US006900781B1

(12) United States Patent
Mori et al.

(10) Patent No.: US 6,900,781 B1
(45) Date of Patent: May 31, 2005

(54) DISPLAY AND METHOD FOR DRIVING THE SAME

(75) Inventors: Mitsuhiro Mori, Ibaraki (JP); Mitsuhiro Kasahara, Hirakata (JP); Yoshinao Oe, Kyoto (JP); Hiroyuki Tachibana, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 549 days.

(21) Appl. No.: 09/868,914

(22) PCT Filed: Nov. 6, 2000

(86) PCT No.: PCT/JP00/07801

§ 371 (c)(1),
(2), (4) Date: Jul. 11, 2001

(87) PCT Pub. No.: WO01/37250

PCT Pub. Date: May 25, 2001

(30) Foreign Application Priority Data

| | | |
|---|---|---|
| Nov. 12, 1999 | (JP) | 11/322724 |
| Feb. 15, 2000 | (JP) | 2000/36931 |
| Apr. 18, 2000 | (JP) | 2000/117032 |
| Sep. 26, 2000 | (JP) | 2000/291987 |
| Sep. 26, 2000 | (JP) | 2000/291988 |

(51) Int. Cl.[7] ..... G09G 3/28
(52) U.S. Cl. ..... 345/60; 345/208; 315/169.1
(58) Field of Search ..... 345/60–68, 208, 345/210, 211; 315/169.1, 169.2, 169.3, 169.4; 313/585–587

(56) References Cited

U.S. PATENT DOCUMENTS

| | | | | |
|---|---|---|---|---|
| 5,952,986 A | * | 9/1999 | Nguyen et al. | 345/68 |
| 6,061,040 A | | 5/2000 | Onodera et al. | |
| 6,369,781 B2 | * | 4/2002 | Hashimoto et al. | 345/60 |
| 6,504,519 B1 | * | 1/2003 | Ryu et al. | 345/60 |
| 2002/0008680 A1 | | 1/2002 | Hashimoto et al. | |

FOREIGN PATENT DOCUMENTS

| | | |
|---|---|---|
| EP | 0755043 | 1/1997 |
| JP | 7-44127 | 2/1995 |
| JP | 8-152865 | 6/1996 |
| JP | 8-314405 | 11/1996 |
| JP | 9-244575 | 9/1997 |
| JP | 9-319329 | 12/1997 |
| JP | 2755201 | 3/1998 |
| JP | 11109914 | 4/1999 |
| JP | 11143422 | 5/1999 |
| JP | 11219150 | 8/1999 |
| JP | 11282396 | 10/1999 |
| JP | 11282415 | 10/1999 |
| JP | 11282416 | 10/1999 |
| JP | 11316572 | 11/1999 |
| JP | 2000206928 | 7/2000 |

OTHER PUBLICATIONS

English Language Abstract of JP–11–282416.
English Language Abstract of JP–11–109914.

(Continued)

*Primary Examiner*—Henry N. Tran
*Assistant Examiner*—Jean Lesperance
(74) *Attorney, Agent, or Firm*—Greenblum & Bernstein, P.L.C.

(57) ABSTRACT

A plasma display having a discharge cell, the emission efficiency of which is improved by generating first and second discharges with one sustaining pulse. A first discharge is generated by increasing a voltage up to a maximal value through a LC resonance formed by a recovery coil and a panel capacitor. A second discharge is generated by connecting the panel capacitor to a power supply when the voltage falls a predetermined amount below the maximal value, thereby increasing the voltage to a predetermined level above the maximal value.

46 Claims, 47 Drawing Sheets

OTHER PUBLICATIONS

English Language Abstract of JP–8–314405.
English Language Abstract of JP–11–219150.
English Language Abstract of JP–9–319329.
English Language Abstract of JP–7–441127.
English Language Abstract of JP 11–109914.
English Language Abstract of JP 11–143422.
English Language Abstract of JP 11–282415.
English Language Abstract of JP–9–244575.
English Language Abstract of JP–11–316572.
English Language Abstract of JP–11–282396.
English Language Abstract of JP–2755201.
English Language Abstract of JP–2000–206928.

* cited by examiner

DISPLAY AND METHOD FOR DRIVING THE SAME

TECHNICAL FIELD

The present invention relates to a display device for selectively discharging a plurality of discharge cells to display an image and a method of driving the same.

BACKGROUND ART

Plasma display devices using PDPs (Plasma Display Panels) have the advantage that thinning and larger screens are possible. In the plasma display devices, images are displayed by utilizing light emission in cases where discharge cells composing pixels are discharged.

FIG. 46 is a diagram for explaining a method of driving discharge cells in an AC-type PDP. As shown in FIG. 46, the surfaces of electrodes 301 and 302 opposite to each other are respectively covered with dielectric layers 303 and 304 in the discharge cell in the AC-type PDP.

As shown in FIG. 46(*a*), when a voltage lower than a discharge start voltage is applied between the electrodes 301 and 302, no discharges are induced. As shown in FIG. 46(*b*), when a voltage in a pulse shape (a write pulse) higher than the discharge start voltage is applied between the electrodes 301 and 302, discharges are induced. When the discharges are induced negative charges are stored on a wall surface of the dielectric layer 303 after moving toward the electrode 301, and positive charges are stored on a wall surface of the dielectric layer 304 after moving toward the electrode 302. The charges stored on the wall surface of the dielectric layer 303 or 304 will be referred to as "wall charges". Further, a voltage induced by the wall charges will be referred to as a "wall voltage".

As shown in FIG. 46(*c*), the negative wall charges are stored on the wall surface of the dielectric layer 303, and the positive wall charges are stored on the wall surface of the dielectric layer 304. In this case, the polarity of the wall voltage is opposite to the polarity of an externally applied voltage. Accordingly, an effective voltage in a discharge space is lowered as the discharges progress, so that the discharges are automatically stopped.

As shown in FIG. 46(*d*), when the polarity of the externally applied voltage is reversed, the polarity of the wall voltage is the same as the polarity of the externally applied voltage. Accordingly, the effective voltage in the discharge space is raised. When the effective voltage at this time exceeds the discharge start voltage, discharges which are opposite in polarity to the discharges shown in FIG. 46(*b*) are induced. Consequently, the positive charges move toward the electrode 301, to neutralize the negative wall charges which have already been stored in the dielectric layer 303. The negative charges move toward the electrode 302, to neutralize the positive wall charges which have already been stored in the dielectric layer 304.

As shown in FIG. 46(*e*), the positive and negative charges are respectively stored on the wall surfaces of the dielectric layers 303 and 304. In this case, the polarity of the wall voltage is opposite to the polarity of the externally applied voltage. Accordingly, the effective voltage in the discharge space is lowered as the discharges progress, so that the discharges are stopped.

Furthermore, as shown in FIG. 46(*f*), when the polarity of the externally applied voltage is reversed, discharges which are opposite in polarity to the discharges shown in FIG. 46(*d*) are induced. Consequently, the negative charges move toward the electrode 301, and the positive charges move toward the electrode 302. The program is then returned to the state shown in FIG. 46(*c*).

After the discharges are thus started once by applying the high write pulse, the discharges can be continued by reversing the polarity of the externally applied voltage (sustain pulses) lower than the write pulse due to the function of the wall charges. To start discharges by applying a write pulse will be referred to as address discharges, and to continue discharges by applying sustain pulses which are alternately reversed will be referred to as sustain discharges.

Description is now made of a sustain driver in a conventional plasma display device for driving discharge cells by the above-mentioned driving method. FIG. 47 is a circuit diagram showing the configuration of the sustain driver in the conventional plasma display device.

As shown in FIG. 47, the sustain driver 600 comprises a recovery capacitor C11, a recovery coil L11, switches SW11, SW12, SW21, and SW22, and diodes D11 and D12.

The switch SW11 is connected between a power supply terminal V11 and a node N11, and the switch SW12 is connected between the node N11 and a ground terminal. A voltage Vsus is applied to the power supply terminal V11. The node N11 is connected to 480 sustain electrodes, for example. In FIG. 47, a panel capacitance Cp corresponding to all capacitances among the plurality of sustain electrodes and the ground terminal is illustrated.

The recovery capacity C11 is connected between a node N13 and the ground terminal. The switch SW21 and the diode D11 are connected in series between the node N13 and a node N12, and the diode D12 and the switch SW22 are connected in series between the node N12 and the node N13. The recovery coil L11 is connected between the node N12 and the node N11.

FIG. 48 is a timing chart showing the operation in a sustain time period of the sustain driver 600 shown in FIG. 47. In FIG. 48, a voltage at the node Nil shown in FIG. 47 and the operations of the switches SW21, SW11, SW22, and SW12 shown in FIG. 47 are illustrated.

First, in a time period Ta, the switch SW21 is turned on, and the switch SW12 is turned off. At this time, the switches SW11 and SW22 are turned off. Consequently, the voltage at the node N11 is gently raised due to LC (Inductance-Capacitance) resonance by the recovery coil L11 and the panel capacitance Cp. Then, in a time period Tb, the switch SW21 is turned off, and the switch SW11 is turned on. Consequently, the voltage at the node N11 is rapidly raised. In a time period Tc, the voltage at the node N11 is fixed to Vsus, so that sustain discharges are induced once by a discharge current supplied from the power supply terminal V11.

Then, in a time period Td, the switch SW11 is turned off, and the switch SW22 is turned on. Consequently, the voltage at the node N11 is gently lowered due to LC resonance by the recovery coil L11 and the panel capacitance Cp. Thereafter, in a time period Te, the switch SW22 is turned off, and the switch SW12 is turned on. Consequently, the voltage at the node N11 is rapidly lowered, and is fixed to a ground potential.

By repeatedly performing the above-mentioned operations in the sustain time period, periodical sustain pulses Psu are applied to the plurality of sustain electrodes, and the discharge cells are discharged when the sustain pulses Psu rise, thereby inducing sustain discharges.

As described in the foregoing, in the conventional plasma display device, the discharge cells are discharged only once when the sustain pulse rises using the sustain driver or the like, and the discharges are stopped until the subsequent sustain pulse is applied. In the discharges induced once, the discharge current is supplied from the power supply, so that a current required for the discharges is sufficiently supplied. However, ultraviolet rays are saturated with respect to the discharge current. Further, the intensity of visible light is also saturated with respect to the ultraviolet rays. Even if the discharge current is increased, therefore, luminance is hardly increased.

The conventional plasma display device is caused to emit light by thus supplying the discharge current from the power supply to induce discharges only once. Accordingly, luminous efficiency is reduced with respect to applied power. When the discharge cells are driven at such a low current level that luminance is not saturated, the discharges themselves are unstable. Consequently, the discharges cannot be repeatedly stably induced.

On the other hand, JP-A-11-282416 discloses that a second voltage Vk and a first voltage Vs (>Vk) are applied to all discharge cells which should be turned on in a sustain time period, to discharge the discharge cells having a low discharge voltage at the second voltage Vk, while discharging the discharge cells having a high discharge voltage at the first voltage Vs, thereby dispersing a discharge current. In this case, each of the discharge cells is discharged once during the half of the sustain time period. After the discharge cells having a low discharge voltage are discharged at the second voltage Vk, however, the discharge cells having a high discharge voltage are discharged at the first voltage Vs. On the whole, it seems that the discharge cells are discharged twice during the half of the sustain time period. In such discharges, however, each of the discharge cells is discharged only once. A discharge current corresponding to the whole of a PDP is merely dispersed. Accordingly, luminous efficiency cannot be improved with respect to all the discharge cells which should be turned on.

Furthermore, JP-A-11-282416, described above discloses that the second voltage Vk ($\leqq$Vs/10) and the first voltage Vs are applied to all the discharge cells which should be turned on in the sustain time period. In this case, the discharge cell having a low discharge voltage is discharged at the first voltage Vs and is discharged again at the second voltage Vk in the subsequent cycle, and the discharge cell having a high discharge voltage is discharged at the first voltage Vs and is weakly discharged again or is not discharged at the second voltage Vk in the subsequent cycle. Also in this case, therefore, all the discharge cells which should be turned on are not discharged twice during the half of the sustain time period. Some of the discharge cells are discharged only once. Accordingly, luminous efficiency cannot be improved with respect to all the discharge cells which should be turned on.

Furthermore, the conventional plasma display device is caused to emit light by supplying a discharge current from the power supply to induce discharges only once. Accordingly, luminous efficiency is reduced with respect to applied power, resulting in increased power consumption. Generally, power consumption in the plasma display device is higher than that in the other display device. It is desired that the power consumption is reduced.

When the discharge cells are driven at such a low current level that luminance is not saturated, the discharges themselves are unstable. Accordingly, the discharges cannot be repeatedly stably induced. In the PDP, various images are displayed. The number of discharge cells which are simultaneously turned on is changed, and a required discharge current is changed. When the discharge cells are driven at a low current level, the discharges are made more unstable.

DISCLOSURE OF THE INVENTION

An object of the present invention is to provide a display device capable of improving the luminous efficiency of all discharge cells which should be turned on and a method of driving the same.

Another object of the present invention is to provide a display device capable of improving the luminous efficiency of all discharge cells which should be turned on as well as capable of repeatedly stably inducing discharges and a method of driving the same.

Still another object of the present invention is to provide a display device capable of repeatedly stably inducing discharges even if the lighting rate is changed as well as capable of improving luminous efficiency corresponding to applied power to reduce power consumption and a method of driving the same.

A display device according to an aspect of the present invention is a display device for selectively discharging a plurality of discharge cells to display an image, characterized by comprising a display panel including the plurality of discharge cells; a first driving circuit for applying a driving pulse to the selected discharge cell in the display panel to induce a first discharge; and a second driving circuit for increasing, after the first discharge is at least weakened by reducing a voltage of the driving pulse, the voltage of the driving pulse again, to induce a second discharge subsequently to the first discharge.

In the display device, the driving pulse is applied to the selected discharge cell in the display panel, to induce the first discharge, and the voltage of the driving pulse is increased again after the first discharge is at least weakened by reducing the voltage of the driving pulse, to induce the second discharge subsequently to the first discharge. Consequently, in the first discharge, only minimum power required for the discharge is applied. Accordingly, the saturation of ultraviolet rays is alleviated by current limitation from the moment the first discharge starts to be weakened, thereby improving luminous efficiency in the first discharge. As a result, the first discharge which is high in luminous efficiency is induced, and the second discharge is further induced by all the discharge cells which should be turned on, thereby making it possible to improve the luminous efficiency of all the discharge cells which should be turned on.

It is preferable that the second driving circuit induces the second discharge while a priming effect produced by the first discharge is obtained.

In this case, the second discharge is induced while the priming effect produced by charged particles, excited atoms, and so forth generated by the first discharge is obtained. Accordingly, the second discharge can be induced in a state where the discharge is easily induced by the priming effect produced by the charged particles, the induced atoms, and so forth remaining in a discharge space by the first discharge, thereby making it possible to stably induce the second discharge. As a result, the first discharge which is high in luminous efficiency is induced, and the second discharge is further stably induced by all the discharge cells which should be turned on. Accordingly, it is possible to improve the luminous efficiency of all the discharge cells which should be turned on and to repeatedly stably induce the discharges.

It is preferable that an interval between the peak of the first discharge and the peak of the second discharge is not less than 100 ns nor more than 550 ns.

In this case, it is possible to obtain the effect of improving luminous efficiency by the first discharge and repetitive discharge stability by the second discharge.

It is preferable that the second driving circuit induces the second discharge after the first discharge is weakened and is completely terminated.

In this case, the saturation of ultraviolet rays is alleviated by current limitation from the moment the first discharge starts to be weakened until the first discharge is terminated, thereby making it possible to completely give the effect of improving luminous efficiency by the first discharge.

It is more preferable that the interval between the peak of the first discharge and the peak of the second discharge is not less than 300 ns nor more than 550 ns.

In this case, it is possible to obtain the effect of improving luminous efficiency by the first discharge almost to its maximum and to obtain repetitive discharge stability by the second discharge.

It is preferable that the peak intensity of the second discharge is not less than the peak intensity of the first discharge.

In this case, the peak intensity of the second discharge is not less than the peak intensity of the first discharge. Accordingly, the second discharge is induced in sufficient intensity, thereby making it possible to sufficiently store wall charges required for the subsequent first discharge and to stably repeat the discharge.

It is preferable that the plurality of discharge cells respectively include capacitive loads, and the first driving circuit comprises an inductance circuit having at least one inductance element having its one end connected to the capacitive load, and a resonance driving circuit for outputting the driving pulse due to LC resonance by the capacitive load and the inductance element.

In this case, the driving pulse is outputted due to LC resonance by the capacitive load and the inductance element. Accordingly, the driving pulse can be generated with small power consumption, and luminous efficiency in the first discharge can be improved by the current-limiting effect of an LC resonance circuit.

It is preferable that the first driving circuit comprises a first capacitive element provided outside the display panel as a current supply source for the driving pulse, the first capacitive element recovering charges stored in the discharge cells.

In this case, a current required for the first discharge is supplied to the capacitive element having a lower current supplying capability than the power supply. Accordingly, the current is not supplied more than required, and no unnecessary power is applied. Further, the first capacitive element is provided separately from the display panel outside the display panel, so that the capacity thereof can be considerably larger than the capacity of the discharge cell in the display panel. Consequently, the discharge current required for the first discharge can be ensured, and the structure of the capacitive element, for example, can be easily changed, thereby making it possible to easily realize the most suitable driving method out of various driving methods. Further, the charges stored in the discharge cell are recovered by the first capacitive element. Accordingly, the charges in the discharge cell can be efficiently used, thereby making it possible to reduce power consumption.

It is preferable that the display device further comprises a third driving circuit for increasing, after the second discharge is at least weakened by reducing the voltage of the driving pulse, the voltage of the driving pulse again, to induce a third discharge subsequently to the second discharge.

In this case, after the second discharge is at least weakened by reducing the voltage of the driving pulse, the voltage of the driving pulse is increased, to induce the third discharge subsequently to the second discharge. Accordingly, the first to third discharges can be induced by minimum applied power required, and luminance at the time of the discharges can be enhanced by continuously inducing the first to third discharges, thereby making it possible to further improve luminous efficiency.

It is preferable that the third driving circuit repeats an operation for increasing, after the discharge is at least weakened by reducing the voltage of the driving pulse, the voltage of the driving pulse again, to continuously induce a plurality of times of discharges subsequent to the second discharge.

In this case, a plurality of times of discharges are induced subsequently to the second discharge. Accordingly, a plurality of times of discharges can be induced in minimum applied power required, and luminance at the time of the discharges can be enhanced by continuously inducing the discharges a plurality of times, thereby making it possible to further improve luminous efficiency.

It is preferable that the second driving circuit comprises a second capacitive element provided outside the display panel as a current supply source for the driving pulse, and a voltage source for charging the second capacitive element to a predetermined voltage.

In this case, a current required for the second discharge is supplied by the second capacitive element charged to a predetermined voltage, that is, the capacitive element having a lower current supplying capability than the power supply. Accordingly, the current is not supplied more than required, and no unnecessary power is applied. Further, the second capacitive element is provided separately from the display panel outside the display panel, so that the capacity thereof can be considerably larger than the capacity of the discharge cell in the display panel. Consequently, the discharge current required for the second discharge can be ensured, and the structure of the capacitive element, for example, can be easily changed, thereby making it possible to easily realize the most suitable driving method out of various driving methods.

It is preferable that the driving pulse includes a driving pulse which makes the transition from a first potential to a second potential and takes a maximal value and a minimal value at least once during the transition from the first potential to the second potential, and the display device further comprises a final driving circuit for driving the driving pulse such that the transition speed from the final extreme value to the second potential is lower than the transition speed from the first potential to an extreme value immediately after that and the transition speed from the subsequent extreme value to an extreme value immediately after that.

In this case, the transition speed from the final extreme value to the second potential can be made lower than the other transition speed. Accordingly, it is possible for the driving pulse to gently make the transition from the last extreme value to the second potential. Consequently, a sharp edge portion is not formed in this portion, thereby making it possible to restrain the radiation of unnecessary electromagnetic waves.

It is preferable that the final driving circuit comprises a field effect transistor having its one end receiving the second potential, and a current-limiting circuit for limiting a current of a control signal inputted to the gate of the field effect transistor.

In this case, when the on-off state of the field effect transistor for the driving pulse to make the transition to the second potential is controlled, the current of the control signal inputted to the gate thereof is limited. Accordingly, charges for forming the channel of the field effect transistor are gently charged or discharged through the gate. Consequently, the opening or closing speed of the channel of the field effect transistor is reduced, thereby making it possible to gently make the transition of the driving pulse to the second potential.

A display device according to another aspect of the present invention is a display device for selectively discharging a plurality of discharge cells to display an image, characterized by comprising a display panel including the plurality of discharge cells; a driving circuit for applying a driving pulse to the selected discharge cell in the display panel to induce a second discharge after inducing a first discharge; a detection circuit for detecting the lighting rate of the discharge cells which are simultaneously turned on out of the plurality of discharge cells; and a control circuit for controlling the driving circuit such that the driving pulse is changed depending on the lighting rate detected by the detection circuit.

In the display device, the lighting rate of the discharge cells which are simultaneously turned on out of the plurality of discharge cells, and the driving pulse which is changed depending on the detected lighting rate is applied to the selected discharge cell in the display panel, to induce the second discharge after inducing the first discharge. Consequently, the most suitable driving pulse corresponding to the lighting rate can be applied. Accordingly, it is possible to induce the first and second discharges to improve luminous efficiency and to repeatedly stably induce the first and second discharges. As a result, it is possible to repeatedly stably induce the discharges even if the lighting rate is changed as well as to improve luminous efficiency corresponding to applied power to reduce power consumption.

It is preferable that the display device further comprises a conversion circuit for converting, in order to divide one field into a plurality of sub-fields and discharge the selected discharge cell for each sub-field to make gray scale expression, image data in the one field into image data in each sub-field, the detection circuit comprises a sub-field lighting rate detection circuit for detecting the lighting rate for each sub-field, and the control circuit controls the driving circuit such that the driving pulse is changed depending on the lighting rate for each sub-field detected by the sub-field lighting rate detection circuit.

In this case, the driving pulse can be changed depending on the lighting rate detected for each sub-field. Accordingly, it is possible to induce the first and second discharges in the most suitable state corresponding to the lighting rate even in a case where gray scale expression is made.

It is preferable that the driving circuit comprises a first driving circuit for increasing the voltage of the driving pulse to induce the first discharge, and a second driving circuit for increasing the voltage of the driving pulse again to induce the second discharge after inducing the first discharge, and the control circuit controls the second driving circuit such that the driving pulse is changed depending on the lighting rate detected by the detection circuit.

In this case, the second discharge is induced after the first discharge is induced. Accordingly, the second discharge can be induced in a state where a discharge space is easily discharged by the first discharge, thereby making it possible to reduce applied power at the time of the second discharge. Further, the discharge current required for the second discharge can be sufficiently supplied by increasing the voltage of the driving pulse again, thereby making it possible to reliably form wall charges for the subsequent discharge and repeatedly stably induce the subsequent first and second discharges.

It is preferable that the second driving circuit increases, after the first discharge is at least weakened by reducing the voltage of the driving pulse, the voltage of the driving pulse, to induce the second discharge subsequent to the first discharge.

In this case, the voltage of the driving pulse is increased again after the first discharge is at least weakened by reducing the voltage of the driving pulse, thereby inducing the second discharge subsequently to the first discharge. Consequently, in the first discharge, the minimum power required for discharges are turned on. Accordingly, the saturation of ultraviolet rays is alleviated by current limitation from the moment the first discharge starts to be weakened, thereby making it possible to improve luminous efficiency.

It is preferable that the control circuit changes the timing at which the second driving circuit increases the voltage of the driving pulse again depending on the lighting rate detected by the detection circuit.

In this case, the timing at which the voltage of the driving pulse is increased is controlled depending on the lighting rate. Accordingly, it is possible to induce the first and second discharges in the most suitable state corresponding to the lighting rate.

It is preferable that the higher the lighting rate detected by the detection circuit is, the later the timing at which the second driving circuit increases the voltage of the driving pulse again is.

In this case, the higher the lighting rate is, the later the timing at which the voltage of the driving pulse is increased again is made. Accordingly, in a portion where the lighting rate is high, the effect of improving luminous efficiency by the first discharge can be sufficiently obtained by sufficiently separating the first discharge and the second discharge. Further, when the timing at which the voltage of the driving pulse is increased again is gradually changed depending on the lighting rate, the state where light is emitted can be changed without giving a visually uncomfortable feeling.

It is preferable that the control circuit controls, when the lighting rate detected by the detection circuit reaches not less than a predetermined value, the second driving circuit such that the second discharge is induced subsequently to the first discharge.

In this case, when the lighting rate reaches not less than the predetermined value, the second driving circuit is controlled such that the second discharge is induced subsequently to the first discharge. The discharge is induced as in the conventional example when the lighting rate is lower than the predetermined value, and the first and second discharges can be induced when the lighting rate is not less than the predetermined value, thereby making it possible to emit light in the most suitable state corresponding to the lighting rate.

It is preferable that the control circuit controls the second driving circuit so as to delay the timing at which the voltage of the driving pulse is increased again with the increase in the lighting rate detected by the detection circuit, and advance the timing at which the voltage of the driving pulse is increased again when the lighting rate is increased to not less than the predetermined value.

In this case, the timing at which the voltage of the driving pulse is increased again can be set to the timing at which power consumption can be further reduced, thereby making it possible to further reduce power consumption.

It is preferable that the control circuit controls the second driving circuit so as to switch the timing at which the second driving circuit increases the voltage of the driving pulse again when the lighting rate detected by the detection circuit reaches not less than a predetermined value and change the number of pulses composing the driving pulse applied to the selected discharge cell in the display panel such that luminance is approximately equal before and after the switching of the timing at which the voltage of the driving pulse is increased again.

In this case, the number of pulses composing the driving pulse applied to the selected discharge cell in the display panel is changed such that the luminance is approximately equal before and after switching the timing at which the voltage of the driving pulse is increased again. Accordingly, the discontinuity of the luminance by switching the timing at which the voltage of the driving pulse is increased again can be corrected, and the timing at which the voltage of the driving pulse is increased can be switched without giving a visually uncomfortable feeling.

It is preferable that the control circuit controls the driving circuit such that the higher the lighting rate detected by the detection circuit is, the longer the period of the driving pulse is.

In this case, even if the voltage of the driving pulse is made lower, the first and second discharges can be stably induced, thereby making it possible to further reduce power consumption.

It is preferable that the control circuit controls the driving circuit so as to switch the period of the driving pulse when the lighting rate detected by the detection circuit reaches not less than a predetermined value and change the number of pulses composing the driving pulse applied to the selected discharge cell in the display panel such that luminance is approximately equal before and after the switching of the period of the driving pulse.

In this case, the number of pulses composing the driving pulse applied to the selected discharge cell in the display panel is changed such that the luminance is approximately equal before and after switching the period of the driving pulse. Accordingly, the discontinuity of the luminance by switching the period of the driving pulse can be corrected, and the period of the driving pulse can be switched without giving a visually uncomfortable feeling.

It is preferable that the driving circuit applies, in the same sub-field, at least one of a first driving pulse for inducing a discharge once by applying one pulse and a second driving pulse for inducing the second discharge after inducing the first discharge, and the control circuit controls the driving circuit so as to change the ratio of the number of times of application of the first driving pulse to the number of times of application of the second driving pulse depending on the lighting rate for each sub-field detected by the sub-field lighting rate detection circuit.

In this case, in the same sub-field, the ratio of the number of times of application of the first driving pulse for inducing the discharge once to the number of times of application of the second driving pulse for inducing the second discharge after inducing the first discharge is changed depending on the lighting rate for each sub-field. Accordingly, all the driving pulses in the same sub-field are not simultaneously switched in switching from the discharge induced once to the first and second discharges, and luminance can be continuously changed by gradually changing the ratio of the two types of driving pulses which differ in the number of times of discharges, thereby making it possible to prevent a flicker from being produced.

It is preferable that the driving circuit applies, in the same sub-field, at least one of a first driving pulse for inducing the first and second discharges at a first time interval and a second driving pulse for inducing the first and second discharges at a second time interval longer than the first time interval, and the control circuit controls the driving circuit so as to change the ratio of the number of times of application of the first driving pulse to the number of times of application of the second driving pulse depending on the lighting rate for each sub-field detected by the sub-field lighting rate detection circuit.

In this case, in the same sub-field, the ratio of the number of times of application of the first driving pulse for inducing the first and second discharges at a first time interval to the number of times of application of the second driving pulse for inducing the first and second discharges at a second time interval is changed depending on the lighting rate for each sub-field. Accordingly, all the driving pulses in the same sub-field are not simultaneously switched in switching from the first and second discharges at a short time interval to the first and second discharges at a long time interval, and luminance can be continuously changed by gradually changing the ratio of the two types of driving pulses which differ in the discharge interval, thereby making it possible to prevent a flicker from being produced.

It is preferable that the period of the second driving pulse is longer than the period of the first driving pulse.

In this case, in the same sub-field, the ratio of the number of times of application of the first driving pulse having a short period to the number of times of application of the second driving pulse having a long period is changed depending on the lighting rate for each sub-field. Accordingly, all the driving pulses in the same sub-field are not simultaneously switched in switching from the first driving pulse having a short period to the second driving pulse having a long period, and luminance can be continuously changed by gradually changing the ratio of the two types of driving pulses which differ in the period, thereby making it possible to prevent a flicker from being produced. Further, even if the voltage of the second driving pulse is further lowered, the first and second discharges can be stably induced, thereby making it possible to further reduce power consumption.

It is preferable that the control circuit controls the driving circuit such that the higher the lighting rate for each sub-field detected by the sub-field lighting rate detection circuit is, the higher the ratio of the number of times of application of the second driving pulse to the number of times of application of the first driving pulse becomes.

In this case, in switching from the first driving pulse to the second driving pulse because the lighting rate for each sub-field is increased, the number of times of application of the second driving pulse is increased as the lighting rate for each sub-field is increased in the same sub-field. Accordingly, luminance can be continuously changed by gradually increasing the ratio of the second driving pulse in switching from the first driving pulse to the second driving pulse.

It is preferable that the control circuit controls the driving circuit so as to increase the ratio of the number of times of application of the second driving pulse to the number of times of application of the first driving pulse with the increase in the lighting rate for each sub-field detected by the sub-field lighting rate detection circuit, and further decrease the ratio of the number of times of application of the second driving pulse to the number of times of application of the first driving pulse with the increase in the lighting rate when the lighting rate is increased to not less than a predetermined value.

In this case, the ratio of the number of times of application of the second driving pulse to the number of times of application of the first driving pulse can be set to a ratio at which power consumption can be further reduced, thereby making it possible to further reduce power consumption.

It is preferable that the first driving circuit comprises a first capacitive element provided outside the display panel as a current supply source for the driving pulse.

In this case, a current required for the first discharges are supplied by the capacitive element having a lower current supplying capability than the power supply. Accordingly, the current is not supplied more than required, and no unnecessary power is applied. Further, the first capacitive element is provided separately from the display panel outside the display panel, so that the capacity thereof can be made considerably larger than the capacity of the discharge cells in the display panel. Therefore, the discharge current required for the first discharge can be ensured, and the structure or the like of the capacitive element can be easily changed, thereby making it possible to easily realize the most suitable driving method out of various driving methods.

It is preferable that the first capacitive element recovers charges stored in the discharge cell.

In this case, the charges stored in the discharge cell are recovered by the first capacitive element. Accordingly, the charges in the discharge cell can be efficiently used, thereby making it possible to reduce power consumption.

It is preferable that the plurality of discharge cells respectively include capacitive loads, and the first driving circuit comprises an inductance circuit having at least one inductance element having its one end connected to the capacitive load, and a resonance driving circuit for outputting the driving pulse due to LC resonance by the capacitive load and the inductance element.

In this case, the driving pulse is outputted due to LC resonance by the capacitive load and the inductance element. Accordingly, the driving pulse can be generated with small power consumption, and luminous efficiency in the first discharge can be improved by the current-limiting effect of an LC resonance circuit.

It is preferable that the inductance circuit includes a variable inductance circuit capable of changing an inductance value, and the display device further comprises an inductance control circuit for changing the inductance value of the variable inductance circuit depending on the lighting rate detected by the detection circuit.

In this case, the inductance value of the variable inductance circuit is controlled depending on the lighting rate. Accordingly, the current required for the discharge can be supplied due to the most suitable LC resonance corresponding to the lighting rate, thereby making it possible to reduce power consumption.

It is preferable that the driving circuit further comprises a third driving circuit for increasing, after the second discharge is at least weakened by reducing the voltage of the driving pulse, the voltage of the driving pulse, to induce a third discharge subsequently to the second discharge, and the control circuit controls the third driving circuit such that the driving pulse is changed depending on the lighting rate detected by the detection circuit.

In this case, after the second discharge is at least weakened by reducing the voltage of the driving pulse, the third discharge is induced subsequently to the second discharge by increasing the voltage of the driving pulse. Accordingly, the first to third discharges can be induced in minimum applied power required, and luminance at the time of the discharge can be enhanced by continuously inducing the first to third discharge, thereby making it possible to further improve luminous efficiency corresponding to applied power.

It is preferable that the third driving circuit repeats an operation for increasing the voltage of the driving pulse again after the discharge is at least weakened by reducing the voltage of the driving pulse, to continuously induce a plurality of times of discharges subsequent to the second discharge, and the control circuit controls the third driving circuit such that the driving pulse is changed depending on the lighting rate detected by the detection circuit.

In this case, the plurality of times of discharges are induced subsequently to the second discharge. Accordingly, the plurality of times of discharges can be induced in minimum applied power required, and luminance at the time of the discharges can be enhanced by continuously inducing the discharges a plurality of times, thereby making it possible to further improve luminous efficiency corresponding to applied power.

It is preferable that the second driving circuit comprises a second capacitive element provided outside the display panel as a current supply source for the driving pulse, and a voltage source for charging the second capacitive element to a predetermined voltage.

In this case, a current required for the second discharge is supplied by the second capacitive element charged to a predetermined voltage, that is, the capacitive element having a lower current supplying capability than the power supply. Accordingly, the current is not supplied more than required, and no unnecessary power is applied. Further, the second capacitive element is provided separately from the display panel outside the display panel, so that the capacity thereof can be made considerably larger than the capacity of the discharge cells in the display panel. Accordingly, the discharge current required for the second discharge can be ensured, and the structure or the like of the capacitive element can be easily changed, thereby making it possible to easily realize the most suitable driving method out of various driving methods.

It is preferable that the voltage source includes a variable voltage source capable of changing its output voltage, and the display device further comprises a voltage control circuit for controlling the output voltage of the variable voltage source such that the higher the lighting rate detected by the detection circuit is, the lower a charging voltage for the second capacitive element becomes.

In this case, the higher the lighting rate is, the lower the charging voltage for the second capacitive element can be made. Even if the lighting rate is increased, and the voltage of the driving pulse is significantly reduced by the first discharge, therefore, the peak voltage of the driving pulse at the time of the second discharge can be kept constant. Consequently, required charges can be supplied to the discharge cells depending on the lighting rate, thereby making it possible to stably induce the second discharge.

It is preferable that the voltage source includes a variable voltage source capable of changing an output voltage, and the display device further comprises a potential detection circuit for detecting a potential of the driving pulse which is changed by the first discharge, and a voltage control circuit for controlling an output voltage of the variable voltage source such that the larger the amount of change in the potential detected by the potential detection circuit is, the lower the charging voltage for the second capacitive element becomes.

In this case, the larger the amount of change in the potential of the driving pulse which is reduced by the first discharge is, the lower the charging voltage for the second capacitive element can be made. Even if the lighting rate is increased, and the voltage of the driving pulse is significantly reduced by the first discharge, therefore, the peak voltage of the driving pulse at the time of the second discharge can be kept constant. Consequently, required charges can be supplied to the discharge cells depending on the lighting rate. Further, the amount of change in the potential of the driving pulse is directly detected. Accordingly, the peak voltage of the driving pulse at the time of the second discharge can be adjusted with higher precision, thereby making it possible to more stably induce the second discharges.

A method of driving a display device according to another aspect of the present invention is a method of selectively discharging a plurality of discharge cells to display an image, characterized by comprising the steps of applying a driving pulse to the selected discharge cell to induce a first discharge; and increasing, after the first discharge is at least weakened by reducing a voltage of the driving pulse, the voltage of the driving pulse again, to induce a second discharge subsequently to the first discharge.

In the method of driving the display device, the driving pulse is applied to the selected discharge cell in the display panel, to induce the first discharge, and the voltage of the driving pulse is increased again after the first discharge is at least weakened by reducing the voltage of the driving pulse, to induce the second discharge subsequently to the first discharge. Consequently, in the first discharge, only the minimum power required for the discharge is applied. Accordingly, the saturation of ultraviolet rays is alleviated by current limitation from the moment the first discharge starts to be weakened, so that luminous efficiency in the first discharge is improved. As a result, the first discharge which is high in luminous efficiency is induced, and the second discharge is further induced by all the discharge cells which should be turned on, thereby making it possible to improve the luminous efficiency of all the discharge cells which should be turned on.

It is preferable that the method of driving a display deice further comprises the step of increasing, after the second discharge is at least weakened by reducing the voltage of the driving pulse, the voltage of the driving pulse again, to induce a third discharge subsequently to the second discharge.

In this case, the third discharge is induced subsequently to the second discharge by increasing the voltage of the driving pulse after the second discharge is at least weakened by reducing the voltage of the driving pulse. Accordingly, the first to third discharges can be induced in minimum applied power required, and luminance at the time of the discharges can be enhanced by continuously inducing the first to third discharges, thereby making it possible to further improve luminous efficiency.

It is preferable that the step of inducing the third discharge further comprises the step of repeating an operation for increasing, after the discharge is at least weakened by reducing the voltage of the driving pulse, the voltage of the driving pulse again, to continuously induce a plurality of times of discharges subsequently to the second discharge.

In this case, the plurality of times of discharges are induced subsequently to the second discharge. Accordingly, the plurality of times of discharges can be induced in minimum applied power required, and luminance at the time of the discharges can be enhanced by continuously inducing the discharges a plurality of times, thereby making it possible to further improve luminous efficiency.

It is preferable that the driving pulse includes a driving pulse which makes the transition from a first potential to a second potential and takes a maximal value and a minimal value at least once during the transition from the first potential to the second potential, and the method of driving the display device further comprises the step of driving the driving pulse such that the transition speed from the final extreme value to the second potential is lower than the transition speed from the first potential to an extreme value immediately after that and the transition speed from the subsequent extreme value to an extreme value immediately after that.

In this case, the transition speed from the final extreme value to the second potential can be made lower than the other transition speed. Accordingly, it is possible to gently make the transition of the driving pulse from the last extreme value to the second potential. Consequently, a sharp edge is not formed in this portion, thereby making it possible to restrain the radiation of unnecessary electromagnetic waves.

A method of driving a display device according to still another aspect of the present invention is a method of selectively discharging a plurality of discharge cells to display an image, characterized by comprising the steps of detecting the lighting rate of the discharge cells which are simultaneously turned on out of the plurality of discharge cells; and changing the driving pulse depending on the lighting rate detected by the detecting step to apply the driving pulse to the selected discharge cell, and inducing a second discharge after inducing a first discharge.

In the method of driving the display device, the lighting rate of the discharge cells which are simultaneously turned on out of the plurality of discharge cells is detected, and the driving pulse which is changed depending on the detected lighting rate are applied to the selected discharge cell in the display panel, to induce the second discharge after inducing the first discharge. Consequently, the most suitable driving pulse corresponding to the lighting rate can be applied. Accordingly, it is possible to induce the first and second discharges to improve luminous efficiency and to repeatedly stably induce the first and second discharges. As a result, it is possible to repeatedly stably induce the discharges even if the lighting rate is changed as well as to improve luminous efficiency corresponding to applied power to reduce power consumption.

It is preferable that the step of inducing the first and second discharges comprises the steps of increasing the voltage of the driving pulse applied to the selected discharge cell, to induce the first discharge, and increasing the voltage of the driving pulse again to induce the second discharge after inducing the first discharge, and changing the driving pulse depending on the lighting rate detected by the detecting step.

In this case, the second discharge is induced after the first discharge is induced. Accordingly, the second discharge can be induced in a state where a discharge space is easily discharged by the first discharge, thereby making it possible to also reduce applied power at the time of the second discharge. Further, a discharge current required for the second discharge can be sufficiently supplied by increasing the voltage of the driving pulse again, thereby making it possible to reliably form wall charges for the subsequent discharge and repeatedly stably induce the subsequent first and second discharges.

It is preferable that the step of inducing the second discharge comprises the step of increasing, after the first discharge is at least weakened by reducing the voltage of the driving pulse, the voltage of the driving pulse again, to induce the second discharge subsequently to the first discharge, and changing the timing at which the voltage of the driving pulse is increased again depending on the lighting rate detected by the detecting step.

In this case, the voltage of the driving pulse is increased again after the first discharge is at least weakened by reducing the voltage of the driving pulse, thereby inducing the second discharge subsequently to the first discharge. Consequently, the minimum power required for the discharge is applied in the first discharge. Accordingly, the saturation of ultraviolet rays is alleviated by current limitation from the moment the first discharge starts to be weakened, thereby making it possible to improve luminous efficiency. At this time, the timing at which the voltage of the driving pulse is increased again is controlled depending on the lighting rate, thereby making it possible to induce the first and second discharges in the most suitable state corresponding to the lighting rate.

BEST MODE FOR CARRYING OUT THE INVENTION

Figure 1:
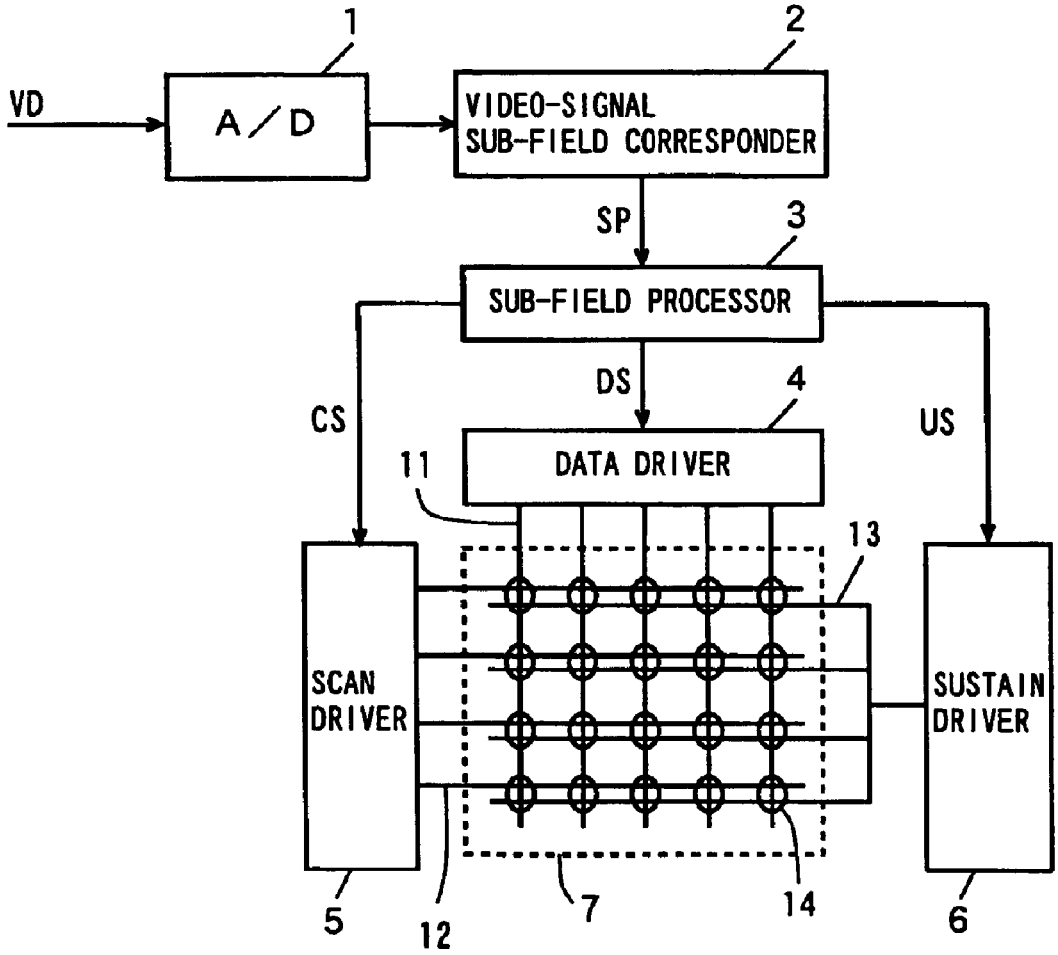
FIG. 1 is a block diagram showing the configuration of a plasma display device according to a first embodiment of the present invention.

An AC-type plasma display device will be described as an example of a display device according to the present invention. FIG. 1 is a block diagram showing the configuration of the plasma display device according to a first embodiment of the present invention.

The plasma display device shown in FIG. 1 comprises an A/D converter (an analog-to-digital converter) 1, a video signal/sub-field corresponder 2, a sub-field processor 3, a data driver 4, a scan driver 5, a sustain driver 6, and a PDP (Plasma Display Panel) 7.

A video signal VD is inputted to the A/D converter 1. The A/D converter 1 converts the analog video signal VD into digital image data, and outputs the digital image data to the video signal/sub-field corresponder 2. The video signal/sub-field corresponder 2 divides one field into a plurality of sub-fields and displays the sub-fields. Therefore, image data SP for each of the sub-fields is generated from the image data in the one field, and is outputted to the sub-field processor 3.

The sub-field processor 3 generates a data driver driving control signal DS, a scan driver driving control signal CS, and a sustain driver driving control signal US from the image data SP for each of the sub-fields, for example, and respectively outputs the signals to the data driver 4, the scan driver 5, and the sustain driver 6.

The PDP 7 comprises a plurality of address electrodes (data electrodes) 11, a plurality of scan electrodes 12, and a plurality of sustain electrodes 13. The plurality of address electrodes 11 are arranged in the vertical direction on a screen, and the plurality of scan electrodes 12 and the plurality of sustain electrodes 13 are arranged in the horizontal direction on the screen. Further, the plurality of sustain electrodes 13 are together connected. A discharge cell 14 is formed at each of the intersections of the address electrodes 11, the scan electrodes 12, and the sustain electrodes 13. The discharge cell 14 constitutes a pixel on the screen.

The data driver 4 is connected to the plurality of address electrodes 11 in the PDP 7. The scan driver 5 has driving circuits respectively provided for the scan electrodes 12 provided therein, and each of the driving circuits is connected to the corresponding scan electrode 12 in the PDP 7. The sustain driver 6 is connected to the plurality of sustain electrodes 13 in the PDP 7.

The data driver 4 applies a write pulse to the corresponding address electrode 11 in the PDP 7 in response to the image data SP in a write time period in accordance with the data driver driving control signal DS. The scan driver 5 successively applies the write pulse to the plurality of scan electrodes 12 in the PDP 7 while shifting a shift pulse in the vertical scanning direction in the write time period in accordance with the scan driver driving control signal CS. Consequently, address discharges are induced in the corresponding discharge cell 14.

Furthermore, the scan driver 5 applies periodical sustain pulses to the plurality of scan electrodes 12 in the PDP 7 in a sustain time period in accordance with the scan driver driving control signal CS. On the other hand, the sustain driver 6 simultaneously applies to the plurality of sustain electrodes 13 in the PDP 7 sustain pulses which are shifted in phase by 180° from the sustain pulses applied to the scan electrodes 12. Consequently, sustain discharges are induced in the corresponding discharge cell 14.

Figure 2:
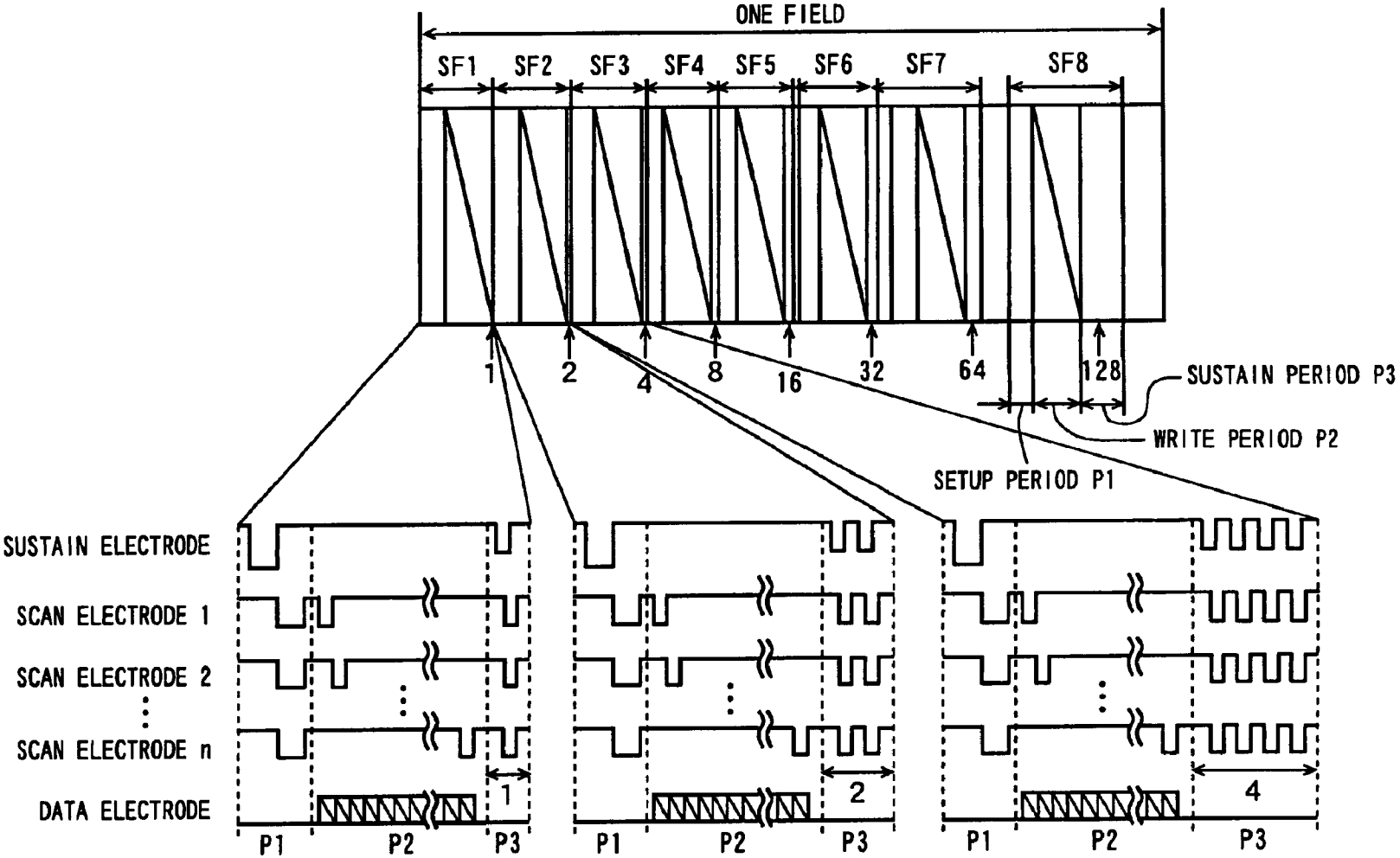
FIG. 2 is a diagram for explaining an ADS system used in the plasma display device shown in FIG. 1.

In the plasma display device shown in FIG. 1, an example of gray scale expression is an ADS (Address Display-Period Separated) system. FIG. 2 is a diagram for explaining the ADS system applied to the plasma display device shown in FIG. 1. Although in FIG. 2, an example of a negative-polarity pulse for inducing discharges when a driving pulse falls is illustrated, the basic operation is the same as below even in the case of a positive-polarity pulse for inducing discharges when the driving pulse rises.

In the ADS system, one field (1/60 seconds=16.67 ms) is divided into a plurality of sub-fields on a time basis. When 256 gray scale expression is made by eight bits, for example, one field is divided into eight sub-fields SF1 to SF8. Each of the sub-fields SF1 to SF8 is separated into a setup time period P1, a write time period P2, and a sustain time period P3. Setup processing of each of the sub-fields is performed in the setup time period P1, address discharges for selecting the discharge cell 14 which is tuned on are induced in the write time period P2, and sustain discharges for display are induced in the sustain time period P3.

In the setup time period P1, a single pulse is applied to the sustain electrode 13. A single pulse is applied to each of the scan electrodes 12 (although the number of scan electrodes is n in FIG. 2, the number of scan electrodes is actually 480, for example). Consequently, preliminary discharges are induced.

In the write time period P2, the scan electrodes 12 are successively scanned, so that predetermined writing processing to only the discharge cell 14 which has received the pulse from the address electrode 11 is performed. Consequently, address discharges are induced.

In the sustain time period P3, a sustain pulse corresponding to a value with which each of the sub-fields SF1 to SF8 is weighted is outputted to the sustain electrode 13 and the scan electrodes 12. For example, in the sub-field SF1, the sustain pulse is applied once to the sustain electrode 13, and the sustain pulse is applied once to the scan electrodes 12, so that sustain discharges are induced twice in the discharge cell 14 selected in the write time period P2. Further, in the sub-field SF2, the sustain pulse is applied twice to the sustain electrode 13, and the sustain pulse is applied twice to the scan electrode 12, so that sustain discharges are induced four times in the discharge cell 14 selected in the write time period P2.

As described in the foregoing, in each of the sub-fields SF1 to SF8, the sustain pulse is applied once, twice, four times, eight times, 16 times, 32 times, 64 times, and 128 times to the sustain electrode 13 and the scan electrodes 12, so that the discharge cell 14 emits light in brightness (luminance) corresponding to the number of pulses. That is, the sustain time period P3 is a time period during which the discharge cell 14 selected in the write time period P2 is discharged a number of times corresponding to a brightness value with which the sub-field is weighted.

The sub-fields SF1 to SF8 are respectively weighted with brightness values 1, 2, 4, 8, 16, 32, 64, 128. The sub-fields SF1 to SF8 are combined, thereby making it possible to adjust the level of the brightness on 256 gray scales from 0 to 255. The number of sub-fields obtained by the division, the values with which the sub-fields are respectively weighted, and so forth are not particularly limited to those in the above-mentioned example. Various changes are possible. In order to reduce a pseudo contour of a moving picture, for example, the sub-field SF8 may be divided into two sub-fields, to set a value with which the two sub-fields are weighted to 64.

Figure 3:
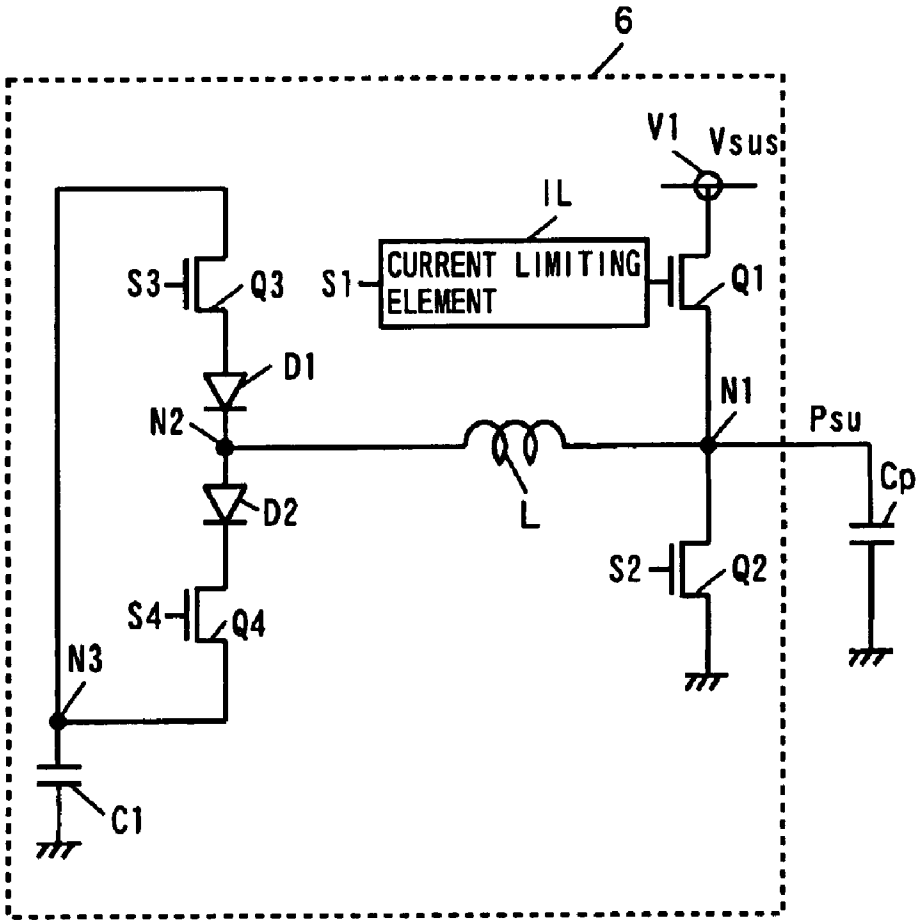
FIG. 3 is a circuit diagram showing the configuration of a sustain driver shown in FIG. 1.

The sustain driver 6 shown in FIG. 1 will be described in detail. FIG. 3 is a circuit diagram showing the configuration of the sustain driver 6 shown in FIG. 1. The scan driver 5 is configured and operated similarly to the sustain driver 6. Therefore, the detailed description of the scan driver 5 is omitted, and only the sustain driver 6 will be described in detail below. Although in the following description, an example of a positive-polarity pulse for inducing discharges when the driving pulse rises is illustrated, a negative-polarity pulse for inducing discharges when the driving pulse falls may be used.

The sustain driver 6 shown in FIG. 3 comprises FETs (Field Effect Transistors, which are hereinafter referred to as transistors) Q1 to Q4, a recovery capacitor C1, a recovery coil L, diodes D1 and D2, and a current-limiting element IL.

The transistor Q1 has its one end connected to a power supply terminal V1 and has the other end connected to a node N1. A voltage Vsus is applied to the power supply terminal V1. The current-limiting element IL is constituted by a resistor having a predetermined resistance value, for example, and has its one end receiving a control signal S1 and has the other end connected to the gate of the transistor Q1. The transistor Q2 has its one end connected to the node N1 and has the other end connected to a ground terminal, and has its gate receiving a control signal S2.

Although the node N1 is connected to the 480 sustain electrodes 13, for example, a panel capacitance Cp corresponding to all capacitances between the plurality of sustain electrodes 13 and the ground terminal is illustrated in FIG. 3. In respect to this point, the same is true for a sustain driver according to another embodiment, described below.

The recovery capacitor C1 is connected between a node N3 and the ground terminal. The transistor Q3 and the diode D1 are connected in series between the node N3 and a node N2. The diode D2 and the transistor Q4 are connected in series between the node N2 and the node N3. A control signal S3 is inputted to the gate of the transistor Q3, and a control signal S4 is inputted to the gate of the transistor Q4. The recovery coil L is connected between the node N2 and the node N1.

In the present embodiment, the PDP 7 corresponds to a display panel, the scan driver 5 and the sustain driver 6 correspond to first and second driving circuits and a final driving circuit, and the video signal/sub-field corresponder 2 corresponds to a conversion circuit. The recovery coil L, the recovery capacitor C1, the transistor Q3, and the diode D1 correspond to a first driving circuit, and the transistor Q1, the current-limiting element IL, and the power supply terminal V1 correspond to a second driving circuit. Further, the recovery capacitor C1 corresponds to a first capacitive element, the recovery coil L corresponds to an inductance circuit and an inductance element, the recovery capacitor C1, the transistor Q3, and the diode D1 correspond to a resonance driving circuit, the transistor Q1 corresponds to a field effect transistor, and the current-limiting element IL corresponds to a current-limiting circuit.

Figure 4:
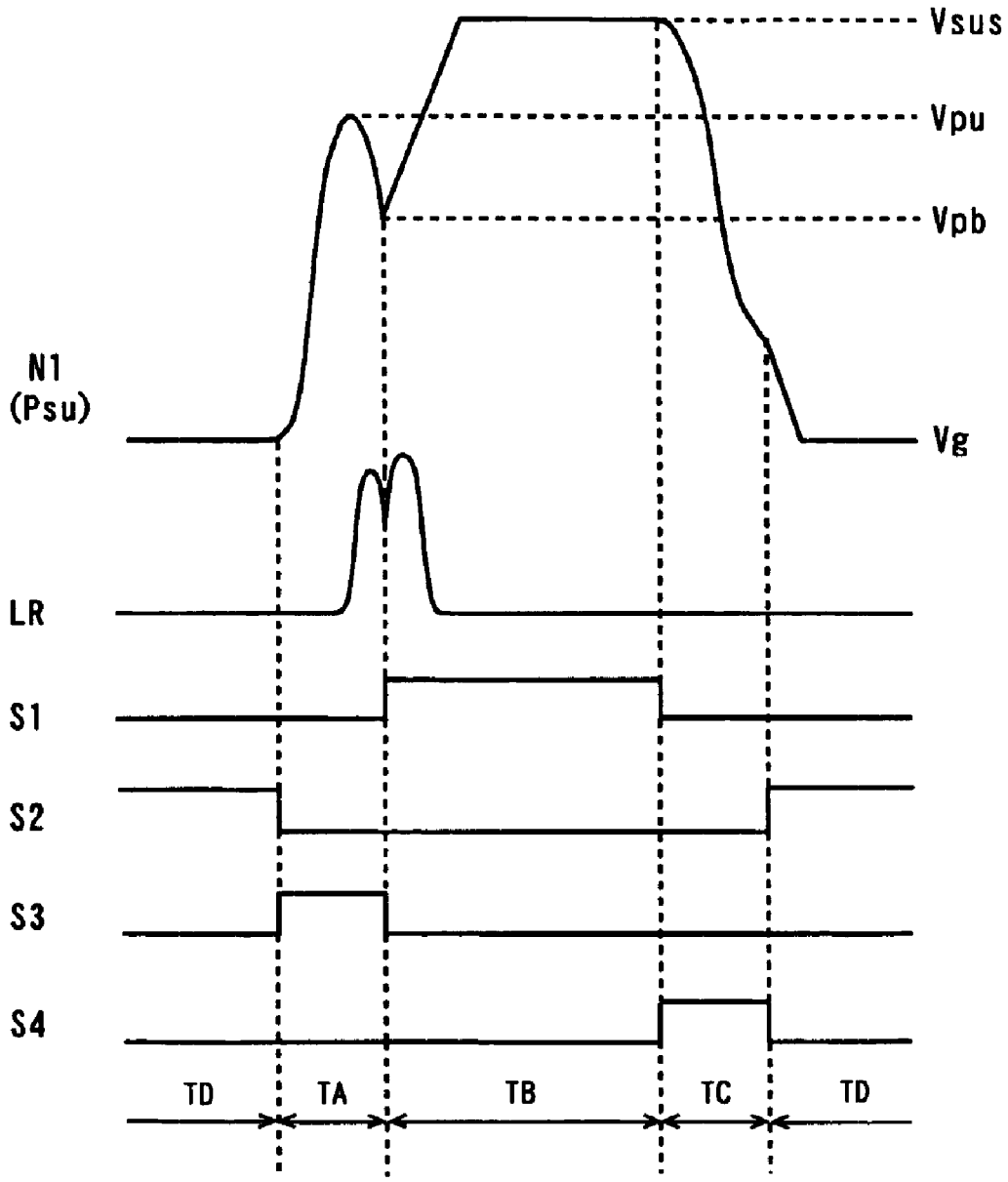
FIG. 4 is a timing chart showing an example of the operation in a sustain time period of the sustain driver shown in FIG. 3 in a case where first and second discharges are continuously induced at the time of sustain discharges.

FIG. 4 is a timing chart showing an example of the operation in a sustain time period of the sustain driver 6 shown in FIG. 3 in a case where first and second discharges are continuously induced at the time of sustain discharges. In FIG. 4, a voltage at the node N1 shown in FIG. 3, discharge intensity LR in the PDP 7, and the control signals S1 to S4 inputted to the transistors Q1 to Q4 are illustrated. The control signals S1 to S4 are signals outputted from the sub-field processor 3 as the sustain driver driving control signal US.

The discharge intensity is measured by the following method. In the case of the PDP using mixed gas containing xenon, its light emission utilizes vacuum ultraviolet rays (a wavelength of 147 nm) generated at the time of discharges from xenon at a resonance level. The vacuum ultraviolet rays cannot be observed in the air beyond a front glass of the PDP. On the other hand, it is considered that near infrared rays (a wavelength of 828 nm) are emitted in the case of the transition from an energy level higher than the resonance level to the resonance level, and the near infrared rays are approximately proportional to the discharge intensity. Therefore, in the present specification, the intensity of the near infrared rays is measured with respect to one discharge cell using an avalanche photodiode having spectral sensitivity characteristics in a near infrared area, for example, and is taken as the discharge intensity.

Consequently, the continuous first and second discharges, described below, mean that the second discharge is induced subsequently to the first discharge for each discharge cell, and all the discharge cells which should be turned on in the PDP are always discharged twice, and do not include a case where the discharge cells which are discharged early and the discharge cells which are discharged late are respectively discharged only once at different timings due to the variation in the discharge cells.

First, in a time period TA, the control signal S2 enters a low level so that the transistor Q2 is turned off, and the control signal S3 enters a high level so that the transistor Q3 is turned on. At this time, the control signal S1 is at a low level so that the transistor Q1 is turned off, and the control signal S4 is at a low level so that the transistor Q4 is turned off. Consequently, the recovery capacitor C1 is connected to the recovery coil L through the transistor Q3 and the diode D1, so that the voltage at the node N1 is smoothly raised from a ground potential Vg due to LC resonance by the recovery coil L and the panel capacitance Cp. At this time, charges on the recovery capacitor C1 are emitted to the panel capacitance Cp through the transistor Q3, the diode D1, and the recovery coil L.

When the voltage at the node N1 is raised, to exceed a discharge start voltage in the sustain time period, and the discharge cell 14 starts the first discharge, the discharge intensity LR starts to be increased. Thereafter, the first discharge is increased to some extent. When a required discharge current exceeds the current supplying capability of a circuit comprising the recovery capacitor C1 and the recovery coil L, the voltage at the node N1 is lowered from a maximal value Vpu to a minimal value Vpb. Accordingly, the first discharge is weakened and correspondingly, the discharge intensity LR is also reduced. The saturation of the amount of emission of ultraviolet rays starts to be alleviated by current limitation from the moment the first discharge starts to be weakened. Thereafter, the amount of saturation of the ultraviolet rays corresponding to the discharge current is reduced, resulting in improved luminous efficiency.

Then in a time period TB, the control signal S1 enters a high level so that the transistor Q1 is turned on, and the control signal S3 enters a low level so that the transistor Q3 is turned off. At this time, a current of the control signal S1 is limited by the current-limiting element IL, and charges for forming the channel of the transistor Q1 are gently charged through the gate of the transistor Q1. Consequently, the opening speed of the channel of the transistor Q1 is reduced. Accordingly, the voltage at the node N1 is gently raised to Vsus at a rising speed lower than a rising speed in the time period TA, that is, a rising speed (voltage/time) from the ground potential Vg to the maximal value Vpu. Consequently, an edge portion which is rapidly changed is not formed in the sustain pulse Psu, thereby restraining the radiation of unnecessary electromagnetic waves.

When the radiation of the electromagnetic waves is not a problem, the current-limiting element IL may not be provided. In this case, the voltage at the node N1 is raised to Vsus at a rising speed higher than the rising speed (voltage/time) from the ground potential Vg to the maximal value Vpu.

When the voltage at the node N1 is raised from the minimal value Vpb, to exceed the discharge start voltage again, the second discharge is started subsequently the first discharge in the discharge cell 14, and the discharge intensity LR starts to be increased again. At this time, the second discharge is induced subsequently to the first discharge. At the time of the second discharge, therefore, the discharge is easily induced by a priming effect produced by charged particles, excited atoms, and so forth remaining in a discharge space by the first discharge, thereby making it possible to stably induce the second discharge.

At the time of the second discharge, the discharge current is not limited from the power supply terminal V1 and is sufficiently supplied. Accordingly, the second discharge has a sufficient intensity, that is, a larger peak value than the peak value of the first discharge. Accordingly, wall charges required for the subsequent first discharge is then sufficiently stored, thereby making it possible to stably repeat the sustain discharge.

Thereafter, when the voltage at the node N1 is held at Vsus, the second discharge is stopped as in the conventional example and correspondingly, the discharge intensity LR is also decreased.

When the first and second discharges are induced continuously in the discharge cell 14, as described above, it is considered that luminous efficiency is improved by the following reasons:

First in the first discharge, charges required for the discharges are supplied from the recovery capacitor C1 through the recovery coil L, so that a current to be supplied is limited to a value determined by a resonance circuit comprising the panel capacitance Cp and the recovery coil L. Further, a supply source for the discharge current is the recovery capacitor C1. When the discharge is increased, therefore, sufficient charges cannot be supplied. Accordingly, the first discharge is weakened or stopped as the voltage at the node N1 is lowered. That is, in the first discharge, the minimum charges required for the discharge is only supplied, unlike the case of discharges by supplying the current from the power supply which is connected without through an inductance element or the like and to which sufficient charges can be supplied. Accordingly, the saturation of the amount of emission of ultraviolet rays starts to be alleviated by current limitation from the moment the first discharge starts to be weakened. Thereafter, the saturation of the ultraviolet rays corresponding to the discharge current is reduced, resulting in improved luminous efficiency. Consequently, an extra discharge current which does not contribute to the emission of a fluorescent member in the discharge cell 14 does not flow, thereby making it possible to improve luminous efficiency corresponding to applied power.

In the second discharge, a wall voltage is lowered by the first discharge, so that the discharge is induced in a state where an effective voltage applied to the discharge space is significantly low, that is, a state where no voltage is excessively applied. Accordingly, luminous efficiency is also improved to some extent even in the second discharge.

The luminous efficiency can be thus improved by continuously inducing the first and second discharge. Accordingly, power consumption can be reduced by improving luminous efficiency corresponding to applied power. When the applied power is not lowered, the power saved by the improvement in the luminous efficiency can be used for improving display luminance by the increase in the number of times of light emission.

Then in a time period TC, the control signal S1 enters a low level so that the transistor Q1 is turned off, and the control signal S4 enters a high level so that the transistor Q4 is turned on. Consequently, the recovery capacitor C1 is connected to the recovery coil L through the diode D2 and the transistor Q4, so that the voltage at the node N1 is gently lowered due to LC resonance by the recovery coil L and the panel capacitance Cp. At this time, charges stored in the panel capacitance Cp are stored in the recovery capacitor C1 through the recovery coil L, the diode D2, and the transistor Q4, so that the charges are recovered.

Then in a time period TD, the control signal S2 enters a high level so that the transistor Q2 is turned on, and the control signal S4 enters a low level so that the transistor Q4 is turned off. Consequently, the node N1 is connected to the ground terminal, so that the voltage at the node N1 is lowered and is fixed to the ground potential Vg.

By repeating the above-mentioned operations in the sustain time period, the periodical sustain pulses Psu for continuously inducing the first and second discharges can be applied to the plurality of sustain electrodes 13 at the time of the rise from the ground potential Vg to the voltage Vsus. In the above-mentioned manner, sustain pulses having the same waveform as the sustain pulses Psu and shifted in phase by 180° therefrom are also periodically applied to the scan electrode 12 by the scan driver 5.

Description is now made of the relationship between a peak interval between the peak value of the first discharge and the peak value of the second discharge and luminous efficiency in a case where the first and second discharges are continuously induced, as described above.

Figure 5:
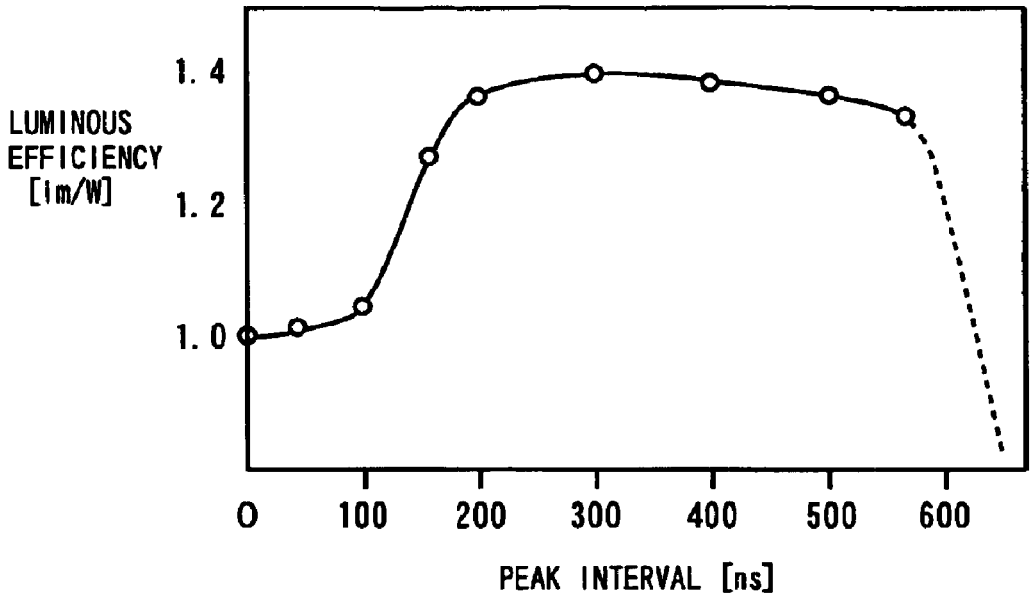
FIG. 5 is a diagram showing the relationship between a perk interval of discharge intensity and luminous efficiency in the plasma display device shown in FIG. 1.

FIG. 5 is a diagram showing the relationship between a peak interval in discharge intensity and luminous efficiency in the plasma display device shown in FIG. 1. FIGS. 6 to 9 are timing charts showing the operation in a sustain time period of the sustain driver 6 shown in FIG. 3 in cases where a peak interval in discharge intensity in the plasma display device shown in FIG. 1 is 100 ns, 300 ns, 550 ns, and 600 ns.

In FIG. 5, luminous efficiency used to enter the vertical axis is luminous efficiency (lm/W) corresponding to applied power excluding ineffective power, and a peak interval used to enter the horizontal axis is a peak interval (ns) between the peak value of the first discharge and the peak value of the second discharge in the discharge intensity in the measurements of near infrared rays. FIGS. 6 to 9 illustrate a voltage at the node N1 shown in FIG. 3, discharge intensity LR in the PDP 7, and the control signals S1 to S4 inputted to the transistors Q1 to Q4.

Each of the timing charts shown in FIGS. 6 to 9 shows a case where the sustain period of the sustain pulse is set to a sufficiently long period, and is the same as the timing chart shown in FIG. 4 except for the timing at which the control signal S1 is changed to a high level (the timing at which the control signal S3 is changed to a low level).

As shown in FIG. 5, the effect of improving luminous efficiency by the first discharge appears when the peak interval is not less than 100 ns, while being the maximum when the peak interval is 300 ns. Thereafter, the effect of improving luminous efficiency by the first discharge is continued in approximately the maximum state until the peak interval reaches 500 ns, and the luminous efficiency is rapidly decreased when the peak interval exceeds 550 ns. The discharged state in each of the peak intervals will be described in detail below.

Figure 6:
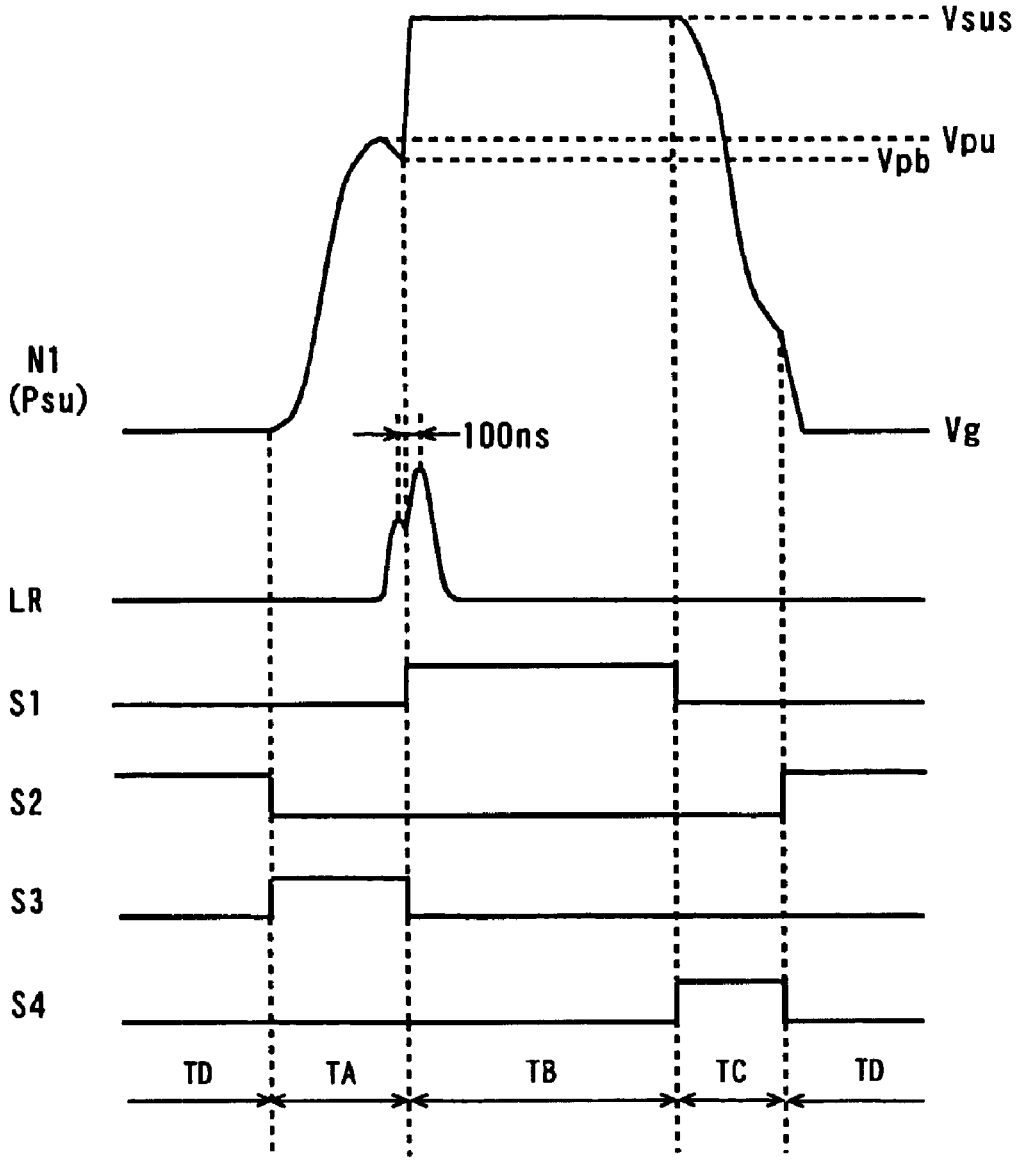
FIG. 6 is a timing chart showing the operation in a sustain time period of the sustain driver shown in FIG. 3 in a case where a peak interval in discharge intensity in the plasma display device shown in FIG. 1 is 10 ns.

When the peak interval is first 100 ns, as shown in FIG. 6, the voltage at the node N1 is smoothly raised from the ground potential Vg due to LC resonance by the recovery coil L and the panel capacitance Cp. When the voltage at the node N1 exceeds the discharge start voltage, the first discharge is started, so that the discharge intensity LR starts to be increased. Thereafter, the first discharge is increased to some extent. When a required discharge current exceeds the current supplying capability of a circuit comprising the recovery capacitor C1 and the recovery coil L, the voltage at the node N1 is lowered from the maximal value Vpu to the minimal value Vpb, so that the first discharge is weakened and correspondingly, the discharge intensity LR is also slightly reduced. The saturation of the amount of emission of ultraviolet rays starts to be alleviated by current limitation from the moment the first discharge starts to be weakened. Thereafter, the saturation of the ultraviolet rays corresponding to the discharge current is reduced in a time period elapsed until the voltage at the node N1 is raised again, resulting in improved luminous efficiency.

When the discharge current is then supplied from the power supply terminal V1, and the voltage at the node N1 is raised again, the second discharge is induced subsequently to the first discharge, and the discharge intensity LR is also increased. At this time, the second discharge has a sufficient intensity, that is, a larger peak value than the peak value of the first discharge. Accordingly, wall charges required for the subsequent first discharge are sufficiently stored, thereby making it possible to stably repeat the sustain discharges.

Figure 7:
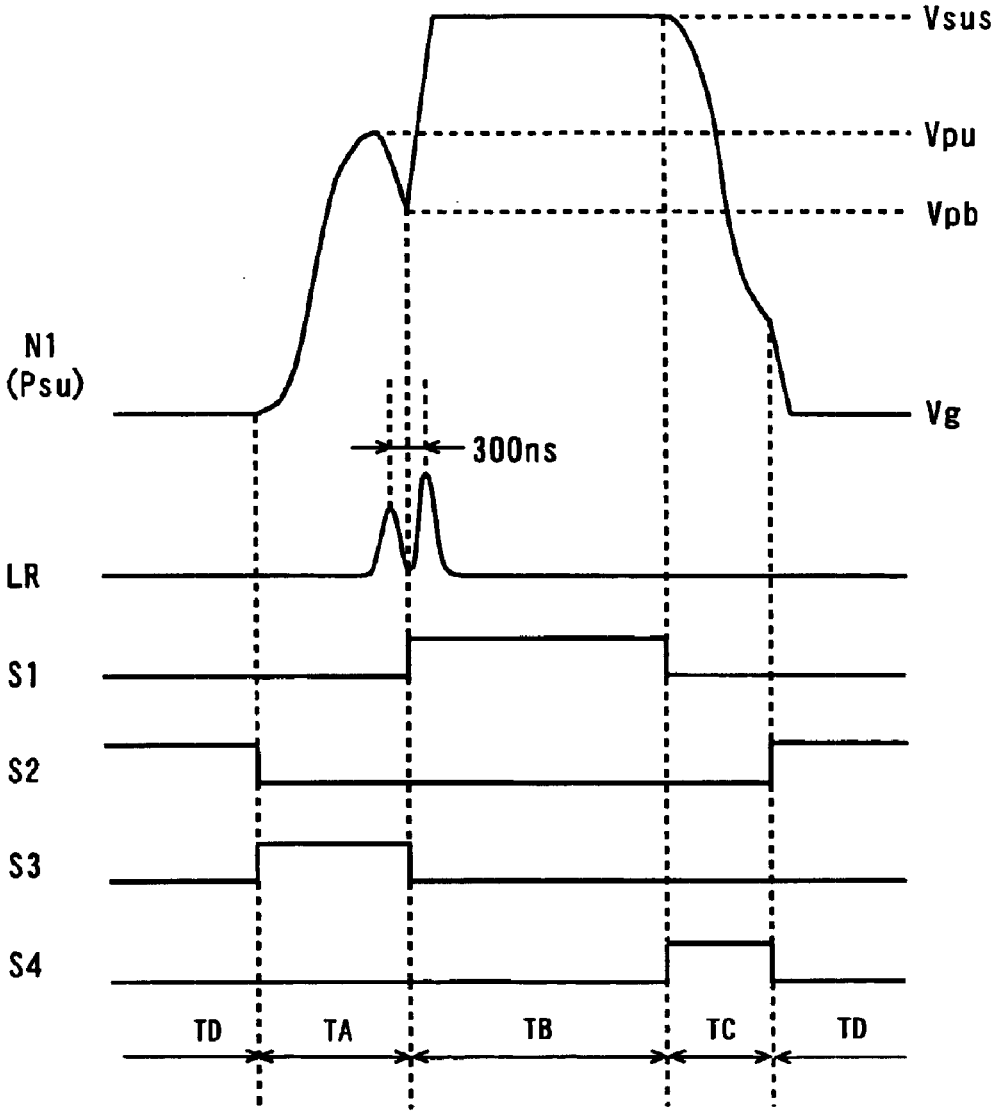
FIG. 7 is a timing chart showing the operation in a sustain time period of the sustain driver shown in FIG. 3 in a case where a peak interval in discharge intensity in the plasma display device shown in FIG. 1 is 30 ns.

Then, when the peak interval is 300 ns, as shown in FIG. 7, the minimal value Vpb at the time of the first discharge is further lowered so that the first discharge is completely terminated once. Thereafter, when the discharge current is supplied from the power supply terminal V1, the second discharge is induced. The first discharge and the second discharge are thus continuously induced in a separated state, so that the peak value of the second discharge is larger than the peak value of the first discharge.

In this case, the saturation of the amount of emission of ultraviolet rays is alleviated by current limitation from the moment the first discharge starts to be weakened until the first discharge is stopped, thereby making it possible to completely give the effect of improving luminous efficiency by the first discharge. Further, the second discharge has a sufficient intensity, that is, a larger peak value than the peak value of the first discharge. Accordingly, wall charges required for the subsequent first discharge are sufficiently stored, thereby making it possible to stably repeat the sustain discharges.

Figure 8:
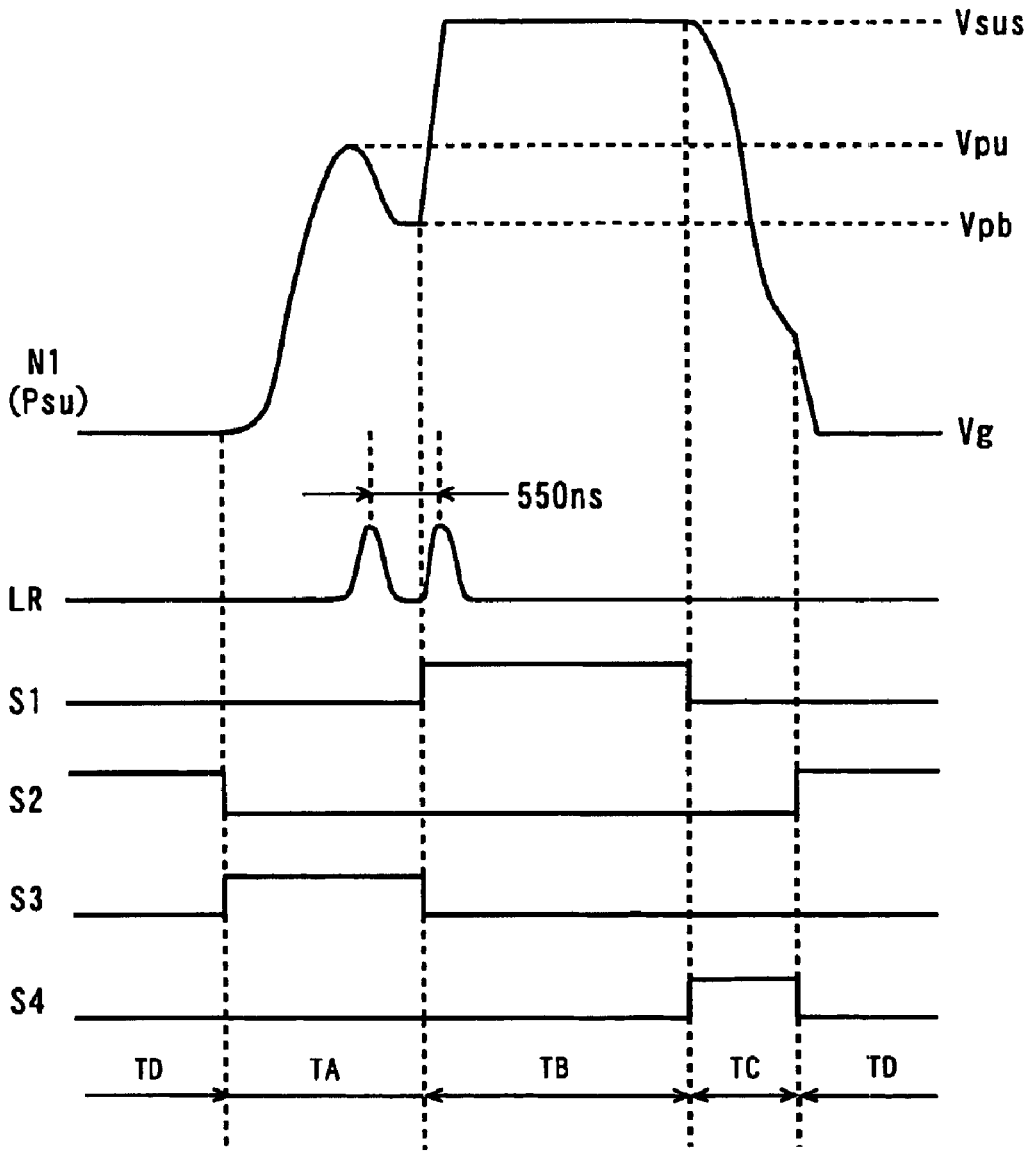
FIG. 8 is a timing chart showing the operation in a sustain time period of the sustain driver shown in FIG. 3 in a case where a peak interval in discharge intensity in the plasma display device shown in FIG. 1 is 50 ns.

Then, when the peak interval is 550 ns, as shown in FIG. 8, the minimal value Vpb at the time of the first discharge is lowered to approximately the same voltage as that in the case of FIG. 7, so that the first discharge is completely terminated once. Thereafter, when the discharge current is supplied from the power supply terminal V1 after an elapse of a predetermined time period, the second discharge is induced. The first discharge and the second discharge are thus continuously induced in a separated state, so that the peak value of the second discharge is approximately equal to the peak value of the first discharge.

In this case, the saturation of the amount of emission of ultraviolet rays is alleviated by current limitation from the moment the first discharge starts to be weakened until the first discharge is stopped, thereby making it possible to completely give the effect of improving luminous efficiency by the first discharge. Further, the second discharge has a peak value equal to the peak value of the first discharge. Accordingly, wall charges required for the subsequent first discharge can be stored, thereby making it possible to stably repeat the sustain discharges.

Figure 9:
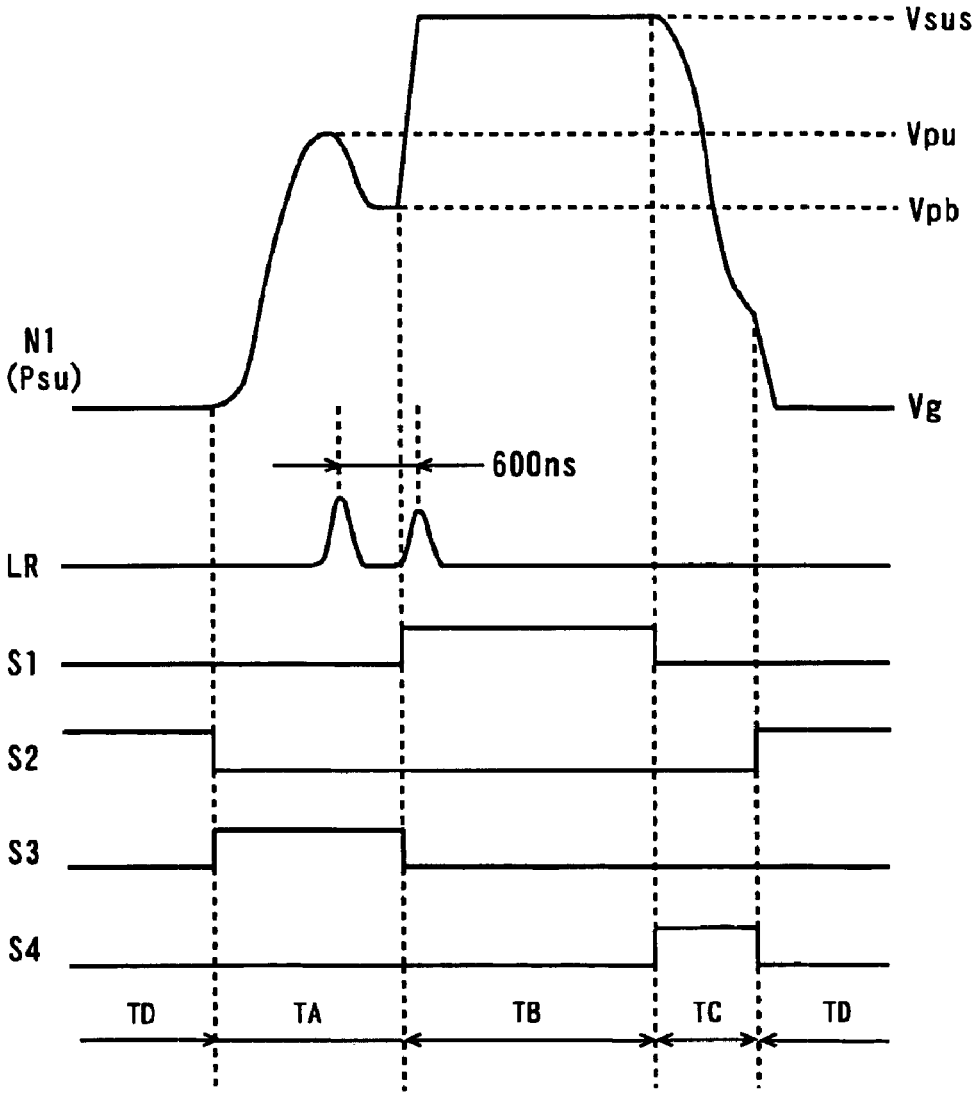
FIG. 9 is a timing chart showing the operation in a sustain time period of the sustain driver shown in FIG. 3 in a case where a peak interval in discharge intensity in the plasma display device shown in FIG. 1 is 60 ns.

Then, when the peak interval is 600 ns, as shown in FIG. 9, the minimal value Vpb at the time of the first discharge is lowered to approximately the same voltage as that in the case of FIG. 7, so that the first discharge is completely terminated once. Thereafter, when the discharge current is supplied from the power supply terminal V1 after an elapse of a predetermined time period, the second discharge is induced. The first discharge and the second discharge are thus continuously induced in a separated state. Accordingly, the peak value of the second discharge is smaller than the peak value of the first discharge.

In this case, the first discharge and the second discharge are too separated from each other. When the second discharge is induced, therefore, it is impossible to sufficiently give the priming effect of the discharge space by the first discharge. Accordingly, the second discharge is smaller than the first discharge, and the discharge intensity LR is also reduced. When the sustain discharges are repeated at the peak interval, wall charges required for the subsequent first discharge are insufficiently formed. While the sustain discharges are repeated, the first and second discharges are gradually decreased, and are not in time induced.

As a result of the foregoing, in order to obtain the effect of improving luminous efficiency by the first discharge, it is preferable that after the first discharge is at least weakened by reducing the voltage at the node N1, the voltage at the node N1 is raised again, to induce the second discharge. In the case of the present embodiment, it is preferable that the peak interval between the peak value of the first discharge and the peak value of the second discharge is not less than 100 ns.

In order to obtain the repetitive stability of the sustain discharges by the second discharges, it is preferable that the voltage at the node N1 is raised again to induce the second discharge while the priming effect by the first discharge is obtained. In the case of the present embodiment, it is preferable that the peak interval between the peak value of the first discharge and the peak value of the second discharge is not more than 550 ns.

Consequently, it is preferable that the peak interval between the peak value of the first discharge and the peak value of the second discharge is not less than 100 ns nor more than 550 ns. In this case, it is possible to obtain the effect of improving luminous efficiency by the first discharge and the repetitive stability of the sustain discharge by the second discharge. Further, the peak interval between the peak value of the first discharge and the peak value of the second discharge is preferably not less than 150 ns nor more than 550 ns and more preferably, not less than 200 ns nor more than 500 ns. In the former case, the effect of improving luminous efficiency by the first discharge can be further enhanced. In the latter case, it is possible to obtain the effect of improving luminous efficiency by the first discharge almost to its maximum as well as to sufficiently obtain the repetitive stability of the sustain discharge by the second discharge.

Figure 10:
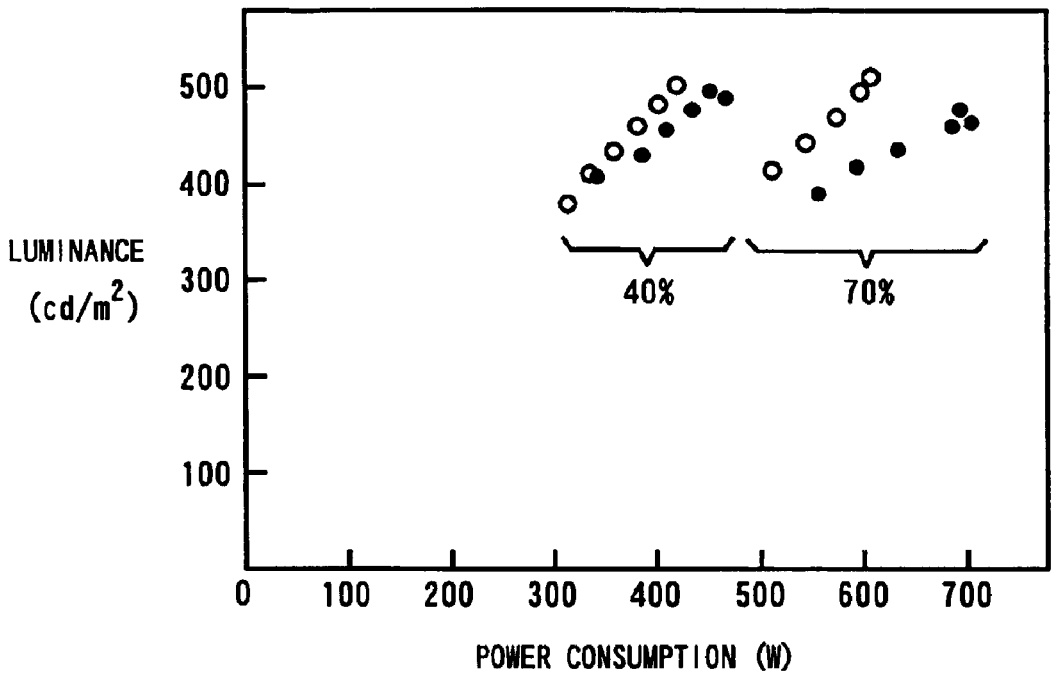
FIG. 10 is a diagram showing the relationship between power consumption and luminance in the plasma display device shown in FIG. 1.

The peak interval between the peak value of the first discharge and the peak value of the second discharge is preferably not less than 300 ns nor more than 550 ns and more preferably, not less than 200 ns nor more than 400 ns. In the former case, the effect of improving luminous efficiency by the first discharge can be obtained almost to its maximum. In the latter case, it is possible to obtain the effect of improving luminous efficiency by the first discharge almost to its maximum as well as to more sufficiently obtain the repetitive stability of the sustain discharge by the second discharge. Description is now made of the relationship between power consumption and luminance in a case where the first and second discharges are continuously induced, as described above. FIG. 10 is a diagram showing the relationship between power consumption and luminance in the plasma display device shown in FIG. 1. In FIG. 10, a white circle indicates a measured value in a case where the first and second discharges are continuously induced by the plasma display device according to the present embodiment, and a black circle indicates a measured value in a case where discharges are induced only once as in the conventional example as a comparative example. Power consumption (W) used to enter the horizontal axis is synthetic power in the sustain time period including charge/discharge power for the PDP, and luminance used to enter the vertical axis (cd/m$^2$) is a measured value of luminance actually produced from the PDP.

As shown in FIG. 10, when a lighting rate on the PDP 7 is 40%, it is found that luminance is raised with the same power consumption in a case where the first and second discharges are continuously induced as in the present embodiment, as compared with the conventional case where the discharge is induced only once. Specifically, the luminance is approximately 452 (cd/m$^2$) when the power consumption is approximately 396 (W) in a case where the first and second discharges are continuously induced, the luminance is approximately 451 (cd/m$^2$) when the power consumption is approximately 421 (W) in a case where the discharges are induced only once. The power consumption can be reduced by approximately 6% by continuously inducing the first and second discharges.

When the lighting rate is 70%, it is found that the luminance is significantly raised in the case where the first and second discharges are continuously induced, as shown, as compared with the conventional case where the discharge is induced only once. Specifically, the luminance is approximately 467 (cd/m$^2$) when the power consumption is approximately 599 (W) in a case where the first and second discharges are continuously induced, and the luminance is approximately 445 (cd/m$^2$) when the power consumption is approximately 685 (W) in a case where the discharge is induced only once. The power consumption can be reduced by approximately 12%.

It is found that when the first and second discharges are thus continuously induced, luminous efficiency corresponding to applied power is improved depending on the lighting rate, thereby making it possible to further reduce power consumption. On the other hand, when the first and second discharges are continuously induced, luminous efficiency is conversely reduced depending on the lighting rate, so that power consumption may, in some cases, be increased. Therefore, in each of the following embodiments, the discharged state is changed depending on the lighting rate for each sub-field, and sustain discharges are induced in the most suitable state corresponding to the lighting rate.

Figure 11:
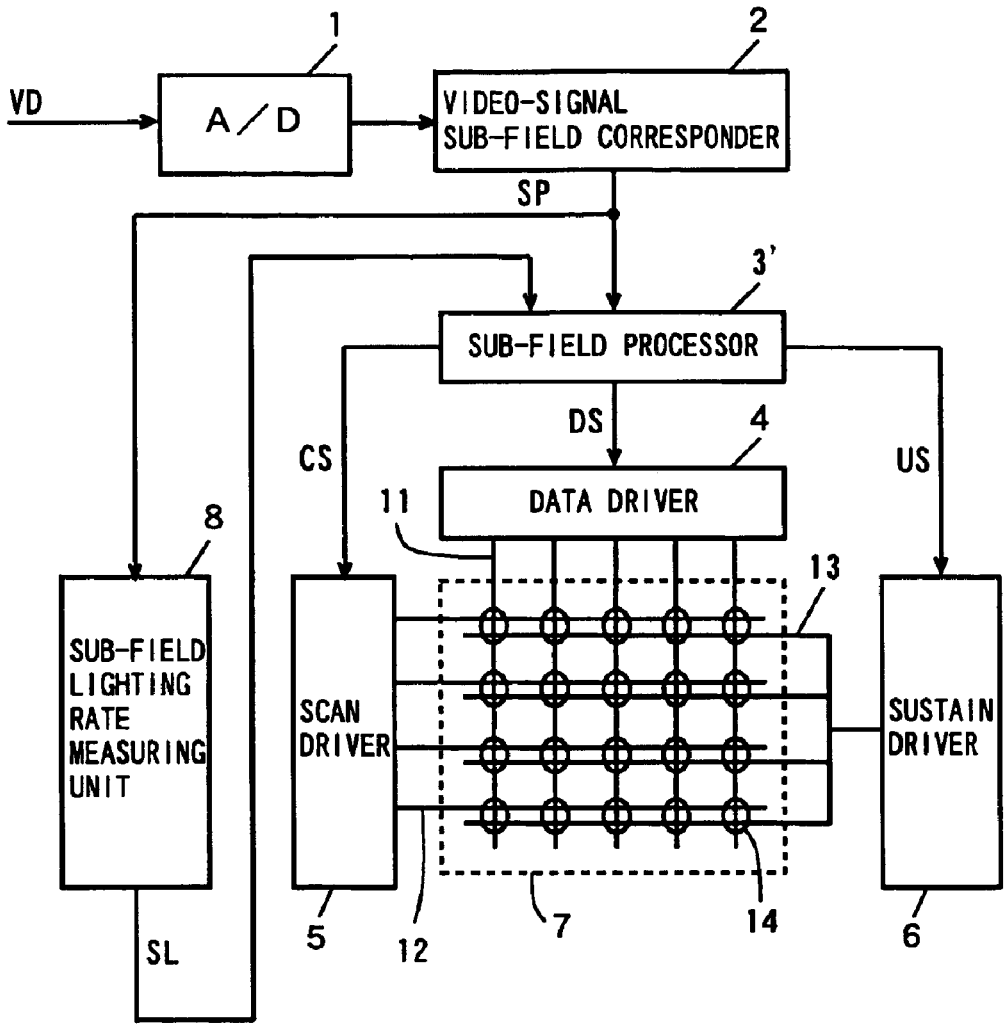
FIG. 11 is a block diagram showing the configuration of a plasma display device according to a second embodiment of the present invention.

Description is now made of a plasma display device according to a second embodiment of the present invention. FIG. 11 is a block diagram showing the configuration of the plasma display device according to the second embodiment of the present invention.

The plasma display device shown in FIG. 11 is the same as the plasma display device shown in FIG. 1 except that a sub-field lighting rate measuring unit 8 is added, and the sub-field processor 3 is changed into a sub-field processor 3' for controlling the timing at which a sustain pulse rises again depending on a lighting rate for each sub-field. Accordingly, the same portions are assigned the same reference numerals and hence, only different portions will be described in detail below.

The sub-field lighting rate measuring unit 8 shown in FIG. 11 detects the lighting rate of discharge cells 14 which are simultaneously driven on a PDP 7 from image data SP for each sub-field, and outputs the results of the detection to the sub-field processor 3' as a sub-field lighting rate signal SL.

The lighting rate is given by the following equation if the minimum unit of a discharge space which can be independently controlled to enter a lighting/non-lighting state shall be referred to as a discharge cell:

(Lighting rate)=(Number of discharge cells which are simultaneously turned on)/(Number of all discharge cells on PDP)

Specifically, the sub-field lighting rate measuring unit 8 separately calculates the lighting rates in all sub-fields using video signal information decomposed into one-bit information representing lighting/non-lighting of the discharge cells for each sub-field which are produced by a video signal/sub-field corresponder 2, and outputs the results of the calculation to the sub-field processor 3' as the sub-field lighting rate signal SL.

For example, the sub-field lighting rate measuring unit 8 has a counter provided therein, and finds the total number of discharge cells which are turned on for each sub-field by increasing the value of the counter one at a time when the video signal information decomposed into the one-bit information representing lighting/non-lighting represents lighting, and divides the total number by the number of all discharge cells on the PDP 7, to find the lighting rate.

The sub-field processor 3' generates a data driver driving control signal DS, a scan driver driving control signal CS, and a sustain driver driving control signal US from the image data SP, the sub-field lighting rate signal SL, and so forth for each sub-field, and respectively outputs the signals to a data driver 4, a scan driver 5, and a sustain driver 6.

The scan driver 5 and the sustain driver 6 change the timing at which the sustain pulse rises again in response to the sub-field lighting rate signal SL in a sustain time period in accordance with the scan driver driving control signal CS and the sustain driver driving control signal US, as described later.

Figure 12:
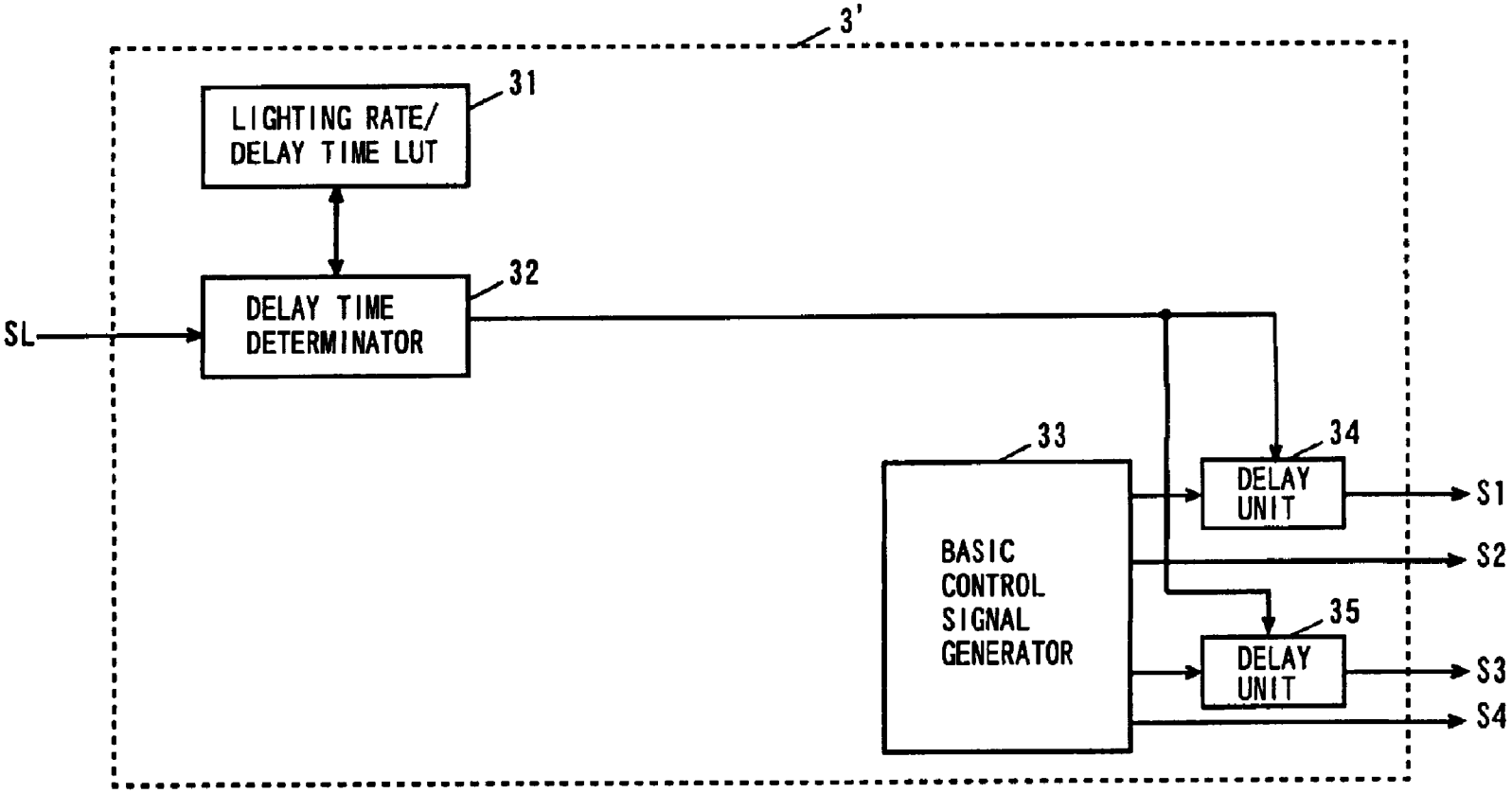
FIG. 12 is a block diagram showing the configuration of a sub-field processor shown in FIG. 11.

FIG. 12 is a block diagram showing the configuration of the sub-field processor 3' shown in FIG. 11. The sub-field processor 3' shown in FIG. 12 comprises a lighting rate/delay time LUT (Look-up Table) 31, a delay time determinator 32, a basic control signal generator 33, and delay units 34 and 35.

The lighting rate/delay time LUT 31 is connected to the delay time determinator 32, and stores in a table format the relationship between a lighting rate and a delay time Td based on experimental data. For example, 100 ns is stored as the delay time Td with respect to the lighting rate of 0 to 45%, 200 ns as the delay time with respect to the lighting rate of 45 to 60%, and 350 ns as the delay time with respect to the lighting rate of 60 to 100%.

Here, the delay time Td is defined, when the time when a potential at a sustain electrode 13 is raised to a discharge start voltage Vst at which discharges are induced in accordance with a voltage rising curve determined due to resonance by a recovery coil L and a panel capacitance Cp is taken as origin time, as a time period elapsed from the origin time until a control signal S1 enters a high level. Conventionally, the control signal S1 is brought into a high level at the timing at which the delay time Td reaches 0 ns to supply a discharge current from a power supply which applies a sustain voltage Vsus, thereby accomplishing compatibility between the recovery of ineffective power and stable discharges.

The delay time determinator 32 is connected to the delay units 34 and 35, and reads out the corresponding delay time Td from the lighting rate/delay time LUT 31 in response to the sub-field lighting rate signal SL outputted from the sub-field lighting rate measuring unit 8 and controls the delay units 34 and 35 such that a delay operation is performed for only the delay time Td read out. The determination of the delay time Td is not particularly limited to the example in which the relationship between a lighting rate and a delay time Td based on experimental data is stored in a table format, as described above. The delay time Td corresponding to the lighting rate may be found from an approximate expression representing the relationship between a lighting rate and a delay time Td.

The basic control signal generator 33 outputs control signals S1 to S4 as the sustain driver driving control signal US. The control signals S1 and S3 are respectively outputted to the delay units 34 and 35, and the control signals S2 and S4 are outputted to the sustain driver 6 as they are.

The delay unit 34 delays the leading edge of the control signal S1 by the delay time Td determined by the delay time determinator 32, and the delay unit 35 delays the falling edge of the control signal S3 by the delay time Td determined by the delay time determinator 32. The edges are outputted to the sustain driver 6. The sustain driver 6 can be operated as in the foregoing even if the control signal S3 enters a low level when the control signal S1 enters a low level. In this case, the delay unit 35 can be omitted.

By the above-mentioned configuration, the sub-field processor 3' changes the delay time Td depending on the lighting rate measured by the sub-field lighting rate measuring unit 8, and controls the timing at which the control signal S1 enters a high level and the timing at which the control signal S3 enters a low level.

The present embodiment is the same as the first embodiment except that the scan driver 5 and the sustain driver 6 respectively correspond to first and second driving circuits and a driving circuit, the sub-field lighting rate measuring unit 8 corresponds to a detection circuit and a sub-field lighting rate detection circuit, and the sub-field processor 3' corresponds to a control circuit.

The scan driver 5 is controlled by the sub-field processor 3' as in the foregoing. Similarly, the timing at which the sustain pulse applied to a scan electrode 12 depending on the lighting rate for each sub-field rises again is controlled.

FIGS. 13 to 16 are timing charts showing the operation in a sustain time period of the sustain driver 6 shown in FIG. 11 in cases where the delay time Td is 0 ns, 100 ns, 200 ns, and 350 ns. FIGS. 13 to 16 illustrate a voltage at the node N1 shown in FIG. 3, discharge intensity LR in the PDP 7, and the control signals S1 to S4 inputted to the transistors Q1 to Q4 in a case where the sustain period of the sustain pulse is 6 $\mu$s.

Each of timing charts shown in FIGS. 13 to 16 is the same as the timing chart shown in FIG. 4 except for the timing at which the control signal S1 is changed to a high level (the timing at which the control signal S3 is changed to a low level) and hence, different points will be described in detail below.

Figure 13:
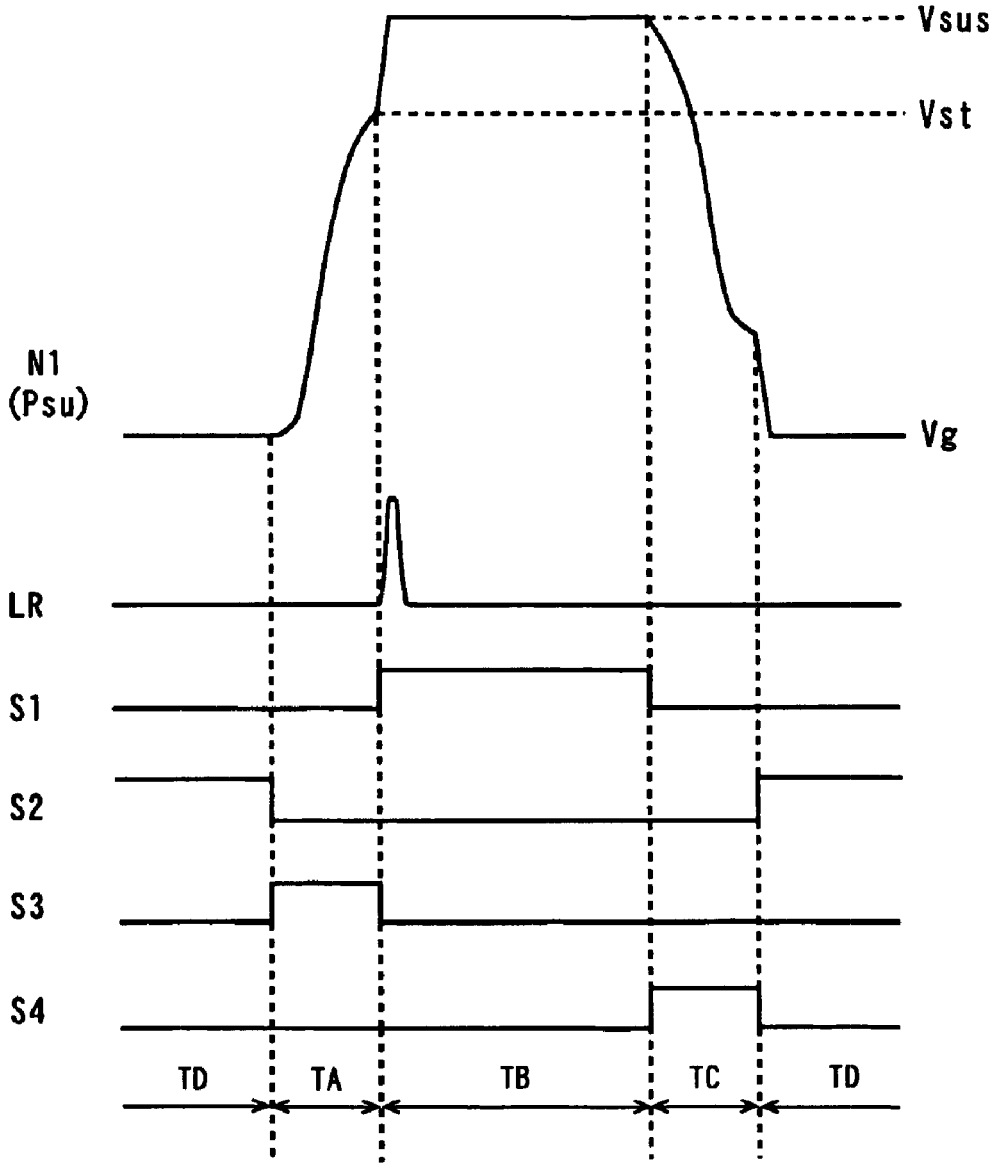
FIG. 13 is a timing chart showing the operation in a sustain time period of the sustain driver shown in FIG. 11 in a case where a delay time is 0 ns.

First when the delay time Td is 0 ns, as shown in FIG. 13, the voltage at the node N1 is smoothly raised from a ground potential Vg due to LC resonance by the recovery coil L and the panel capacitance Cp in a time period TA. When the voltage exceeds the discharge start voltage Vst, sustain discharges are induced. At this time, the control signal S1 enters a high level, and the voltage at the node N1 is raised to the sustain voltage Vsus supplied from a power supply terminal V1. A discharge in which the discharge current is supplied from the power supply are induced once, as in the conventional example, so that the discharge intensity LR is increased once. That is, a case where the delay time Td shown in FIG. 1 is 0 ns indicates a case where the discharge current is supplied from the power supply, to induce a discharge once, as in the conventional example.

Figure 14:
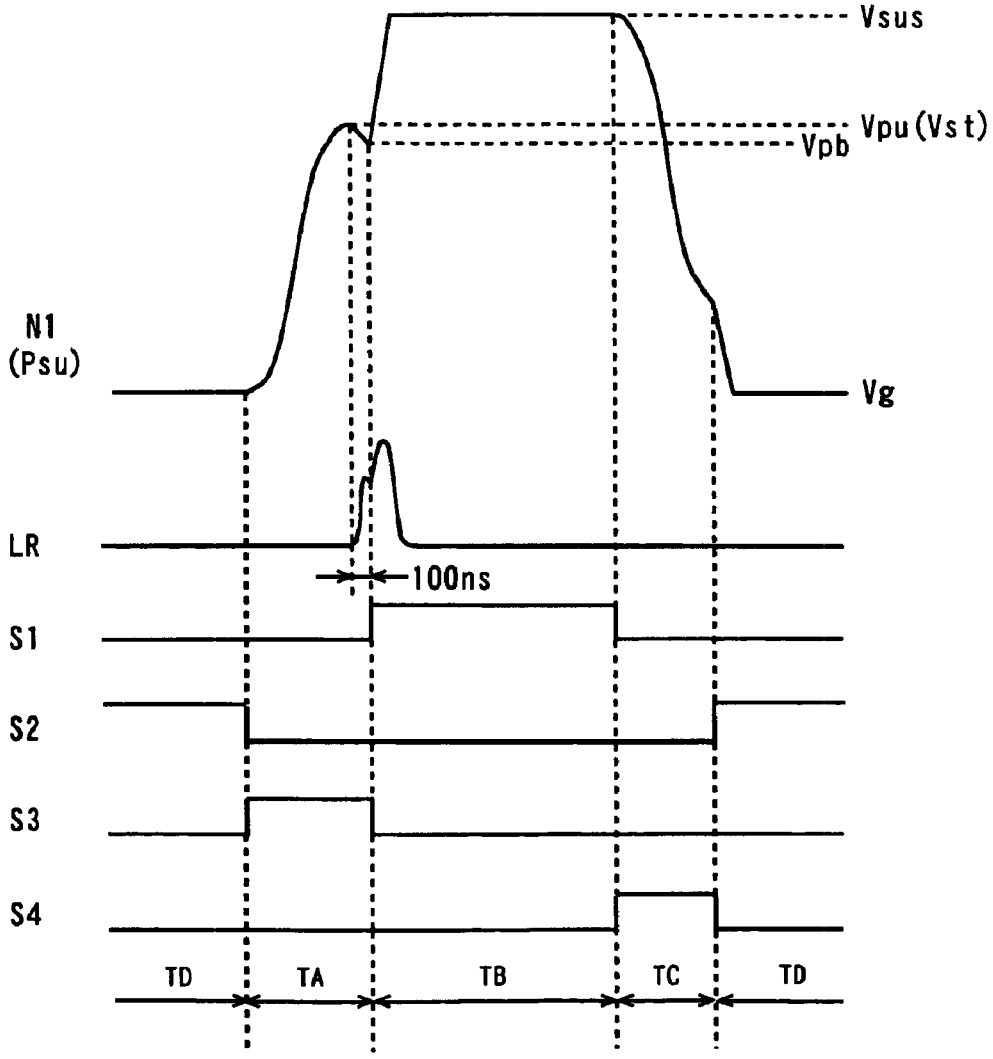
FIG. 14 is a timing chart showing the operation in a sustain time period of the sustain driver shown in FIG. 11 in a case where a delay time is 100 ns.

Then, when the delay time Td is 100 ns, as shown in FIG. 14, the voltage at the node N1 is then smoothly raised from the ground potential Vg due to LC resonance by the recovery coil L and the panel capacitance Cp in the time period TA. When the voltage exceeds a discharge start voltage Vst, a first discharge is induced, and the discharge intensity LR starts to be increased.

Thereafter, when the first discharge is increased to some extent, and a required discharge current exceeds the current supplying capability of a circuit comprising a recovery capacity C1 and a recovery coil L, the voltage at the node N1 is lowered from a maximal value Vpu to a minimal value Vpb so that the first discharge is weakened and correspondingly, the discharge intensity LR is also reduced. The saturation of the amount of emission of ultraviolet rays starts to be alleviated by current limitation from the moment the first discharge starts to be weakened. Thereafter, the saturation of the ultraviolet rays corresponding to the discharge current is reduced in a time period elapsed until the voltage at the node N1 is raised again, resulting in improved luminous efficiency.

When the timing at which the control signal S1 enters a high level is delayed by 100 ms from the timing shown in FIG. 13, to turn the transistor Q1 on, the discharge current is supplied from the power supply terminal V1. Consequently, the voltage at the node N1 is raised again, the second discharge is induced subsequently to the first discharge, and the discharge intensity LR is also increased again.

At this time, the second discharge has a sufficient intensity, that is, a larger peak value than the peak value of the first discharge. Accordingly, wall charges required for the subsequent first discharge are then sufficiently stored, thereby making it possible to stably repeat the sustain discharges.

Figure 15:
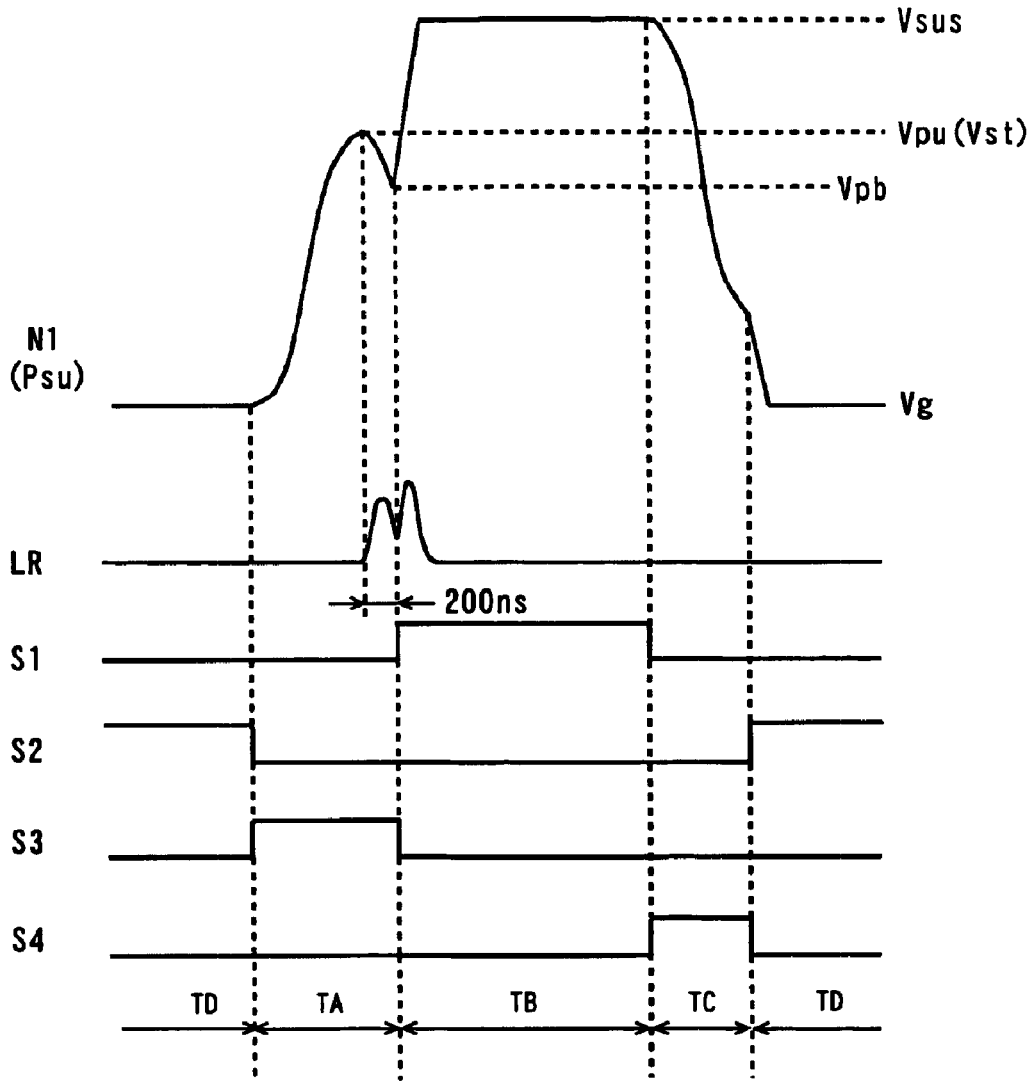
FIG. 15 is a timing chart showing the operation in a sustain time period of the sustain driver shown in FIG. 11 in a case where a delay time is 200 ns.

Then, when the delay time Td is 200 ns, as shown in FIG. 15, the first and second discharges are continuously induced, as in the case of FIG. 14. However, a time period during which charges required for the first discharge is supplied from the recovery capacitor C1 is further lengthened. Therefore, a time period during which sufficient charges cannot be supplied is lengthened. The minimal value Vpb at the node N1 is further decreased, so that the first discharge is further weakened, and the discharge intensity LR is also further reduced. At this time, the saturation of ultraviolet rays corresponding to the discharge current is further reduced, and the time period is lengthened, resulting in further improved luminous efficiency.

When the timing at which the control signal S1 enters a high level is delayed by 200 ns from the timing shown in FIG. 13, to turn the transistor Q1 on, charges required for a discharge are supplied from the power supply terminal V1 so that the second discharge is induced, and the discharge intensity LR is then increased again. When the delay time Td is changed from 100 ns to 200 ns, the minimal value Vpb at the node N1 is further decreased, so that the first discharge and the second discharge enter a more separated state. Accordingly, luminous efficiency is further improved by the first discharge.

Figure 16:
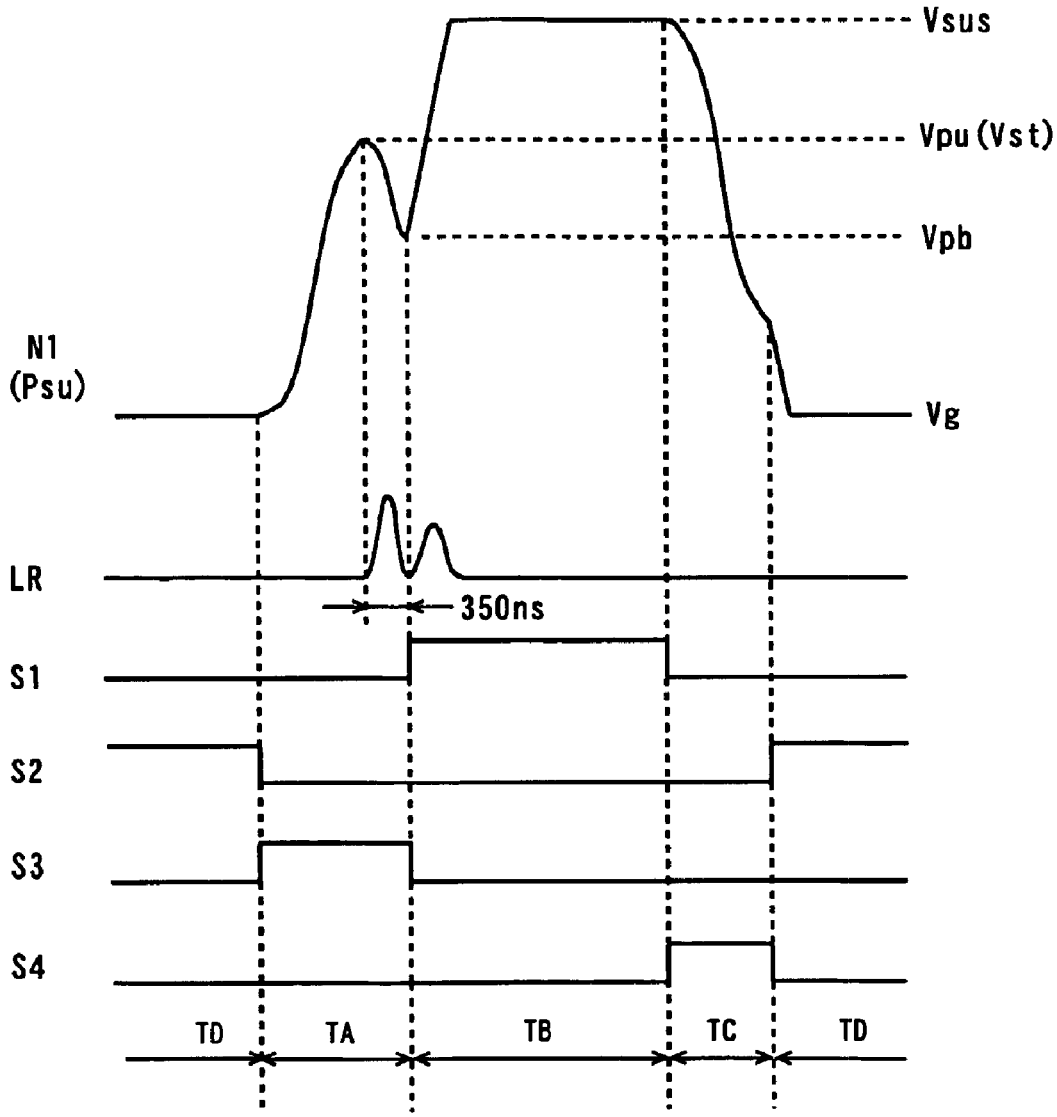
FIG. 16 is a timing chart showing the operation in a sustain time period of the sustain driver shown in FIG. 11 in a case where a delay time is 350 ns.

Then, when the delay time Td is 350 ns, as shown in FIG. 16, a minimal value Vpb at the time of the first discharge is further decreased so that the first discharge is completely terminated once. Thereafter, when the control signal S1 enters a high level so that the discharge current is supplied from the power supply terminal V1, the second discharge is induced. The first discharge and the second discharge are thus continuously induced in a too separated state. Accordingly, the peak value of the second discharge is lower than the peak value of the first discharge.

In this case, the first discharge and the second discharge are too separated from each other. When the second discharge is induced, therefore, the priming effect in a discharge space cannot be sufficiently given. Accordingly, the second discharge is smaller than the first discharge, and the discharge intensity LR is also reduced. When the sustain discharges are repeated at the delay time Td, the formation of the wall charges required for the subsequent first discharge is insufficient. Therefore, the first and second discharges may, in some cases, be gradually reduced while the sustain discharges are repeated, not to be in time induced.

Figure 17:
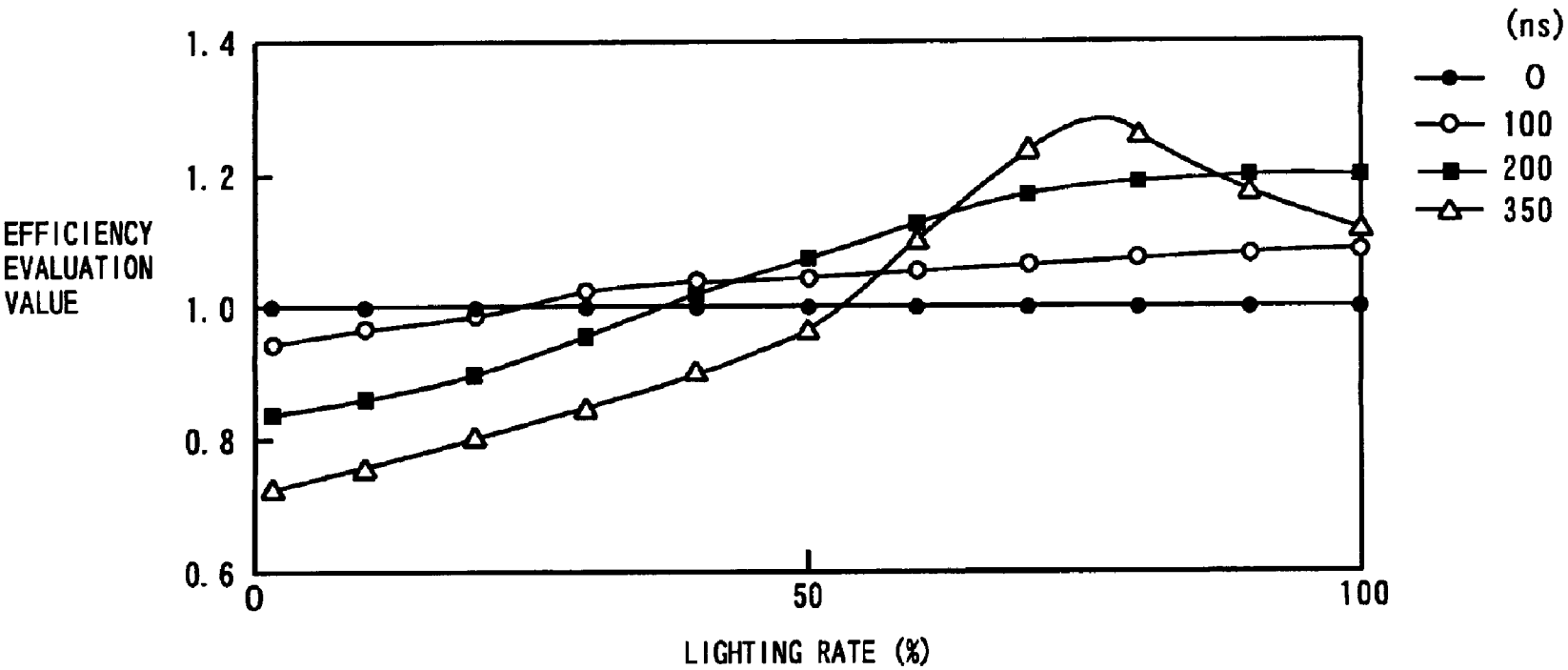
FIG. 17 is a diagram showing the relationship between an efficiency evaluation value and a lighting rate in each delay time in the plasma display device shown in FIG. 1.

Description is now made of the relationship between power consumption and a lighting rate in each of the delay times. FIG. 17 is a diagram showing the relationship between an efficiency evaluation value and a lighting rate in each of the delay times in the plasma display device shown in FIG. 11.

In FIG. 17, a black circle indicates a case where the delay time Td is 0 ns, a white circle indicates a case where the delay time Td is 100 ns, and a black square indicates a case where the delay time Td is 200 ns, and a white triangle indicates a case where the delay time Td is 350 ns. An efficiency evaluation value used to enter the vertical axis is a value using as a reference value of efficiency (luminance/power consumption (including charge/discharge power for the PDP)) at the delay time 0 ns in each lighting rate and normalized by dividing the value of (luminance/power consumption (including charge/discharge power for the PDP) at each delay time by the reference value. That is, it is indicated that the larger the efficiency evaluation value is, the smaller the power consumption compared in the same luminance is. Further, a lighting rate (%) for each sub-field is used to enter the horizontal axis.

As shown in FIG. 17, the power consumption is the lowest when the delay time is 0 ns at the lighting rate in the range of 0 to 25%, is the lowest when the delay time is 100 ns at the lighting rate in the range of 25 to 45%, is the lowest when the delay time is 200 ns at the lighting rates in the range of 45 to 60% and in the range of 85 to 100%, and is the lowest when the delay time is 350 ns at the lighting rate in the range of 60 to 85%.

When the lighting rate thus reaches not less than a predetermined value, the power consumption is reduced as the delay time is increased. However, it is found that if the delay time is too increased, the efficiency evaluation value is decreased and the power consumption is conversely increased.

Figure 18:
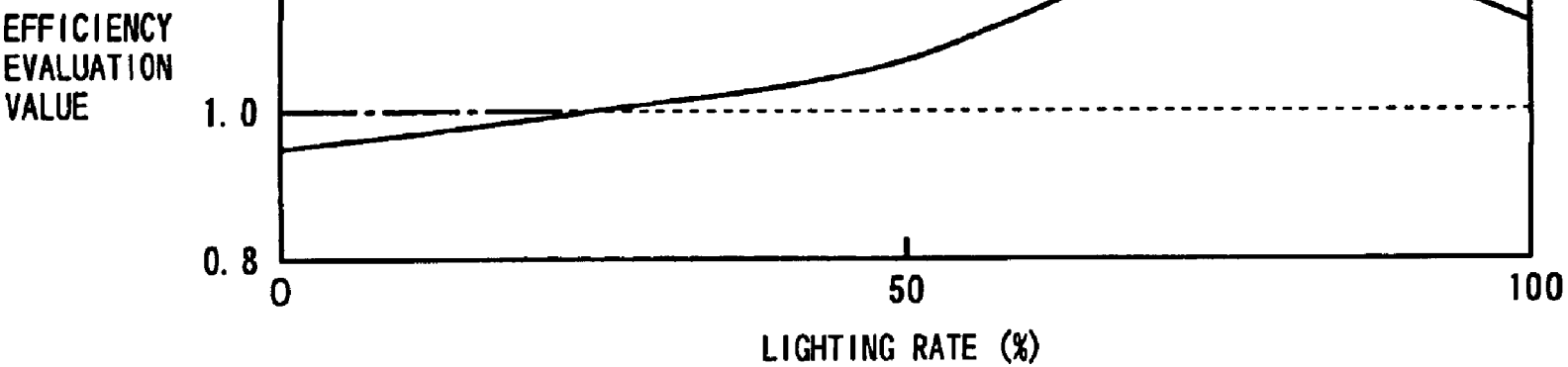
FIG. 18 is a diagram showing, on the basis of the relationship between an efficiency evaluation value and a lighting rate in each delay time shown in FIG. 17, the relationship between an efficiency evaluation value and a lighting rate in a case where the delay time is controlled depending on the lighting rate by a sub-field processor.

FIG. 18 is a diagram showing, on the basis of the relationship between an efficiency evaluation value and a lighting rate in each of the delay times shown in FIG. 17, the relationship between an efficiency evaluation value and a lighting rate in a case where the delay time Td is controlled depending on the lighting rate by the sub-field processor 3'.

A solid line shown in FIG. 18 indicates the relationship between an efficiency evaluation value and a lighting rate in a case where the delay time Td is set to 100 ns when the lighting rate is 0 to 45%, is set to 200 ns when the lighting rate is 45 to 60%, and is set to 350 ns when the lighting rate is 60 to 100%.

That is, FIG. 18 shows a case where the first and second discharges are induced, and the delay time Td is increased depending on the lighting rate. In this case, the efficiency evaluation value is less than one when the lighting rate is 0 to 20%, so that luminous efficiency is made lower than that in the conventional example. However, in the other lighting rate, luminous efficiency is sufficiently improved, thereby making it possible to reduce power consumption as a whole.

A portion indicated by a one-dot and dash line shown in FIG. 18 indicates the relationship between an efficiency evaluation value and a lighting rate in a case where the delay time Td is set to 0 ns when the lighting rate is 0 to 25%. That is, FIG. 18 shows a case where the first and second discharges are induced when the lighting rate is not less than a predetermined value, for example, 25%, and the discharge current is supplied from the power supply terminal V1 to induce discharges once, as in the conventional example, when the lighting rate is less than the predetermined value (25%). In this case, the efficiency evaluation value is one when the lighting rate is 0 to 25%, thereby making it possible to further reduce power consumption.

A portion indicated by a two-dot and dash line in FIG. 18 indicates the relationship between an efficiency evaluation value and a lighting rate in a case where the delay time Td is set to 200 ns when the lighting rate is 85 to 100%. That is, FIG. 18 shows a case where the delay time Td is decreased when the lighting rate is not less than a predetermined value, for example, 85%. In this case, the efficiency evaluation value is further improved with respect to the lighting rate of 85 to 100%, thereby making it possible to further reduce power consumption.

When the timing at which the sustain pulse Psu rises again, that is, the control signal S1 enters a high level is thus controlled depending on the lighting rate, various types of control can be carried out depending on characteristics between the lighting rate in the PDP and the power consumption. Various types of control can be carried out. For example, the delay time Td is successively increased as the lighting rate is increased. A discharge is induced once, as in the conventional example, until the lighting rate reaches not less than a predetermined value, and the first and second discharges are induced when the lighting rate reaches not less than the predetermined value. The delay time Td is shortened when the lighting rate is further increased to not less than the predetermined value after the delay time Td is increased as the lighting rate is increased.

When the delay time is increased to not less than the predetermined value, the discharges may, in some cases, be unstable. In this case, however, the discharges can be stably and continuously induced by supplying charges to the recovery capacitor C1 from the exterior and decreasing the frequency of the sustain pulse in the sustain time period.

Furthermore, when the discharge is induced only once, as in the conventional example, luminous efficiency is not improved, and luminance is not also changed. When a rapid change from a state where the discharge is induced only once to a state where the first and second discharges are induced is made, luminous efficiency is rapidly changed and the luminance on the PDP 7 is also rapidly changed. Accordingly, an uncomfortable feeling may, in some cases, be visually given. However, control is carried out such that as the lighting rate for each sub-field is increased, the timing at which the control signal S1 enters a high level is successively delayed. The luminance is successively increased by making a gradual change from the discharge induced once to the first and second discharges, thereby giving no visually uncomfortable feeling.

It goes without saying that the same effect is obtained even if used as control for switching from discharge induced once to the first and second discharges such that no visually uncomfortable feeling is given is control for switching by changing the level of a video signal in signal processing to make the difference between luminance obtained by the discharges induced once and luminance obtained by the first and second discharges inconspicuous in addition to the above-mentioned control.

As described in the foregoing, in the present embodiment, the first and second discharges are continuously induced when the sustain pulse rises, thereby making it possible to improve luminous efficiency corresponding to applied power to reduce power consumption. Further, the timing at which the sustain pulse rises again is controlled depending on the lighting rate for each sub-field, thereby making it possible to gradually improving luminous efficiency to reduce power consumption in a state where there is no visually uncomfortable feeling.

The lighting rate in the sub-field where one time of light emission is switched to two times of light emission is not particularly limited if power consumption can be synthetically reduced and there is no visually uncomfortable feeling.

Figure 19:
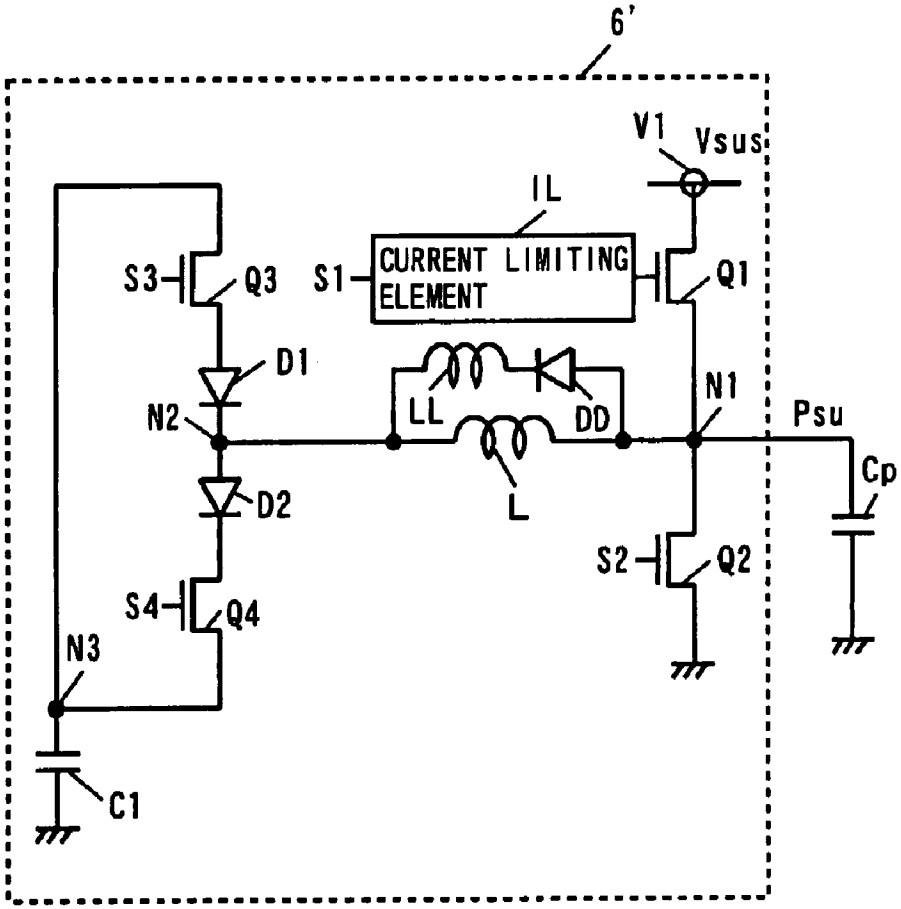
FIG. 19 is a circuit diagram showing another configuration of the sustain driver shown in FIG. 1 or 11.

Description is now made of another sustain driver which is applied to the plasma display device shown in FIG. 1 or 11. FIG. 19 is a circuit diagram showing another configuration of the sustain driver shown in FIG. 1 or 11. A sustain driver 6' shown in FIG. 19 is the same as the sustain driver 6 shown in FIG. 3 except that a recovery coil LL and a diode DD are added in series between a node N2 and a node N1. Accordingly, the same portions are assigned the same reference numerals and hence, the detailed description thereof is not omitted. When the sustain driver 6' shown in FIG. 19 is applied to the plasma display device shown in FIG. 1, the scan driver 5 is also changed in the same manner as described below.

In the sustain driver 6' shown in FIG. 19, the recovery coil LL and the diode DD are connected in series between the node N2 and the node N1, and a recovery coil L and the recovery coil LL are connected in parallel therebetween. When a current flows from the node N1 to the node N2, therefore, both the recovery coils L and LL contribute to a LC resonating operation. When the current flows from the node N2 to the node N1, the current flowing through the recovery coil LL is limited by the diode DD, and only the recovery coil L contributes to the LC resonating operation.

Figure 20:
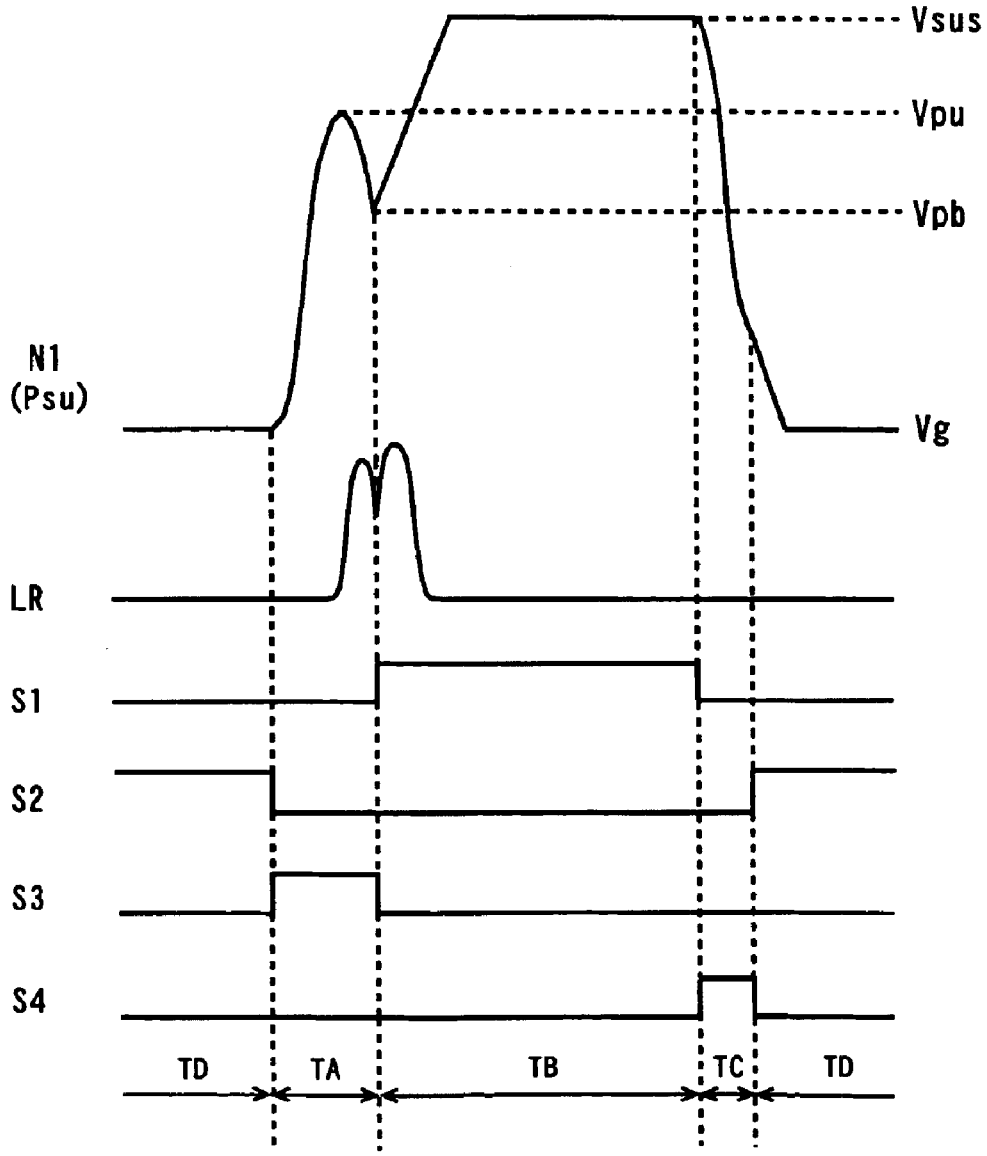
FIG. 20 is a timing chart showing the operation in a sustain time period of the sustain driver shown in FIG. 19.

FIG. 20 is a timing chart showing the operation in a sustain time period of the sustain driver 6' shown in FIG. 19. The timing chart shown in FIG. 20 is the same as the timing chart shown in FIG. 4 except that a time period TB is extended and correspondingly, a time period TC is shortened. Accordingly, different points will be described in detail below.

In a time period TA, a current flowing through the recovery coil LL from a recovery capacitor C1 is limited by the diode DD, and a current flowing from a recovery capacitor C1 flows only through the recovery coil L. Consequently, only the recovery coil L contributes to an LC resonating operation, the rise waveform of a sustain pulse Psu is the same as the waveform in the sustain driver 6 shown in FIG. 3. A time period during which the sustain pulse Psu is held at a voltage Vsus in the time period TB is extended only by a shortened part of the time period TC.

Then in the time period TC, a current flowing through the recovery coil LL is not limited by the diode DD, and both the recovery coils L and LL contribute to the LC resonating operation. Consequently, LC resonance occurs by a composite inductance value of the recovery coils L and LL which is lower than the inductance value of the recovery coil L.

Accordingly, the period of LC resonance is shorted, and the sustain pulse Psu sharply falls in a short time period.

As described in the foregoing, the time period TC is shortened, and the time period TB is extended by the shortened part of the time period TC, thereby making it possible to extend a time period during which the sustain pulse Psu is held at the voltage Vsus. Consequently, a time period during which wall charges are formed after the second discharge can be sufficiently ensured, thereby making it possible to stably form the wall charges. As a result, it is possible to improve the lighting stability in the sustain time period.

Figure 21:
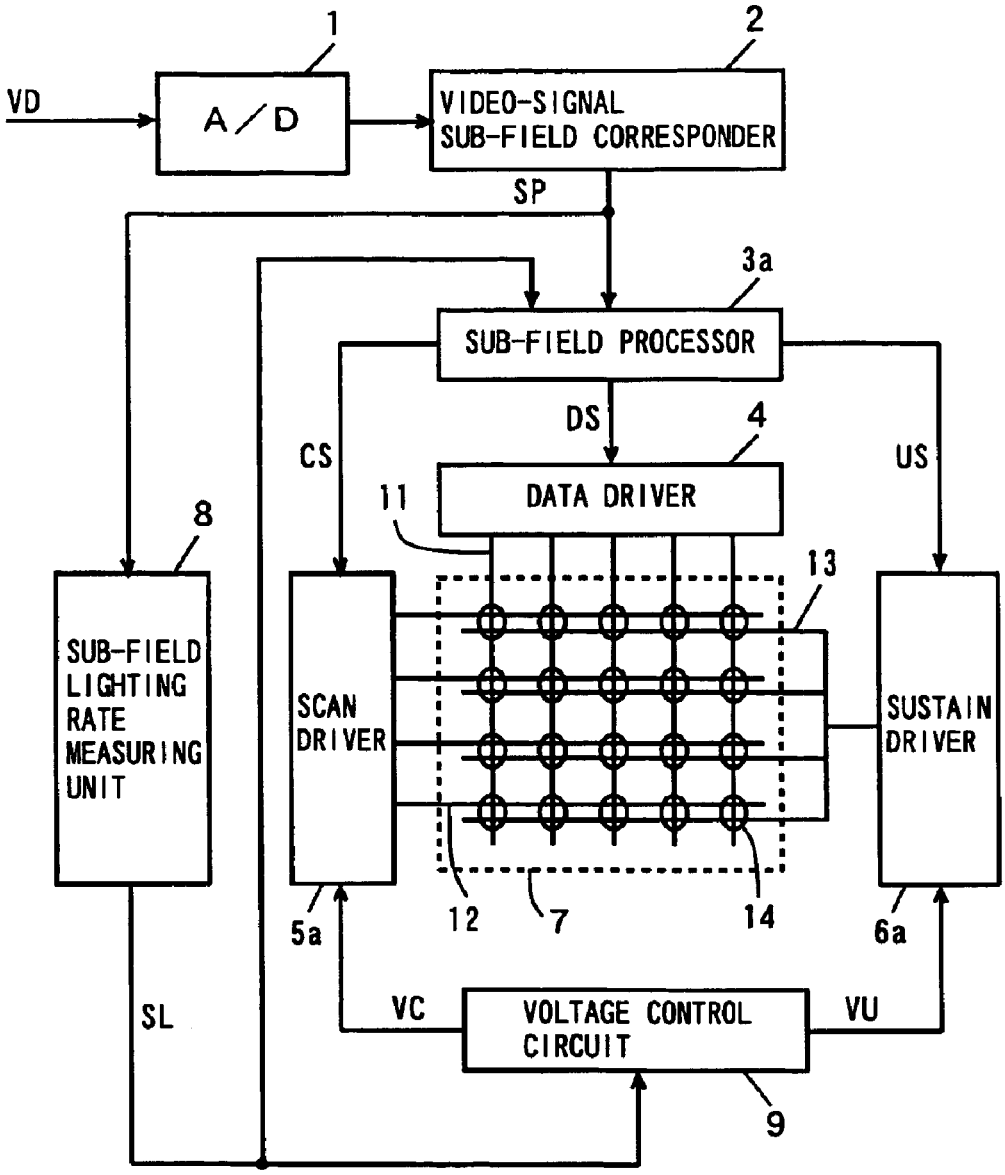
FIG. 21 is a block diagram showing the configuration of a plasma display device according to a third embodiment of the present invention.

Description is now made of a plasma display device according to a third embodiment of the present invention. FIG. 21 is a block diagram showing the configuration of the plasma display device according to the third embodiment of the present invention.

The plasma display device shown in FIG. 21 is the same as the plasma display device shown in FIG. 11 except that the sub-field processor 3' is changed into a sub-field processor 3*a* for controlling a scan driver 5*a* and a sustain driver 6*a* such that the sub-field processor 3*a* induces a third discharge subsequently to first and second discharges in a sustain time period, and a voltage control circuit 9 for controlling a voltage of a sustain pulse depending on a lighting rate for each sub-field is added. Accordingly, the same portions are assigned the same reference numerals and hence, only different portions will be described in detail below.

The sub-field processor 3*a* shown in FIG. 21 generates a scan driver driving control signal CS and a sustain driver driving control signal US for inducing the third discharge subsequently to the first and second discharges in the sustain time period from image data SP, a sub-field lighting rate signal SL, and so forth for each sub-field, and respectively outputs the signals to a scan driver 5*a* and a sustain driver 6*a* in addition to the normal operation of the sub-field processor 3' shown in FIG. 11.

The voltage control circuit 9 receives the sub-field lighting rate signal SL outputted from a sub-field lighting rate measuring unit 8, and outputs voltage control signals VC and VU for controlling the voltage of the sustain pulse, respectively, to the scan driver 5*a* and the sustain driver 6*a* depending on the lighting rate for each sub-field.

Figure 22:
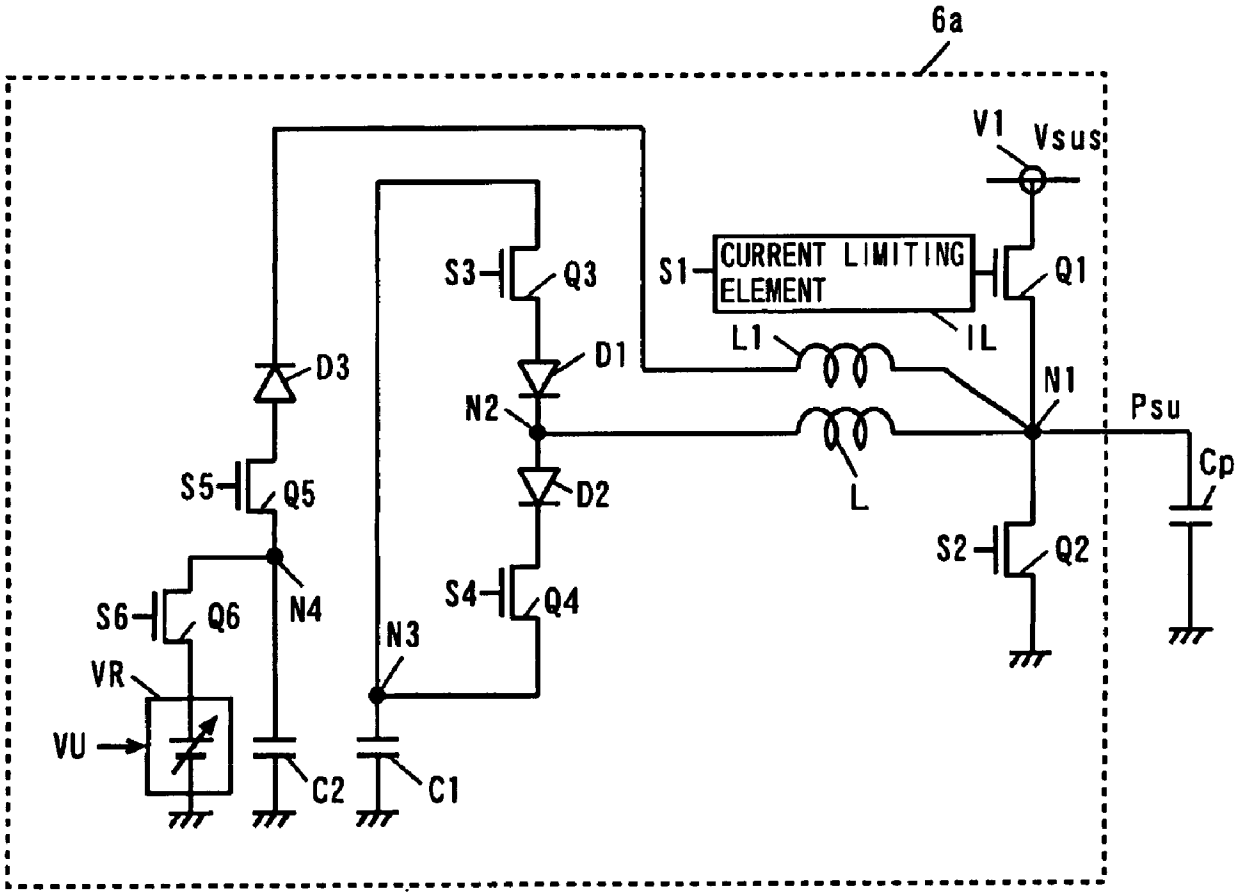
FIG. 22 is a circuit diagram showing the configuration of a sustain driver shown in FIG. 21.

The sustain driver 6*a* shown in FIG. 21 will be now described in detail. FIG. 22 is a circuit diagram showing the configuration of the sustain driver 6*a* shown in FIG. 21. The scan driver 5*a* in the present embodiment is configured and operated similarly to the sustain driver 6*a*. Accordingly, the detailed description of the scan driver 5*a* is not repeated and hence, only the sustain driver 6*a* will be described in detail below.

The sustain driver 6*a* shown in FIG. 22 is the same as the sustain driver 6 shown in FIG. 3 except that transistors Q5 and Q6, a diode D3, a coil L1, a capacitor C2, and a variable voltage source VR are added. Accordingly, the same portions are assigned the same reference numerals and hence, only different portions will be described in detail below.

As shown in FIG. 22, the capacitor C2 is connected between a node N4 and a ground terminal. The transistor Q5, the diode D3, and the coil L1 are connected in series between the node N4 and a node N1. The transistor Q6 has its one end connected to the node N4 and has the other end connected to one end of the variable voltage source VR. The control signal S5 is inputted to the gate of the transistor Q6, and a control signal S6 is inputted to the gate of the transistor Q6. The other end of the variable voltage source VR is connected to the ground terminal, to change an output voltage in response to the voltage control signal VU outputted from the voltage control circuit 9.

The present embodiment is the same as the second embodiment except that the scan driver 5*a* and the sustain driver 6*a* correspond to a driving circuit, first to third driving circuits and a final driving circuit, the sub-field processor 3*a* corresponds to a control circuit, the capacitor C2 corresponds to a second capacitive element, the variable voltage source VR corresponds to a voltage source and a variable voltage source, the voltage control circuit 9 corresponds to a voltage control circuit, the capacitor C2, the coil L1, the transistors Q5 and Q6, the diode D3, and the variable voltage source VR correspond to a second driving circuit, and a transistor Q1, a current-limiting element IL and a power supply terminal V1 correspond to a third driving circuit.

Figure 23:
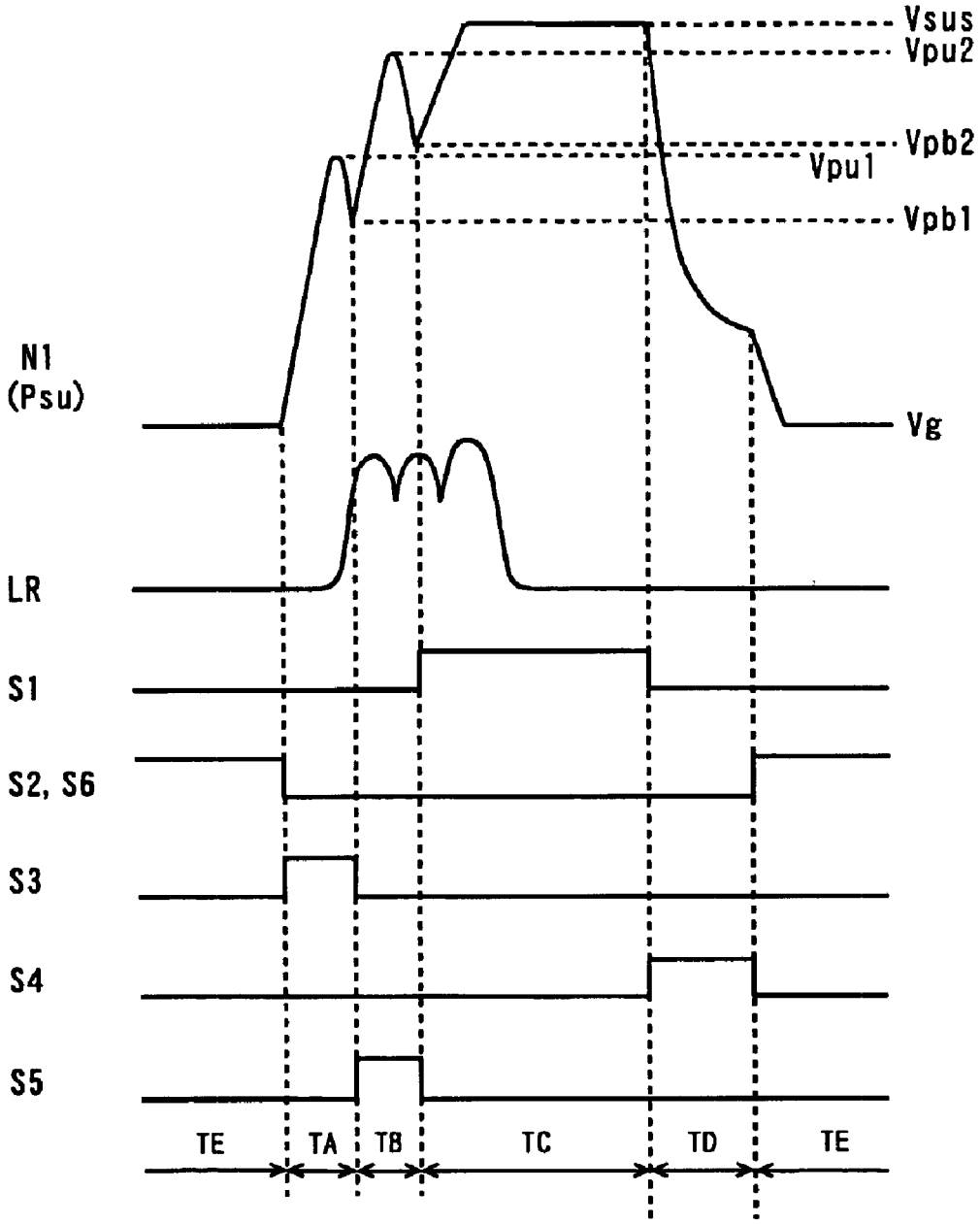
FIG. 23 is a timing chart showing the operation in a sustain time period of the sustain driver shown in FIG. 22.

FIG. 23 is a timing chart showing the operation in a sustain time period of the sustain driver 6*a* shown in FIG. 22. FIG. 23 illustrates a voltage at the node N1 shown in FIG. 22, discharge intensity LR in a PDP 7, and control signals S1 to S6 inputted to transistors Q1 to Q6. Each of the control signals S1 to S6 is a signal outputted from the sub-field processor 3*a* as the sustain driver driving control signal US.

First in a time period TA, the control signals S2 and S6 enter a low level so that the transistors Q2 and Q6 are turned off, and the control signal S3 enters a high level so that the transistor Q3 is turned on. At this time, the control signal S1 is at a low level so that the transistor Q1 is turned off, the control signal S4 is at a low level so that the transistor Q4 is turned off, and the control signal S5 is at a low level so that the transistor Q5 is turned off. Consequently, a recovery capacitor C1 is connected to a recovery coil L through the transistor Q3 and a diode D1, so that the voltage at the node N1 is smoothly raised from a ground potential Vg due to LC resonance by the recovery coil L and a panel capacitance Cp. At this time, charges on the recovery capacitor C1 are emitted to the panel capacitance Cp through the transistor Q3, the diode D1, and the recovery coil L.

When the voltage at the node N1 is raised, to exceed a discharge start voltage in the sustain time period, and the first discharge is started in discharge cells 14, the discharge intensity LR starts to be increased. Thereafter, the first discharge is increased to some extent. When a required discharge current exceeds the current supplying capability of a circuit comprising the recovery capacitor C1 and the recovery coil L, the voltage at the node N1 is lowered from a first maximal value Vpu1 to a first minimal value Vpb1. Accordingly, the first discharge is weakened or stopped and correspondingly, the discharge intensity LR is also reduced.

Then in a time period TB, the control signal S5 enters a high level so that the transistor Q5 is turned on, and the control signal S3 enters a low level so that the transistor Q3 is turned off. Consequently, the capacitor C2 is connected to the coil L1 through the transistor QS and the diode D3, and the voltage at the node N1 is smoothly raised again due to LC resonance by the coil L1 and the panel capacitance Cp. At this time, charges on the capacitor C2 are emitted to the panel capacitance Cp through the transistor Q5, the diode D3, and the coil L1.

A voltage at the capacitor C2 is charged by the variable voltage source VR when the transistor Q6 is turned on in a time period TE, as described later, and is set to a value higher than an intermediate potential between the first minimal value Vpb1 and a second maximal value Vpu2. Consequently, the voltage at the node N1 is raised to the second maximal value Vpu2 from the first minimal value Vpb1 due to LC resonance.

When the voltage at the node N1 is raised, to exceed the discharge start voltage again, and the discharge cells 14 start the second discharge, the discharge intensity LR starts to be increased. Thereafter, the second discharge is increased to some extent. When a required discharge current exceeds the current supplying capability of a circuit comprising the capacitor C2, the transistor Q5, the diode D3, and the coil L1, the voltage at the node N1 is lowered to a second minimal value Vpb2 from the second maximal value Vpu2. Accordingly, the second discharge is weakened or stopped and correspondingly, the discharge intensity LR is also reduced.

Then in a time period TC, the control signal S1 enters a high level so that the transistor Q1 is turned on, and the control signal S5 enters a low level so that the transistor Q5 is turned off. At this time, a current of the control signal S1 is limited by the current-limiting element IL, and charges for forming the channel of the transistor Q1 are gently charged through the gate of the transistor Q1. Consequently, the opening speed of the channel of the transistor Q1 is reduced. Accordingly, the voltage at the node N1 is gently raised to Vsus at a rising speed lower than rising speeds in the time periods TA and TB, that is, a rising speed from the ground potential Vg to the first maximal value Vpu1 and a rising speed from the first minimal value Vpb1 to the second maximal value Vpu2. Consequently, an edge portion which is sharply changed is not formed in the sustain pulse Psu, thereby restraining the radiation of unnecessary electromagnetic waves.

At this time, when the voltage at the node N1 is raised from the second minimal value Vpb2, to exceed the discharge start voltage again, third discharge is induced subsequently to the second discharge in the discharge cells 14, and the discharge intensity LR also starts to be increased again. Thereafter, when the voltage at the node N1 is held at Vsus, the third discharge is stopped, as in the conventional example, and correspondingly, the discharge intensity LR is also reduced.

Then in a time period TD, the control signal S1 enters a low level so that the transistor Q1 is turned on, and the control signal S4 enters a high level so that the transistor Q4 is turned on. Consequently, the recovery capacitor C1 is connected to the recovery coil L through the diode D2 and the transistor Q4, so that the voltage at the node N1 is gently lowered due to LC resonance by the recovery coil L and the panel capacitance Cp. At this time, charges stored in the panel capacitance Cp are stored in the recovery capacitor C1 through the recovery coil L, the diode D2 and the transistor Q4, so that the charges are recovered.

Then in a time period TE, the control signals S2 and S6 enter a high level so that the transistors Q2 and Q6 are turned on, and the control signal S4 enters a low level so that the transistor Q4 is turned off. Consequently, the node N1 is connected to the ground terminal, so that the voltage at the node N1 is lowered and is fixed to the ground potential Vg. Further, the variable voltage source VR is connected to the capacitor C2 through the node N4, so that the capacitor C2 is charged to a voltage higher than an intermediate potential between the first minimal value Vpb1 and the second maximal value Vpu2.

By repeatedly performing the above-mentioned operations in the sustain time period, periodical sustain pulses Psu for continuously inducing the first to third discharges can be applied to the plurality of sustain electrodes 13 at the time of the rise from the ground potential Vg to the voltage Vsus. In the above-mentioned manner, sustain pulses which have the same waveform as the sustain pulses Psu and are shifted by a phase of 180° are also periodically applied to scan electrodes 12 by the scan driver 5*a*.

An operation for controlling the waveform of a sustain pulse depending on a lighting rate for each sub-field will be then described. In the following description, description is made of such an operation that the sustain driver 6*a* is controlled by the sub-field processor 3*a*, to control the waveform of the sustain pulse Psu. The scan driver 5*a* is also controlled by the sub-field processor 3*a* in the same manner as described below. Similarly, the waveform of the sustain pulse applied to the scan electrodes 12 is controlled depending on the lighting rate for each sub-field.

In the sub-field processor 3*a*, a discharge is induced only once, as in the conventional example, when the lighting rate measured by the sub-field lighting rate measuring unit 8 is lower than a predetermined value. That is, the voltage of the sustain pulse is raised due to resonance by the recovery coil L and the panel capacitance Cp, so that a discharge for supplying a discharge current from a power supply for applying the sustain voltage Vsus is induced once, to induce first to third discharges when the lighting rate is not less than the predetermined value. At this time, as the lighting rate is increased, the timing at which the sustain pulse Psu rises again in response to the sub-field lighting rate signal SL, that is, the timing at which the control signals S5 and S1 enter a high level (and the control signals. S3 and S5 enter a low level) is successively changed such that the respective discharges are induced in a more separated state, to control the sustain driver 6*a*.

When the lighting rate is less than the predetermined value in a certain sub-field, the timing at which the control signals S5 and S1 enter a high level is advanced, or the timing at which the control signal S1 enters a high level after the control signal S5 is always brought into a low level, that is, the second driving circuit in the present embodiment is brought into a non-operated state is advanced. The voltage of the sustain pulse is raised due to resonance by the recovery coil L and the panel capacitance Cp so that a discharge for supplying a discharge current from the power supply for feeding the sustain voltage Vsus is induced once, to induce discharges only once, as in the conventional example. On the other hand, when the lighting rate is increased, the timing at which the control signals S5 and S1 enter a high level is successively delayed. Accordingly, a second discharge is induced after the first discharge is weakened or stopped, and a third discharge is induced after the second discharge is weakened or stopped.

Also in the present embodiment, therefore, control is carried out such that as the lighting rate for each sub-field is increased, the timing at which the control signals S5 and S1 enter a high level is successively delayed, as in the second embodiment. Luminance is successively increased by making a gradual change from the discharge induced once to the first to third discharges, to give no visually uncomfortable feeling. It goes without saying that the same effect is obtained even if used as control for switching from the discharge induced once to the first to third discharges is control for switching by changing the level of a video signal in signal processing to make the difference between the luminance obtained in the discharge induced once and the luminance obtained in the first to third discharges inconspicuous in addition to the above-mentioned control of successively delaying the timing at which the control signals S5 and S1 enter a high level.

The lighting rate in the sub-field where switching from the discharge induced once to the first to third discharges occurs is not particularly limited, provided that power consumption can be synthetically reduced, and there is no visually uncomfortable feeling. In the present embodiment, when the lighting rate is not less than 25%, for example, the respective timings at which the control signals S5 and S1 enter a high level such that a change from the discharge induced once to the first to third discharges is made when the lighting rate is not less than 25%, for example.

An operation for controlling the voltage of the sustain pulse depending on the lighting rate for each sub-field will be then described. In the following description, description is made of such an operation that the sustain driver 6*a* is controlled by the voltage control circuit 9, to control the voltage of the sustain pulse Psu. However, the scan driver 5*a* is also controlled by the voltage control circuit 9 in the same manner as described below, so that the voltage of the sustain pulse applied to the scan electrode 12 is similarly controlled depending on the lighting rate for each sub-field.

When the lighting rate is increased, the required discharge current is increased so that the voltage at the node N1 is greatly lowered, so that the first minimal value Vpb1 is decreased. When the lighting rate is reduced, the required discharge current is decreased so that the voltage drop at the node N1 is reduced, so that the first minimal value Vpb1 is increased. On the other hand, in order to raise the voltage at the node N1 to the second maximal value Vpu2 due to LC resonance by the coil L1 and the panel capacitance Cp, the voltage at the node N4 must be made higher than an intermediate potential between the first minimal value Vpb1 and the second maximal value Vpu2.

In order to raise the voltage at the node N1 to the original second maximal value Vpu2 such that the second discharge can be stably induced, therefore, the voltage at the node N4 must be lowered only by ΔV/2 when the lighting rate is increased so that the first minimal value Vpb1 is decreased only by ΔV, while the voltage at the node N4 must be raised only by ΔV/2 when the lighting rate is reduced so that the first minimal value Vpb1 is increased by ΔV. Therefore, in the present embodiment, the voltage of the sustain pulse Psu is controlled depending on the lighting rate, in the following manner, in order to stably induce the second discharge.

The voltage control circuit 9 controls the variable voltage source VR in the sustain driver 6*a* in accordance with the sub-field lighting rate signal SL such that the lighting rate measured by the sub-field lighting rate measuring unit 8 reaches not less than a predetermined value, and the higher the lighting rate is, the lower an output voltage of the variable voltage source VR is when the first to third discharges are induced.

When in a certain sub-field, the lighting rate is increased so that the first minimal value Vpb1 is decreased, the voltage control circuit 9 outputs the voltage control signal VU to the variable voltage source VR such that the higher the lighting rate is, the lower the output voltage of the variable voltage source VR is. At this time, the variable voltage source VR lowers the output voltage in response to the voltage control signal VU, to lower the voltage at the node N4. Even if the first minimal value Vpb1 is decreased, therefore, the voltage at the node N1 can be raised to the original second maximal value Vpu2, thereby making it possible to continuously stably induce a second discharge.

On the other hand, when the lighting rate is decreased, the voltage control signal VU for raising the output voltage at the variable voltage source VR is outputted depending on the lighting rate, so that the voltage at the node N4 is raised. Even if the first minimal value Vpb1 is increased, therefore, the voltage at the node N1 can be raised to the original second maximal value Vpu2, thereby making it possible to continuously stably induce the second discharge.

As described in the foregoing, in the present embodiment, the first to third discharges are continuously induced when the sustain pulse rises, thereby making it possible to improve luminous efficiency corresponding to applied power to reduce power consumption. Further, the timing at which the sustain pulse rises again is controlled depending on the lighting rate for each sub-field, thereby making it possible to gradually improve luminous efficiency to reduce power consumption in a state where there is no visually uncomfortable feeling. Further, the voltage of the sustain pulse is controlled depending on the lighting rate for each sub-field, thereby making it possible to stably induce the second discharges in a simple circuit configuration.

Although description was made of a case where the first to third discharges are continuously induced, the number of times of continuous discharges is not limited to that in the above-mentioned example. The continuous discharges may be induced not less than the number of times. In this case, a driving circuit comprising the capacitor C2, the transistors Q5 ad Q6, the diode D3, the variable voltage source VR, and the coil L1 shown in FIG. 22 is successively added for the purpose of the respective discharges, thereby making it possible to continuously induce the discharges in the same manner as described above.

Figure 24:
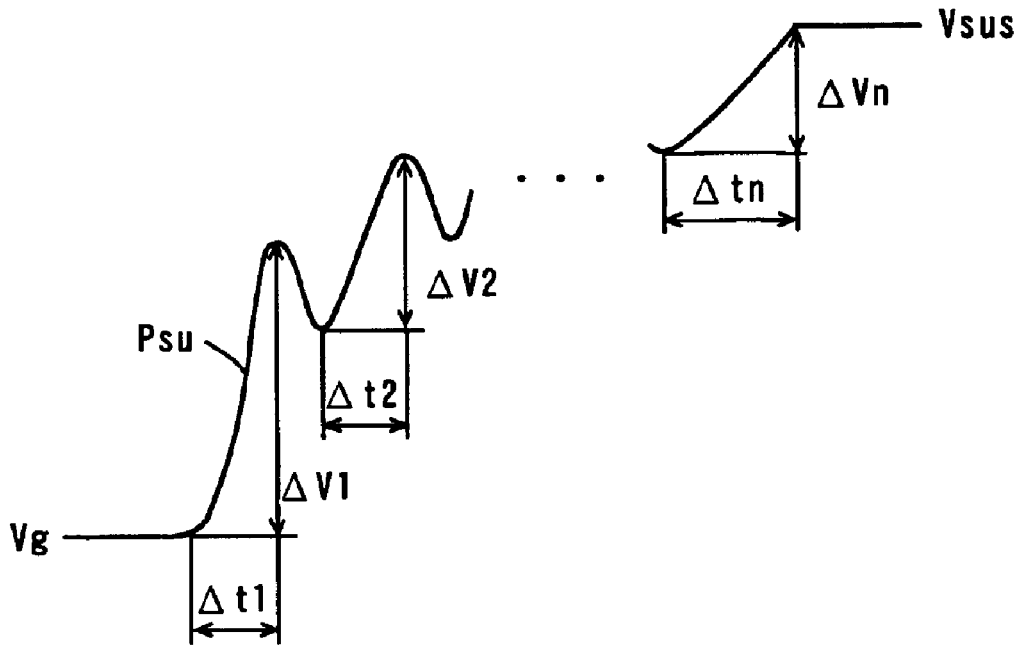
FIG. 24 is a diagram showing the waveform of a sustain pulse in a case where discharges are continuously induced a plurality of times by the present invention.

When the discharges are continuously induced, the waveform of a portion, where the last discharge is induced, of the sustain pulse is constructed as follows. FIG. 24 is a diagram showing the waveform of the sustain pulse Psu in a case where the voltage of the sustain pulse is successively raised and is finally raised to the voltage Vsus due to a plurality of times of LC resonance.

As shown in FIG. 24, the sustain pulse Psu is raised by a voltage ΔV1 during a time period Δt1 and is then lowered at the first step, and is raised by a voltage ΔV2 during a time period Δt2 at the subsequent step. The sustain pulse Psu is thus successively raised due to LC resonance, and is finally raised by a voltage ΔVn during a time period Δtn. The sustain pulse Psu is raised from a ground potential Vg to the voltage Vsus. At this time, the current value of the control signal S1 inputted to the gate of the transistor Q1 is limited by the current-limiting element IL such that a rising speed ΔVn/Δtn at the final step is the lowest of rising speeds ΔV1/Δt1, ΔV2/Δt2, . . . , ΔVn-1/Δtn-1 of the sustain pulse Psu in each step.

The rising waveform in each step of the sustain pulse Psu is thus composed of a plurality of smooth overshoot waveforms due to LC resonance, and can be also gently raised when the sustain pulse Psu finally reaches the voltage Vsus at the power supply terminal V1. Consequently, an edge portion which is sharply changed as in the conventional example is not formed, thereby making it possible to restrain the radiation of unnecessary electromagnetic waves.

Figure 25:
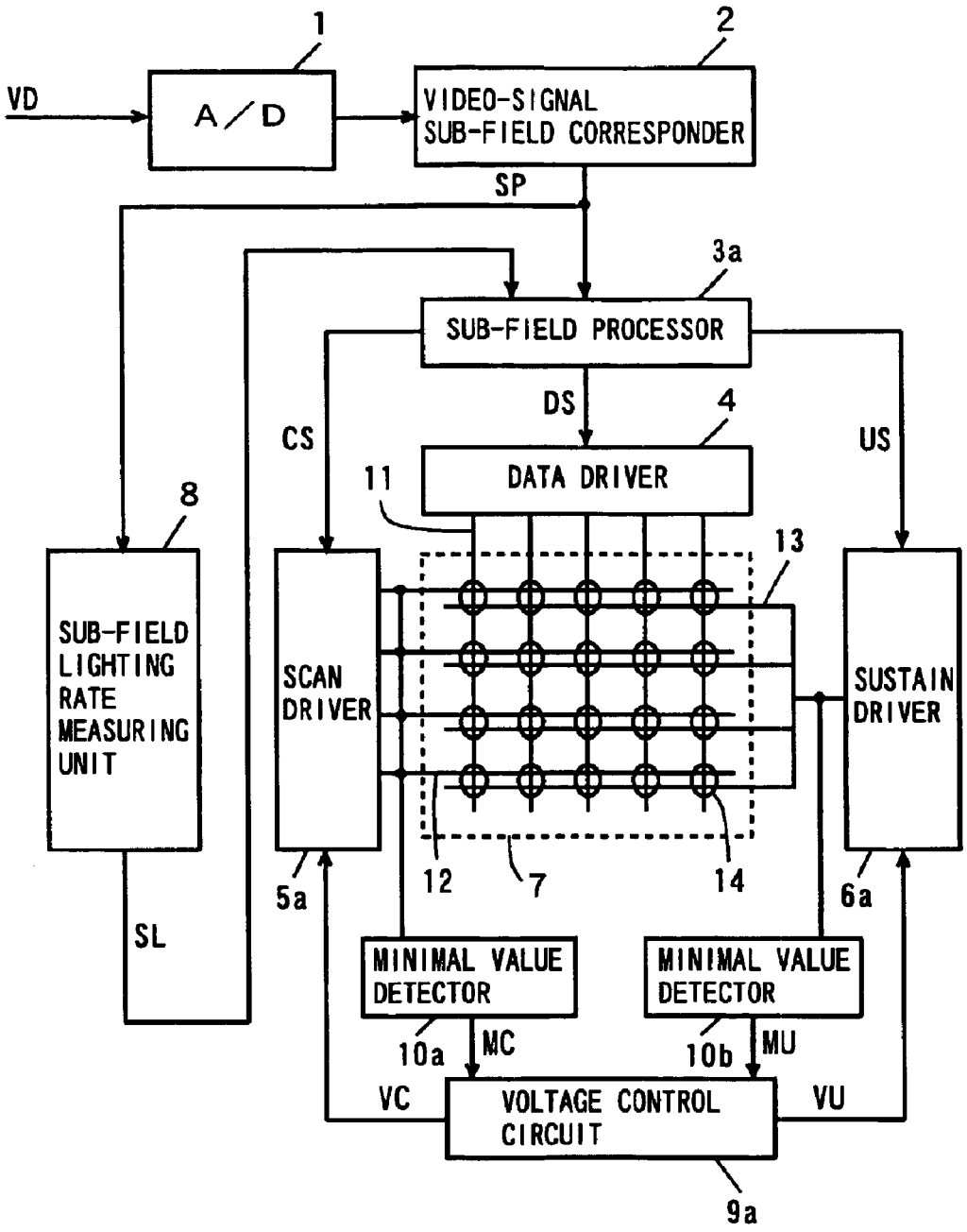
FIG. 25 is a block diagram showing the configuration of a plasma display device according to a fourth embodiment of the present invention.

Description is now made of a plasma display device according to a fourth embodiment of the present invention. FIG. 25 is a block diagram showing the configuration of the plasma display device according to the fourth embodiment of the present invention.

The plasma display device shown in FIG. 25 is the same as the plasma display device shown in FIG. 21 except that the voltage control circuit 9 is changed into a voltage control circuit 9*a*, and minimal value detectors 10*a* and 10*b* are added. Accordingly, the same portions are assigned the same reference numerals and hence, only different portions will be described in detail below.

The minimal value detector 10*a* shown in FIG. 25 detects a minimal value of a sustain pulse in a sustain time period of each scan electrode 12, and outputs the results of the detection to the voltage control circuit 9*a* as a minimal value signal MC. The minimal value detector 10*b* detects a minimal value of a sustain pulse in a sustain time period of a sustain electrode 13, and outputs the results thereof to the voltage control circuit 9*a* as a minimal value signal MU.

The voltage control circuit 9*a* respectively outputs a voltage control signal VC for controlling an output voltage of a variable voltage source in a scan driver 5*a* and a voltage control signal VU for controlling an output voltage of a variable voltage source VR in a sustain driver 6*a* to the scan driver 5*a* and the sustain driver 6*a* in response to the minimal value signals MC and MU. The subsequent operations of the scan driver 5*a* and the sustain driver 6*a* and an operation for controlling the waveform of the sustain pulse depending on a lighting rate for each sub-field are the same as those in the third embodiment and hence, the detailed description thereof is omitted.

The present embodiment is the same as the third embodiment except that the voltage control circuit 9*a* corresponds to a voltage control circuit, and the minimal value detectors 10*a* and 10*b* correspond to a potential detection circuit.

An operation for controlling a voltage of a sustain pulse depending on a lighting rate for each sub-field will be described. In the following description, description is made of such an operation that the sustain driver 6*a* is controlled by the voltage control circuit 9*a*, to control a voltage of a sustain pulse Psu. However, the scan driver 5*a* is controlled by the voltage control circuit 9*a* in the same manner as described below. The voltage of the sustain pulse applied to each of the scan electrodes 12 is controlled depending on a first minimal value of the sustain pulse in the sustain time period of the scan electrode 12 which is detected by the minimal value detector 10*a*.

The voltage control circuit 9*a* controls the variable voltage source VR in the sustain driver 6*a* depending on the minimal value signal MU such that the lower a first minimal value Vpb1 detected by the minimal value detector 10*b* is, the lower the output voltage of the variable voltage source VR is.

When the lighting rate is increased so that the first minimal value Vpb1 is decreased in a certain sub-field, for example, the voltage control circuit 9*a* outputs the voltage control signal VU to the variable voltage source VR such that the lower the first minimal value Vpb1 is, the lower the output voltage at the variable voltage source VR is and specifically, the output voltage is lowered by $\Delta V/2$ when the first minimal value Vpb1 is lowered by $\Delta V$. At this time, the variable voltage source VR lowers the output voltage in response to the voltage control signal VU, to lower a voltage at a node N4. Even if the first minimal value Vpb1 is decreased, therefore, a voltage at a node N1 can be raised to the original second maximal value Vpu2, thereby making it possible to continuously stably induce a second discharge.

On the other hand, when the lighting rate is reduced so that the first minimal value Vpb1 is increased, the voltage control circuit 9*a* outputs the voltage control signal VU to the variable voltage source VR such that the higher the first minimal value Vpb1 is, the higher the output voltage of the variable voltage source VR is and specifically, the output voltage is raised by $\Delta V/2$ when the first minimal value Vpb1 is raised by $\Delta V$. At this time, the variable voltage source VR raises the output voltage in response to the voltage control signal VU, to raise the voltage at the node N4. Even if the first minimal value Vpb1 is increased, therefore, the voltage at the node N1 can be raised to the original second maximal value Vpu2, thereby making it possible to continuously stably induce the second discharge.

Although also in the present embodiment, the same effect as that in the third embodiment can be obtained, and the first minimal value of the sustain pulse is directly detected, as described above, the second maximal value can be adjusted with higher precision, thereby making it possible to more stably induce the second discharge.

Figure 26:
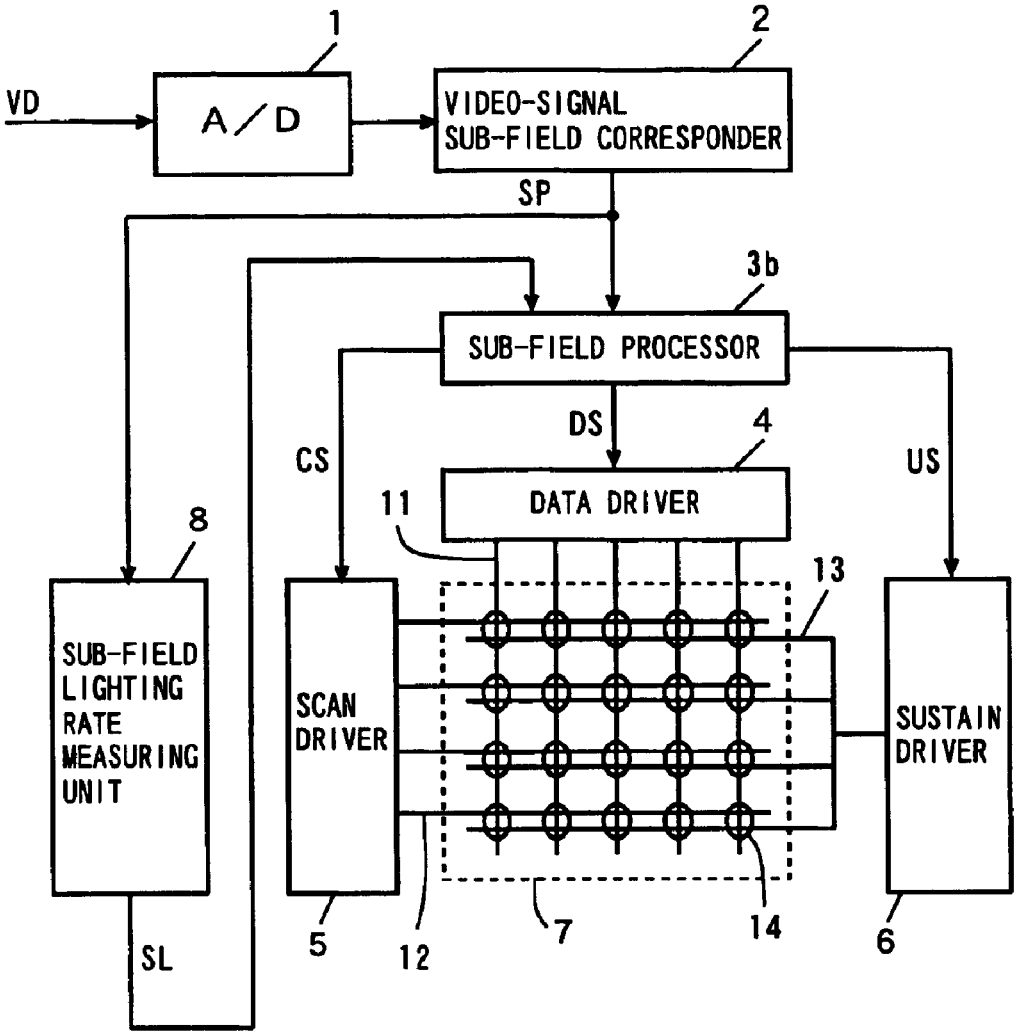
FIG. 26 is a block diagram showing the configuration of a plasma display device according to a fifth embodiment of the present invention.

Description is now made of a plasma display device according to a fifth embodiment of the present invention. FIG. 26 is a block diagram showing the configuration of the plasma display device according to the fifth embodiment of the present invention.

The plasma display device shown in FIG. 26 is the same as the plasma display device shown in FIG. 11 except that the sub-field processor 3' is changed into a sub-field processor 3*b* for switching the respective timings at which sustain pulses outputted from a scan driver 5 and a sustain driver 6 rise again in response to a sub-field lighting rate signal and controlling the scan driver 5 and the sustain driver 6 so as to change the number of sustain pulses such that luminance on a PDP 7 is equal before and after the switching. Accordingly, the same portions are assigned the same reference numerals and hence, only different portions will be described in detail below.

The sub-field processor 3*b* shown in FIG. 26 generates a scan driver driving control signal CS and a sustain driver driving control signal US for increasing and decreasing the number of sustain pulses such that in a case where the timing at which the sustain pulse is increased again is switched, the luminance is equal before and after the switching, and respectively outputs the signals to the scan driver 5 and the sustain driver 6 in addition to the normal operation of the sub-field processor 3' shown in FIG. 11.

Figure 27:
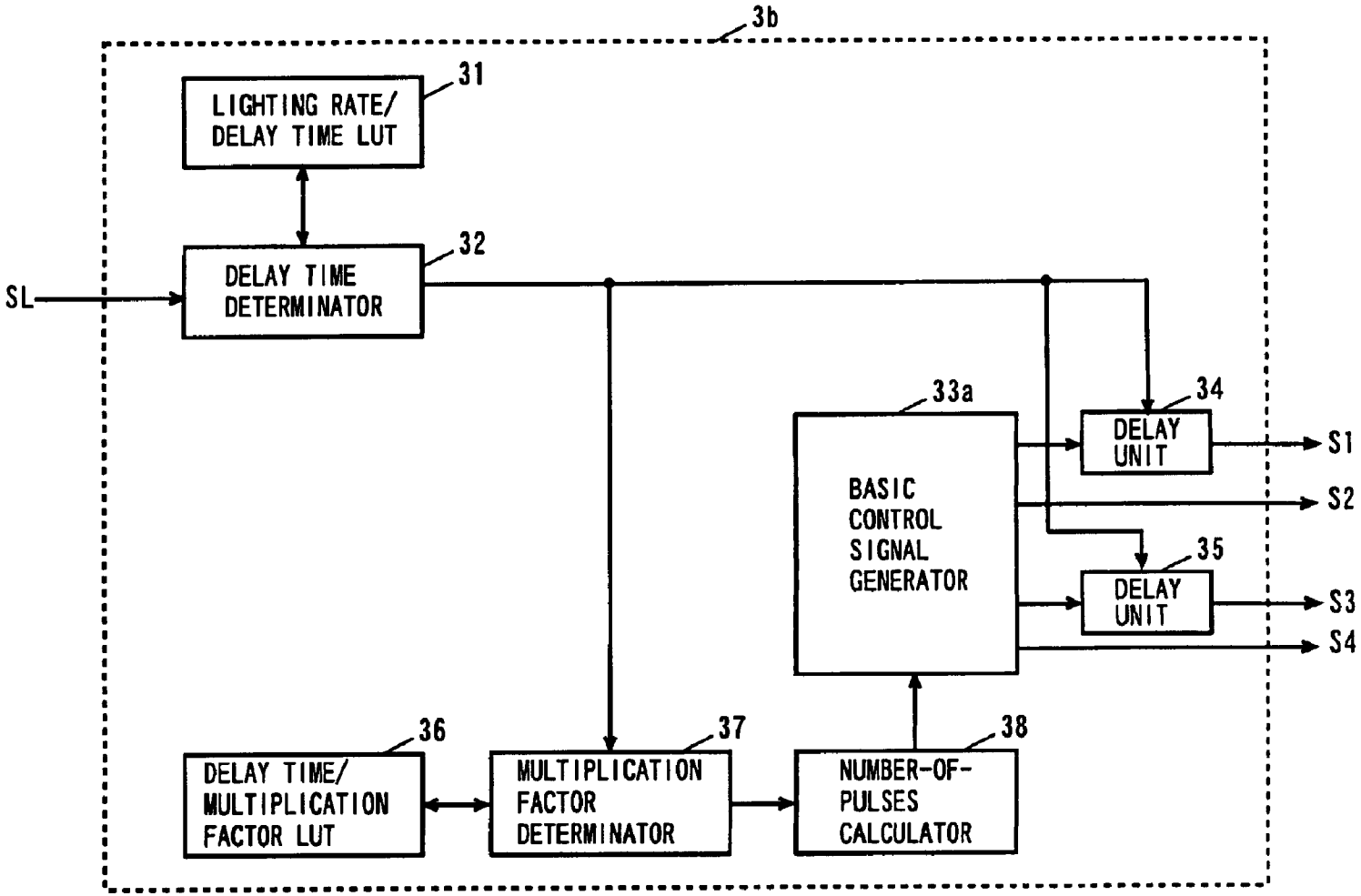
FIG. 27 is a block diagram showing the configuration of a sub-field processor shown in FIG. 26.

FIG. 27 is a block diagram showing the configuration of the sub-field processor 3*b* shown in FIG. 26. The sub-field processor 3*b* shown in FIG. 27 is the same as the sub-field processor 3' shown in FIG. 12 except that a delay time/multiplication factor LUT 36, a multiplication factor determinator 37, and a number-of-pulses calculator 38 are added, and the basic control signal generator 33 is changed into a basic control signal generator 33*a*. Accordingly, the same portions are assigned the same reference numerals and hence, the detailed description thereof is omitted.

The delay time/multiplication factor LUT 36 shown in FIG. 27 is connected to the multiplication factor determinator 37, and stores in a table format the relationship between a delay time Td and a multiplication factor based on experimental data. For example, one is stored as the multiplication factor with respect to the delay time Td of 100 ns, and 431/439 is stored as the multiplication factor with respect to the delay time Td of 200 ns.

The multiplication factor determinator 37 is connected to a delay time determinator 32 and the number-of-pulses calculator 38, and reads out a corresponding multiplication factor from the delay time/multiplication factor LUT 36 depending on the delay time Td determined by the delay time determinator 32 and outputs the read multiplication factor to the number-of-pulses calculator 38. The determination of the multiplication factor is not particularly limited to the example in which the relationship between a delay time Td and a multiplication factor based on experimental data is stored in a table format, as described above. For example, the multiplication factor corresponding to the delay time may be found from an approximate expression representing the relationship between a delay time Td and a multiplication factor.

The number-of-pulses calculator 38 is connected to the basic control signal generator 33*a*, and outputs to the basic control signal generator 33*a* the number of sustain pulses adjusted by multiplying the number of sustain pulses to be a reference number by the multiplication factor determined by the multiplication factor determinator 37.

The basic control signal generator 33*a* outputs control signals S1 to S4 as the sustain driver driving control signal US such that the sustain driver 6 outputs the adjusted number of sustain pulses.

By the above-mentioned configuration, the sub-field processor 3*b* changes the delay time Td depending on a lighting rate measured by a sub-field lighting rate measuring unit 8, and controls the timing at which the control signal S1 enters a high level and the timing at which the control signal S3 enters a low level and controls the number of sustain pulses outputted from the sustain driver 6.

The scan driver 5 is also controlled by the sub-field processor 3*b*, as in the foregoing. The waveform and the number of sustain pulses applied to the scan electrodes 12 are similarly controlled depending on the lighting rate for each sub-field.

The present embodiment is the same as the second embodiment except that the sub-field processor 3*b* corresponds to a control circuit.

In a case where the PDP having the characteristics shown in FIG. 17 is used, to set the delay time Td to 100 ns when the lighting rate is 25 to 45% and set the delay time Td to 200 ns when it is 45 to 60%, for example, the luminance is changed from 431 cd/m$^2$ to 439 cd/m$^2$ at the lighting rate of 45%, that is, the luminance is changed by 8 cd/m$^2$.

In order to correct such a change in the luminance, the sub-field processor 3*b* switches the delay time and at the same time, corrects the number of sustain pulses after the switching to 431/439 times the original number. For example, it is changed into 98 (≈100×431/439) pulses when the number of sustain pulses is 100, while being changed into 147 (≈50×431/439) pulses when the number of sustain pulses is 150.

By thus correcting the number of pulses, the luminance is equal before and after switching the delay time, thereby making it possible to switch the delay time, that is, the timing at which the sustain pulse rises again without giving a visually uncomfortable feeling.

When the luminance differs before and after the switching, as described above, the delay time may be gradually switched without being greatly changed at a time and changed such that the luminance is almost continued.

For example, the delay time Td may be set to 100 ns in a case where the lighting rate is 25 to 45%, as described above, and successively increased by 10 ns every time the lighting rate is thereafter increased by 1% utilizing the continuity of a video signal so that the delay time is 200 ns when the lighting rate is 55%. In this case, the change in the luminance before and after switching the delay time is very small, for example. 2.4 (=(455−431/10) cd/m$^2$, thereby making it possible to control the delay time, that is, the timing at which the sustain pulse rises again depending on the lighting rate without giving a visually uncomfortable feeling.

Figure 28:
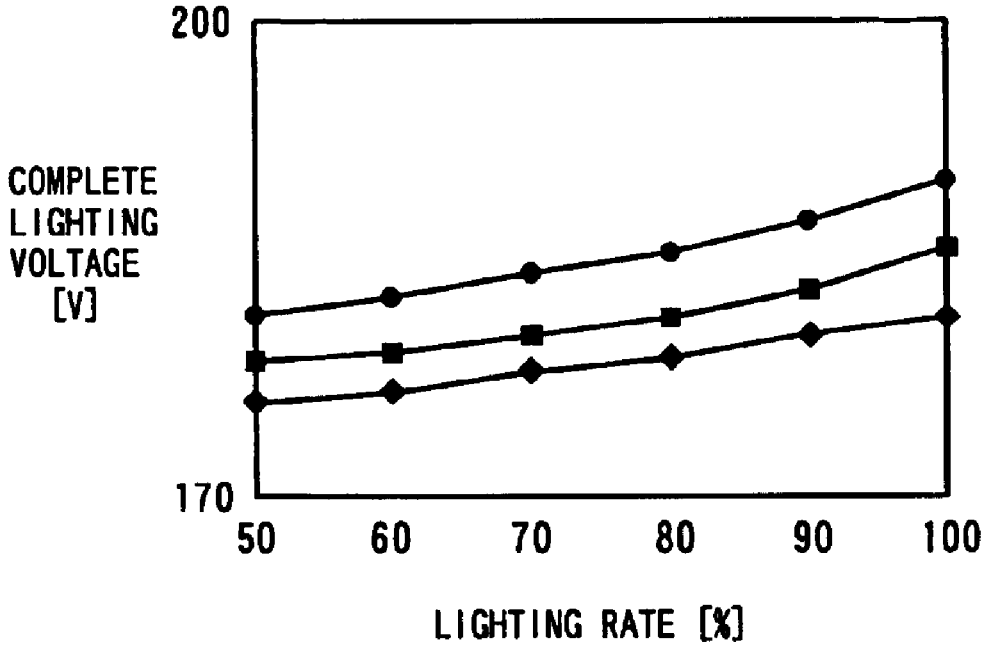
FIG. 28 is a diagram showing the relationship between a complete lighting voltage and a lighting rate.

Description is now made of the relationship between a complete lighting voltage at which all discharge cells on the PDP are turned on by first and second discharges and a lighting rate. FIG. 28 is a diagram showing the relationship between a complete lighting voltage and a lighting rate. FIG. 28 illustrates the relationship between a complete lighting voltage (V) and a lighting rate (%) in a case where the delay time Td is 350 ns and the inductance value of a recovery coil L is 0.36 μs using a 42-inch PDP, where a black circle indicates a case where the sustain period is 6 μs, a black square indicates a case where the sustain period is 7 μs, and a black rhombus indicates a case where the sustain period is 8 μs.

As can be seen from FIG. 28, the longer the sustain period becomes, the lower the complete lighting voltage becomes. Consider a case where the PDP is driven at a practical voltage, for example, 185 V. In this case, when the sustain period is 6 μs, some of the discharge cells in the PDP are not turned on occur when the lighting rate exceeds 80%, thereby making it impossible to induce stable sustain discharges. When the sustain period is 7 μs, all the discharge cells can be turned on with respect to all lighting rates. If the variation in the PDP, for example, is considered, however, a sufficient margin cannot be ensured.

On the other hand, when the sustain period is 8 μs, all the discharge cells can be stably turned on by inducing the first and second discharges in all the discharge cells with respect to all the lighting rates while ensuring a sufficient margin. The sustain period is thus changed depending on the lighting rate, thereby making it possible to ensure the stability of the sustain discharges in a case where the first and second discharges are induced. The embodiment will be described below.

Figure 29:
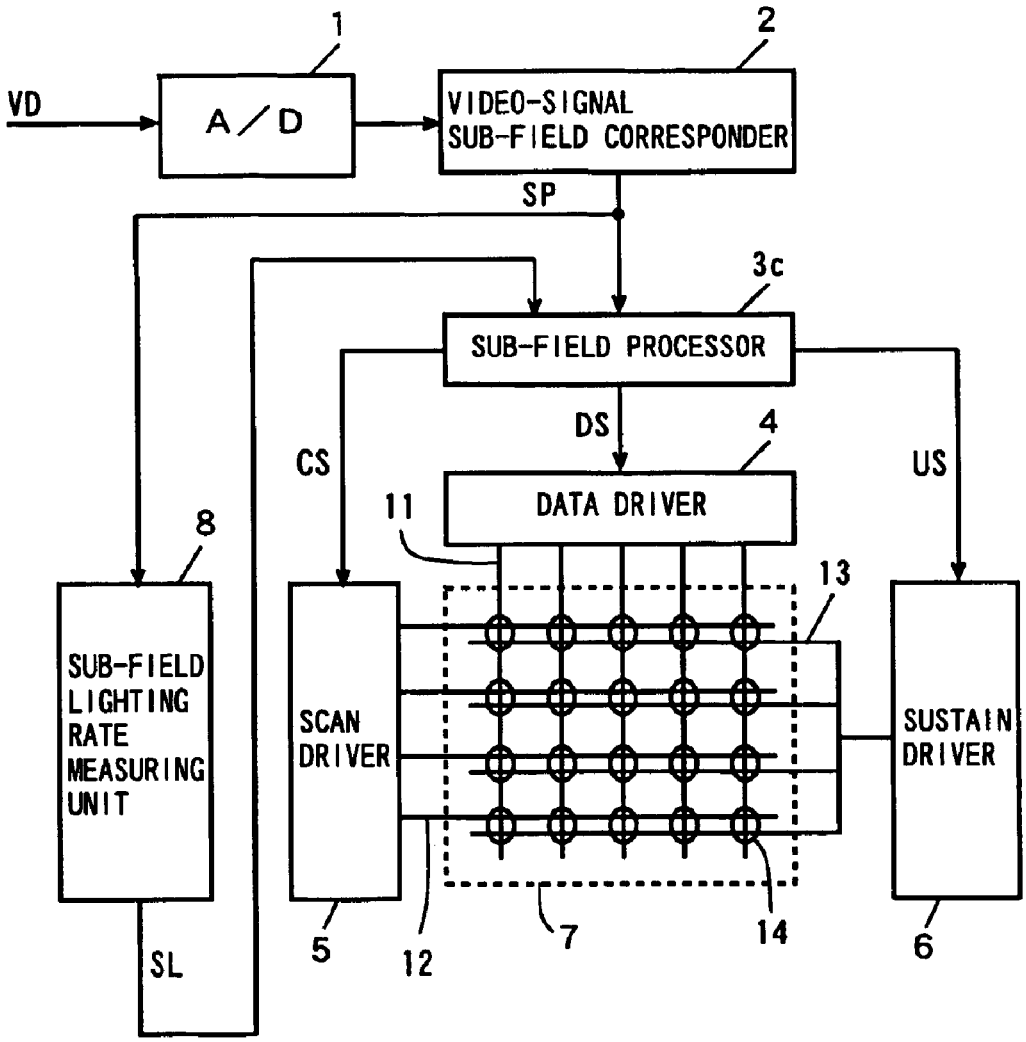
FIG. 29 is a block diagram showing the configuration of a plasma display device according to a sixth embodiment of the present invention.

Description is now made of a plasma display device according to a sixth embodiment of the present invention. FIG. 29 is a block diagram showing the configuration of the plasma display device according to the sixth embodiment of the present invention.

The plasma display device shown in FIG. 29 is the same as the plasma display device shown in FIG. 11 except that the sub-field processor 3' is changed into a sub-field processor 3*c*. Accordingly, the same portions are assigned the same reference numerals and hence, only different portions will be described in detail below.

The sub-field processor 3*c* shown in FIG. 29 generates a scan driver driving control signal CS and a sustain driver driving control signal US for changing a sustain period in response to a sub-field lighting rate signal SL outputted from a sub-field lighting rate measuring unit 8, and respectively outputs the signals to a scan driver 5 and a sustain driver 6 in addition to the normal operation of the sub-field processor 3' shown in FIG. 11.

Figure 30:
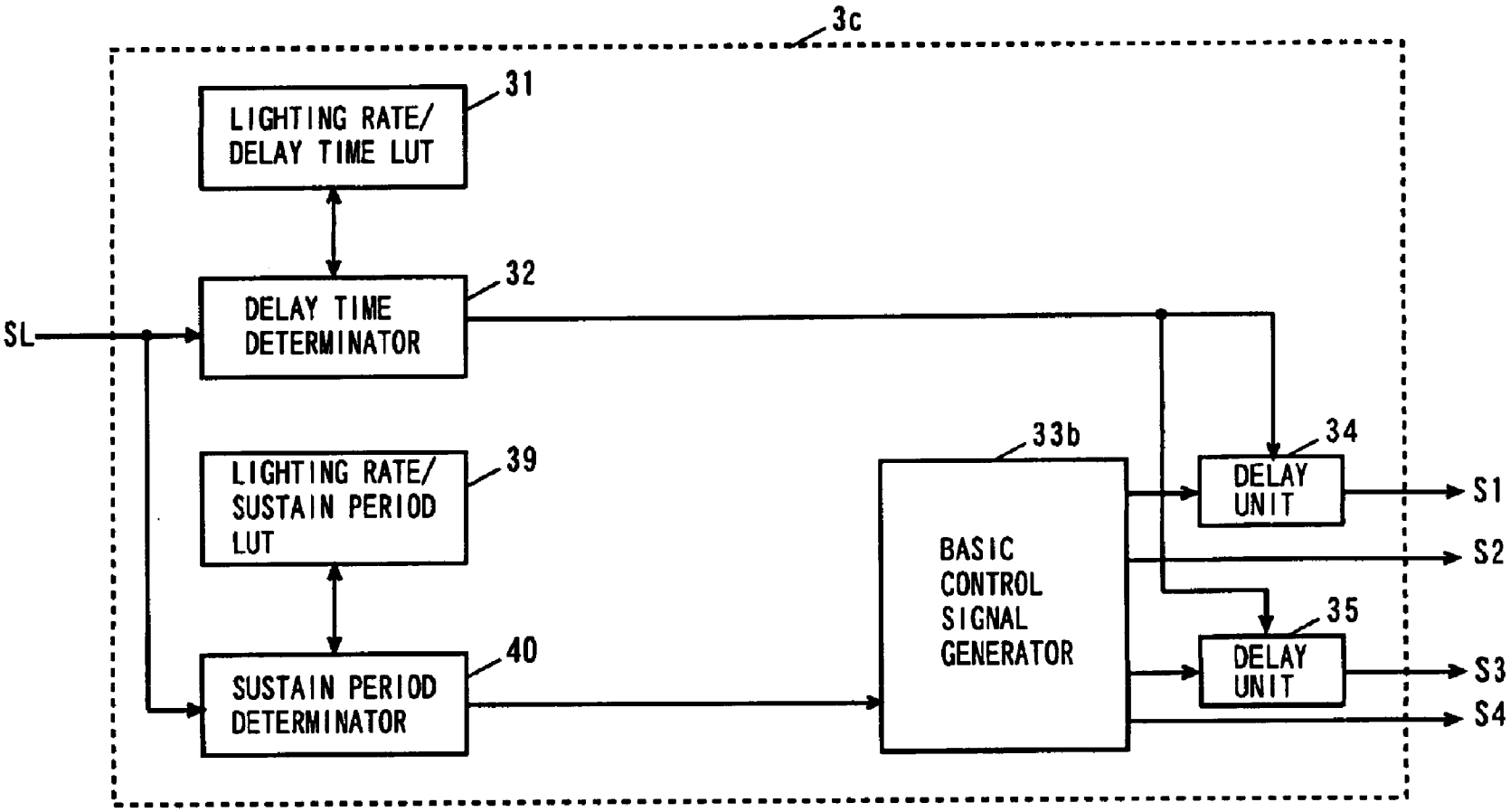
FIG. 30 is a block diagram showing the configuration of a sub-field processor shown in FIG. 29.

FIG. 30 is a block diagram showing the configuration of the sub-field processor 3*c* shown in FIG. 29. The sub-field processor 3*c* shown in FIG. 30 is the same as the sub-field processor 3' shown in FIG. 12 except that a lighting rate/sustain period LUT and a sustain period determinator 40 are added, and the basic control signal generator 33 is changed into a basic control signal generator 33*b*. Accordingly, the same portions are assigned the same reference numerals and hence, the detailed description thereof is omitted.

The lighting rate/sustain period LUT 39 shown in FIG. 30 is connected to the sustain period determinator 40, and stores in a table format the relationship between a lighting rate and a sustain period based on experimental data. For example, 6 μs is stored as the sustain period with respect to the lighting rate of less than 80%, and 8 μs is stored as the sustain period with respect to the lighting rate of not less than 80%.

The sustain period determinator 40 is connected to the basic control signal generator 33*b*, and reads out the corresponding sustain period from the lighting rate/sustain period LUT 39 in response to the sub-field lighting rate signal SL outputted from the sub-field lighting rate measuring unit 8 and outputs the read sustain period to the basic control signal generator 33*b*. The determination of the sustain period is not particularly limited to the example in which the relationship between a lighting rate and a sustain period based on experimental data is stored in a table format, as described above. For example, the sustain period corresponding to the lighting rate may be found by an approximate expression representing the relationship between a lighting rate and a sustain period, for example, by fixing a sustain period corresponding to a lighting rate of not more than 60% to 6 μs, fixing a sustain period corresponding to a lighting rate of 100% to 8 μs, and approximating a lighting rate from 60% to 100% using a linear expression.

The basic control signal generator 33*b* outputs control signals S1 to S4 as the sustain driver driving control signal US such that the sustain pulses are outputted in the sustain period determined by the sustain period determinator 40.

By the above-mentioned configuration, the sub-field processor 3*c* changes a delay time Td depending on the lighting rate measured by the sub-field lighting rate measuring unit 8, and controls the timing at which the control signal S1 enters a high level and the timing at which the control signal S3 enters a low level and controls the sustain period of the sustain pulses outputted from the sustain driver 6.

The scan driver 5 is also controlled by the sub-field processor 3*c* in the same manner as described above. Similarly, the waveform and the period of the sustain pulses applied to the scan electrodes 12 are controlled depending on the lighting rate for each sub-field.

The present embodiment is the same as the second embodiment except that the sub-field processor 3*c* corresponds to a control circuit.

Figure 31:
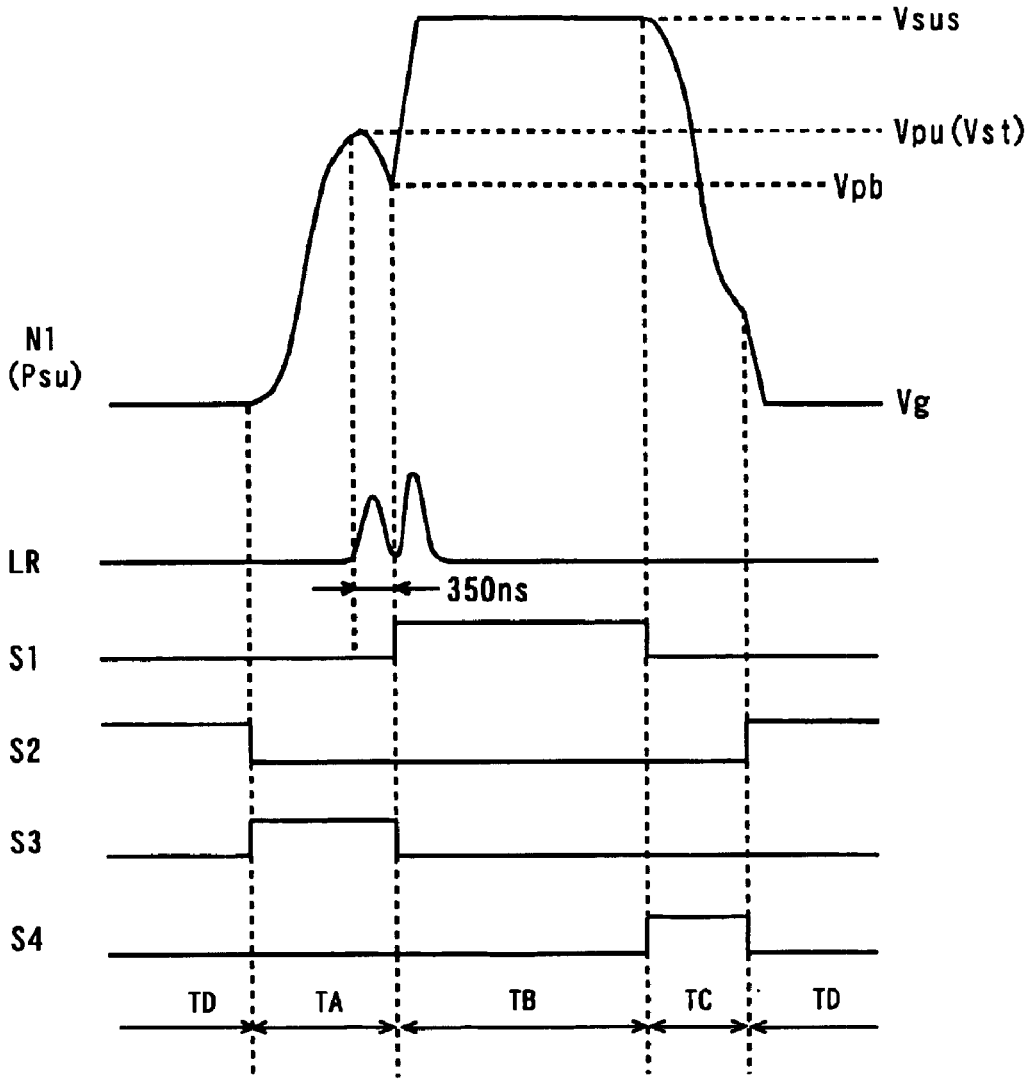
FIG. 31 is a timing chart showing the operation in a sustain time period of a sustain driver shown in FIG. 29 in a case where a delay time is 350 ns and a sustain period is 8 $\mu$m.

FIG. 31 is a timing chart showing the operation in a sustain time period of the sustain driver 6 shown in FIG. 29 in a case where the delay time Td is 350 ns and the sustain period is 8 μs. FIG. 31 illustrates a voltage at the node N1 shown in FIG. 3, discharge intensity LR in a PDP 7, and the control signals S1 to S4 inputted to transistors Q1 to Q4.

When the delay time Td is 350 ns, and the sustain period is 8 μs, as shown in FIG. 31, first and second discharges are continuously induced, as in FIG. 16. However, the sustain period is long. Accordingly, a wall voltage is sufficiently formed by the second discharge, thereby making the first discharge and the second discharge after a half period more reliable. As a result, the second discharge can sufficiently have a priming effect produced by the first discharge, and the second discharge has a sufficient intensity, that is, a peak value larger than the peak value of the first discharge. Accordingly, sustain discharges can be stably repeated.

Figure 32:
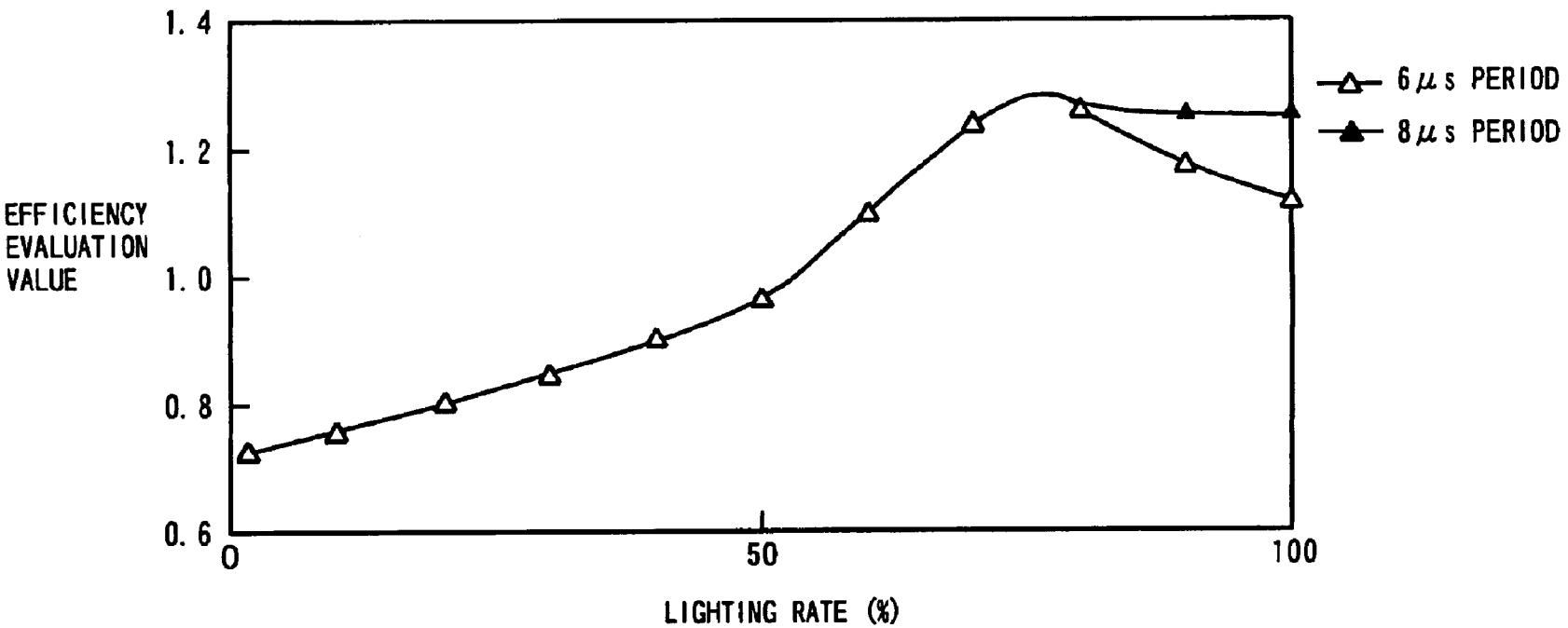
FIG. 32 is a diagram showing the relationship between an efficiency evaluation value and a lighting rate in the plasma display device shown in FIG. 29 in a case where a sustain period is 6 μm and 8 μm.

FIG. 32 is a diagram showing the relationship between an efficiency evaluation value and a lighting rate in cases where the sustain period is 6 μs and 8 μs in the plasma display device shown in FIG. 29. In FIG. 32, a white triangle indicates a case where the sustain period is 6 μs, a black triangle indicates a case where the sustain period is 8 μs, and both the delay times are 350 ns.

As shown in FIG. 32, the efficiency evaluation value in a case where the sustain period is 8 μs when the lighting rate is in the range of 80 to 100% is higher than that in a case where the sustain period is 6 μs. When the lighting rate thus reaches not less than a predetermined value, it is found that power consumption in a case where the same luminance is displayed can be reduced by lengthening the sustain period.

Figure 33:
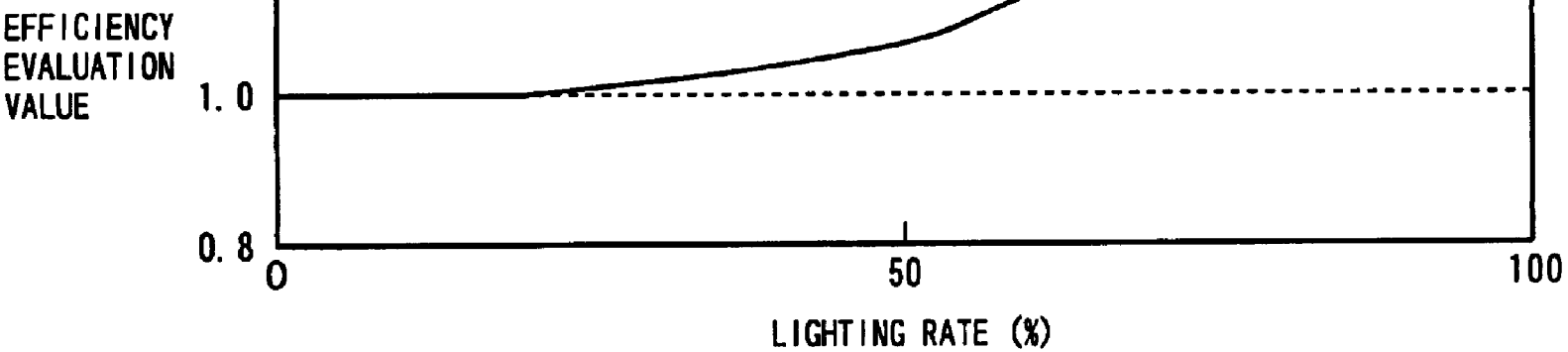
FIG. 33 is a diagram showing the relationship between an efficiency evaluation value and a lighting rate in a case where a sustain period is switched from 6 μm to 8 μm when the lighting rate reaches not less than 80%.

FIG. 33 is a diagram showing the relationship between an efficiency evaluation value and a lighting rate in a case where the sustain period is switched from 6 μs to 8 μs when the lighting rate reaches not less than 80% by the sub-field processor 3*c* on the basis of the relationship between an efficiency evaluation value and a lighting rate shown in FIG. 32.

A solid line shown in FIG. 33 indicates the relationship between an efficiency evaluation value and a lighting rate in a case where power consumption is reduced to its minimum in control of the delay time corresponding to the lighting rate described using FIG. 18, that is, the relationship between an efficiency evaluation value and a lighting rate in cases where the delay time Td is set to 0 ns when the lighting rate is 0 to 25%, is set to 100 ns when the lighting rate is 25 to 45%, is set to 200 ns when the lighting rate is 45 to 60%, is set to 350 ns when the lighting rate is 60 to 85%, and is set to 200 ns when the lighting rate is 85 to 100%, and the sustain period is set to 6 μs with respect to all the lighting rates.

Then, a portion indicated by a one-dot and dash line shown in FIG. 33 indicates the relationship between an efficiency evaluation value and a lighting rate in a case where the delay time Td is changed into 350 ns when the lighting rate is 80 to 100%, and the sustain period is changed into 8 μs. That is, FIG. 33 shows a case where the sustain period is lengthened when the lighting rate is not less than a predetermined value, for example, 80%. In this case, the efficiency evaluation value is further increased when the lighting rate is in the range of 80 to 100%, and power consumption can be further reduced.

Figure 34:
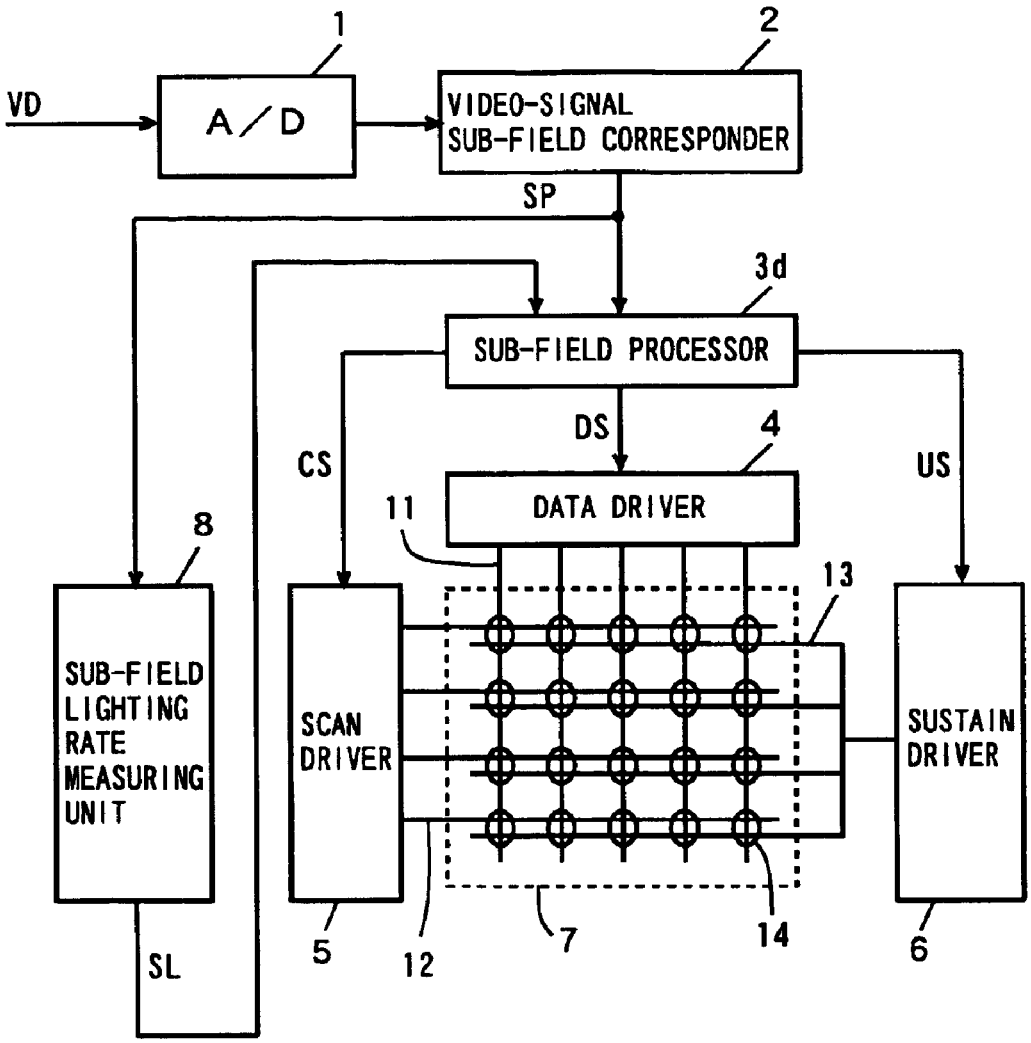
FIG. 34 is a block diagram showing the configuration of a plasma display device according to a seventh embodiment of the present invention.

Description is now made of a plasma display device according to a seventh embodiment of the present invention. FIG. 34 is a block diagram showing the configuration of the plasma display device according to the seventh embodiment of the present invention.

The plasma display device shown in FIG. 34 is the same as the plasma display device shown in FIG. 29 except that the sub-field processor 3C is changed into a sub-field processor 3*d*. Accordingly, the same portions are assigned the same reference numerals and hence, only different portions will be described in detail below.

The sub-field processor 3*d* shown in FIG. 34 generates a scan driver driving control signal CS and a sustain driver driving control signal US for increasing or decreasing the number of sustain pulses such that in a case where a sustain period is switched, luminance is equal before and after the switching, and respectively outputs the signals to a scan driver 6 and a sustain driver 6 in addition to the normal operation of the sub-field processor 3*c* shown in FIG. 29.

Figure 35:
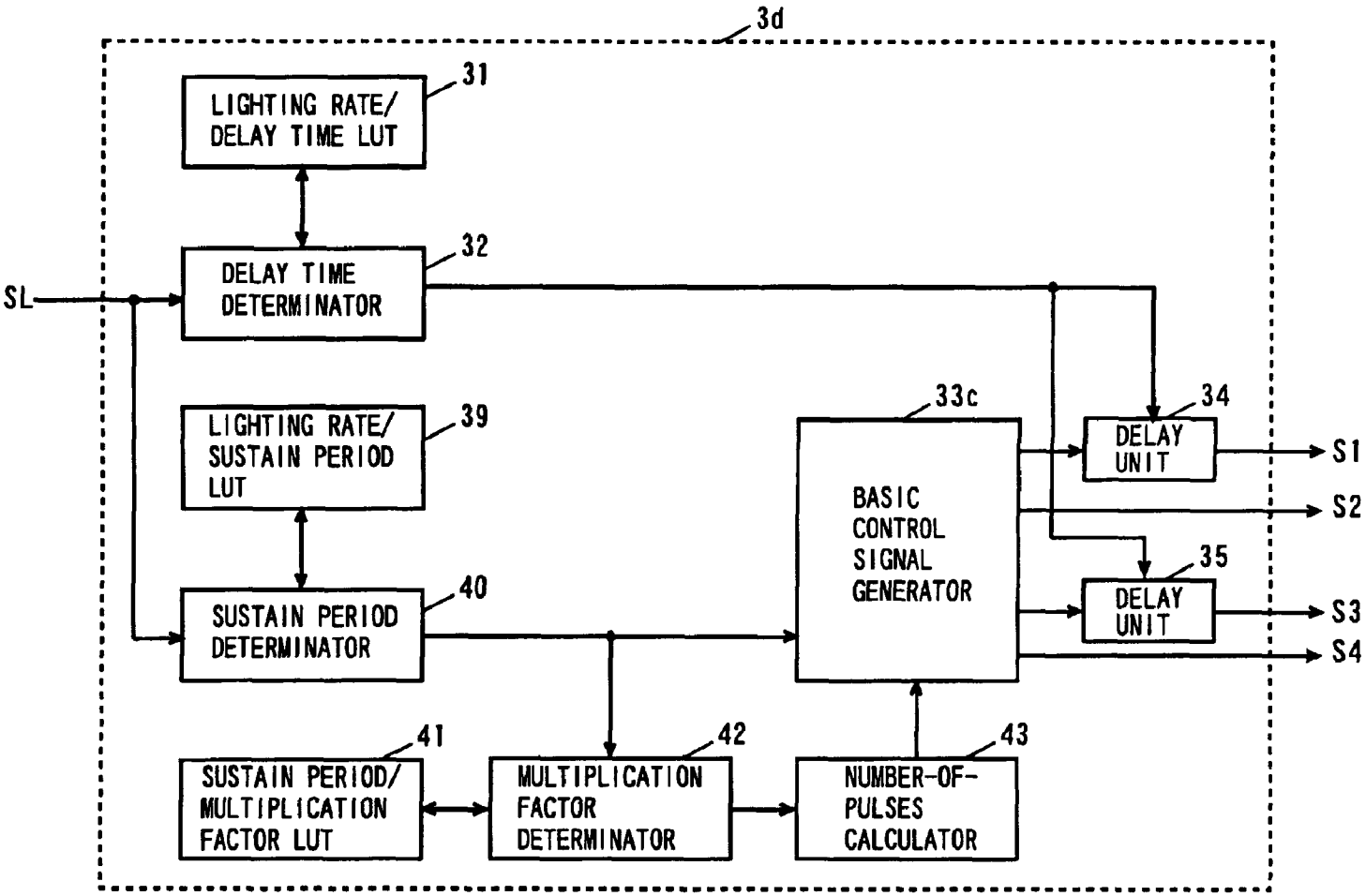
FIG. 35 is a block diagram showing the configuration of a sub-field processor shown in FIG. 34.

FIG. 35 is a block diagram showing the configuration of the sub-field processor 3*d* shown in FIG. 34. The sub-field processor 3*d* shown in FIG. 35 is the same as the sub-field processor 3*c* shown in FIG. 30 except that a sustain period/multiplication factor LUT 41, a multiplication factor determinator 42, and a number-of-pulses calculator 43 are added, and the basic control signal generator 33*b* is changed into a basic control signal generator 33*c*. Accordingly, the same portions are assigned the same reference numerals and hence, the detailed description thereof is omitted.

The sustain period/multiplication factor LUT 41 shown in FIG. 35 is connected to the multiplication factor determinator 42, and stores in a table format the relationship between a sustain period and a multiplication factor based on experimental data. For example, one is stored as the multiplication factor with respect to the sustain period of 6 μs, $1/1.006$ is stored as the multiplication factor with respect to the sustain period of 7 μs, $1/1.012$ is stored as the multiplication factor with respect to the sustain period of 8 μs.

The multiplication factor determinator 42 is connected to a sustain period determinator 40 and the number-of-pulses calculator 43, and reads out the corresponding multiplication factor from the sustain period/multiplication factor LUT 41 depending on the sustain period determined by the sustain period determinator 40 and outputs the read multiplication factor to the number-of-pulses calculator 43. The determination of the multiplication factor is not particularly limited to the example in which the relationship between a sustain period and a multiplication factor based on experimental data is stored in a table format, as described above. The multiplication factor corresponding to the sustain period may be found from an approximate expression representing the relationship between a sustain period and a multiplication factor.

The number-of-pulses calculator 43 is connected to the basic control signal generator 33*c*, and outputs to the basic control signal generator 33*c* the number of sustain pulses adjusted by multiplying the number of sustain pulses to be a reference number by the multiplication factor determined by the multiplication factor determinator 42.

The basic control signal generator 33*c* outputs control signals S1 to S4 as the sustain driver driving control signal US such that the sustain driver 6 outputs the sustain pulses in the adjusted number.

By the above-mentioned configuration, the sub-field processor 3*d* controls a delay time Td and a sustain period depending on a lighting rate measured by a sub-field lighting rate measuring unit 8, and controls the number of sustain pulses outputted from the sustain driver 6.

The scan driver 5 is also controlled by the sub-field processor 3*d* in the same manner as described above, so that the waveform, the period, and the number of sustain pulses applied to scan electrodes 12 are similarly controlled depending on the lighting rate for each sub-field.

The present embodiment is the same as the second embodiment except that the sub-field processor 3*d* corresponds to a control circuit.

In a case where the PDP having the characteristics shown in FIG. 17 is used, the luminance is increased by 0.6% when the sustain period is lengthened by 1 μs, for example. In order to correct such a change in the luminance, the sub-field processor 3*d* switches the sustain period and at the same time, corrects the number of sustain pulses after the switching. For example, when the sustain period is switched from 6 μs to 8 μs, the number of sustain pulses after the switching is changed into 99 (≈100−100×0.012) when the number of sustain pulses is 100, while being changed into 148 (≈150 −150×0.012) when the number of sustain pulses is 150.

By thus correcting the number of pulses, the luminance is equal before and after switching the sustain period, thereby making it possible to switch the delay time Td and the sustain period without giving a visually uncomfortable feeling. Although description was made of a case where the sustain period is switched once, the same effect can be. obtained, when the sustain period is switched a plurality of number of times, by carrying out the same control as described above at the time of each switching.

When the luminance differs before and after the switching, as described above, the period may be gradually switched without being greatly changed at a time and changed such that the luminance is almost continued.

For example, such control that the sustain period is extended only by 0.1 μs every time the lighting rate is increased by 1% utilizing the continuity of a video signal instead of switching the sustain period from 6 μs to 8 μs at a lighting rate of 80% may be carried out. In this case, the change in the luminance before and after switching the period is very small, for example, 0.06 (=1.2/20) %, thereby making it possible to switch the delay time Td and the sustain period depending on the lighting rate without giving a visually uncomfortable feeling.

Description is now made of a plasma display device according to an eighth embodiment of the present invention.

Figure 36:
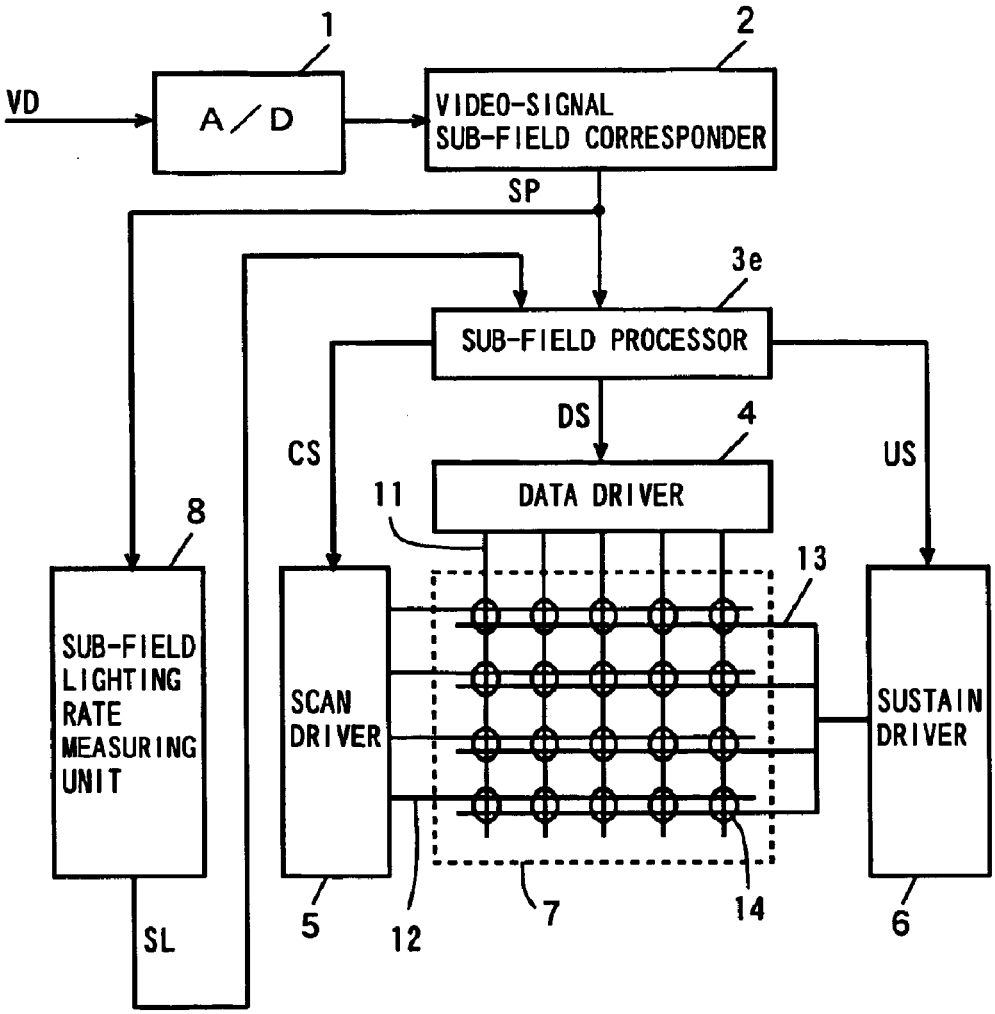
FIG. 36 is a block diagram showing the configuration of a plasma display device according to an eighth embodiment of the present invention.

FIG. 36 is a block diagram showing the configuration of the plasma display device according to the eighth embodiment of the present invention.

The plasma display device shown in FIG. 36 is the same as the plasma display device shown in FIG. 29 except that the sub-field processor 3*c* is changed into a sub-field processor 3*e*. Accordingly, the same portions are assigned the same reference numerals and hence, only different portions will be described in detail below.

The sub-field processor 3*e* shown in FIG. 36 generates a scan driver driving control signal CS and a sustain driver driving control signal US for changing the ratio of two types of sustain pulses which differ in a delay time Td and a sustain period in the same sub-field depending on a lighting rate for each sub-field such that luminance is equal, when the delay time Td and the sustain period are switched, before and after the switching, and respectively outputs the signals to a scan driver 6 and a sustain driver 6 in addition to the normal operation of the sub-field processor 3*c* shown in FIG. 29.

Figure 37:
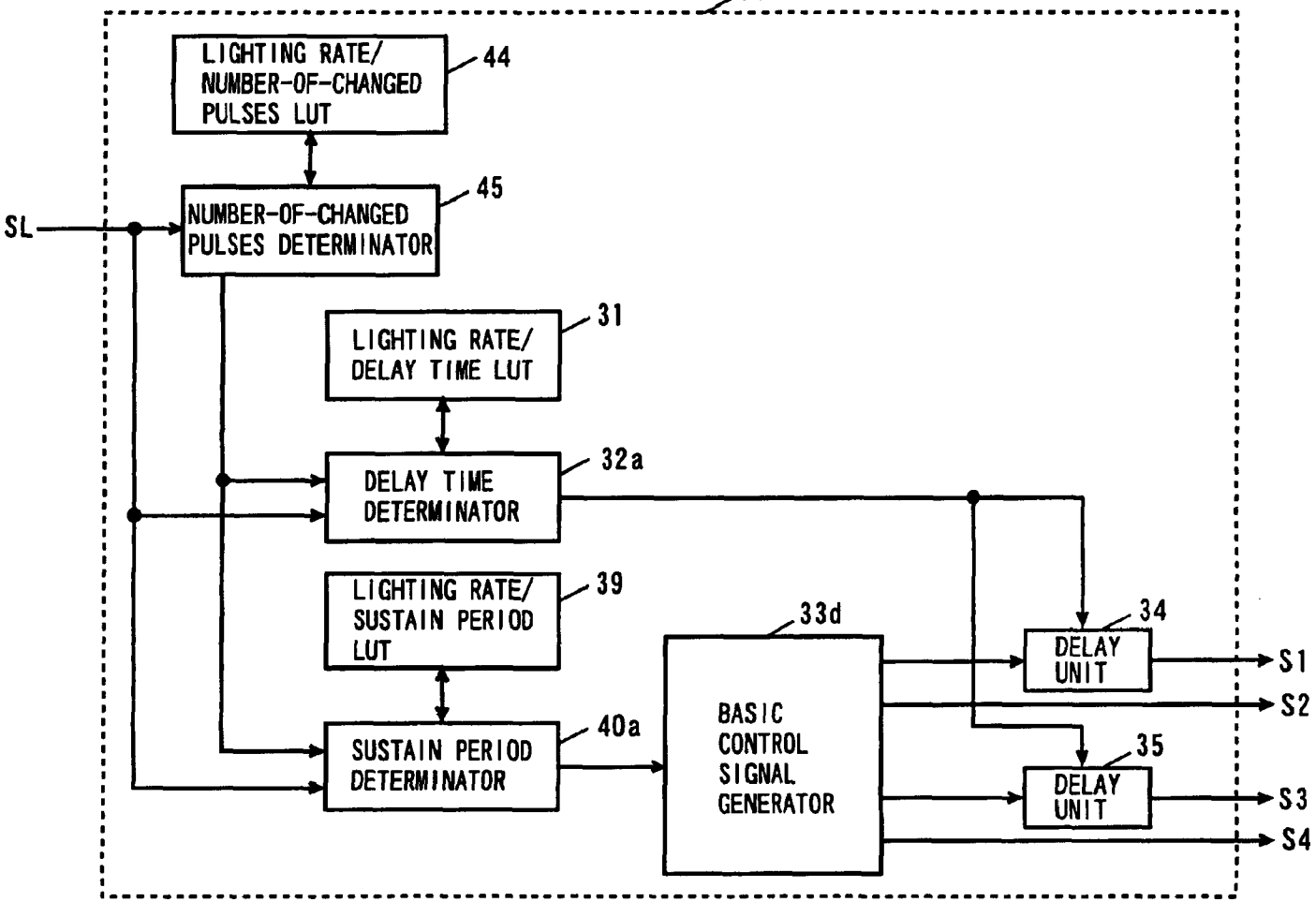
FIG. 37 is a block diagram showing the configuration of a sub-field processor shown in FIG. 36.

FIG. 37 is a block diagram showing the configuration of the sub-field processor 3*e* shown in FIG. 36. The sub-field processor 3*c* shown in FIG. 37 is the same as the sub-field processor 3*c* shown in FIG. 30 except that a lighting rate/number-of-changed pulses LUT 44 and a number-of-changed pulses determinator 45 are added, and the delay time determinator 32, the sustain period determinator 40, and the basic control signal generator 33*b* are respectively changed into a delay time determinator 32*a*, a sustain period determinator 40*a*, and a basic control signal generator 33*d*. Accordingly, the same portions are assigned the same reference numerals and hence, the detailed description thereof is omitted.

The lighting rate/number-of-changed pulses LUT 44 shown in FIG. 37 is connected to the number-of-changed pulses determinator 45, and stores in a table format the relationship between a lighting rate and the number of changed pulses based on experimental data. For example, a value which is 0 when the lighting rate is 35%, is 1 when the lighting rate is 45%, and increases in proportion to the increase in the lighting rate, i.e., 0 to 1 is stored as the number of changed pulses with respect to the lighting rate of 35 to 45%. Similarly, 0 to 1 is stored as the number of changed pulses with respect to the lighting rate of 55 to 65%, 0 to 1 is stored as the number of changed pulses with respect to the lighting rate of 80 to 90%, and 0 is stored as the number of changed pulses with respect to the other lighting rates.

In a case where in the same sub-field, discharge cells are first discharged in a first discharged state by applying first sustain pulses, and are then discharged in a second discharged state different from the first discharged state by applying second sustain pulses different from the first sustain pulses, the number of changed pulses is the ratio of the number of times of application of the second sustain pulses to the number of times of application of all the sustain pulses in the same sub-field. When the number of changed pulses is zero, therefore, only the first sustain pulses are applied in the same sub-field. The number of application of the second sustain pulses increases as the number of changed pulses increase. When the number of changed pulses is one, only the second sustain pulses are applied in the same sub-field.

The number-of-changed pulses determinator 45 is connected to the delay time determinator 32*a* and the sustain period determinator 40*a*, and reads out the corresponding number of changed pulses from the lighting rate/number-of-changed pulses LUT 44 in response to a sub-field lighting rate signal SL outputted from a sub-field lighting rate measuring unit 8 and outputs the read number of changed pulses to the delay time determinator 32*a* and the sustain period determinator 40*a*. The determination of the number of changed pulses is not particularly limited to the example in which the relationship between a lighting rate and the number of changed pulses based on experimental data is stored in a table format, as described above. For example, the number of changed pulses corresponding to the lighting rate may be found from an approximate expression representing the relationship between a lighting rate and the number of changed pulses.

In the present embodiment, a lighting rate/delay time LUT 31 stores values, for example, 0 ns as a first delay time Td1 with respect to the lighting rate of 0 to 35%, 0 ns as a first delay time Td1 and 200 ns as a second delay time Td2 with respect to the lighting rate of 35 to 45%, 200 ns as a first delay time Td1 with respect to the lighting rate of 45 to 55%, 200 ns as a first delay time Td1 and 350 ns as a second delay time Td2 with respect to the lighting rate of 55 to 65%, 350 ns as a first delay time Td with respect to the lighting rate of 65 to 80%, 350 ns as a first delay time Td1 and 200 ns as a second delay time Td2 with respect to the lighting rate of 80 to 90%, and 200 ns as a first delay time Td1 with respect to the lighting rate of 90 to 100%.

The first delay time Td1 is a delay time Td of the first sustain pulses in a case where in the same sub-field, discharge cells are first discharged in a first discharged state by applying the first sustain pulses, and are then discharged in a second discharged state different from the first discharged state by applying second sustain pulses different from the first sustain pulses. The second delay time Td2 is a delay time Td of the second sustain pulses in this case.

The reason why the second delay time Td2 is not stored with respect to the lighting rates of 0 to 35%, 45 to 55%, 65 to 80%, and 90 to 100% is that at the lighting rates, only the first sustain pulses are applied, and the second sustain pulses are not applied in the same sub-field, so that the second delay time Td2 is not required in the present embodiment.

The delay time determinator 32*a* is connected to delay units 34 and 35, and reads out the corresponding first and second delay times Td1 and Td2 from the lighting rate/delay time LUT 31 in response to the sub-field lighting rate signal SL outputted from the sub-field lighting rate measuring unit 8 and outputs one of the first and second delay times Td1 and Td2 as a delay time Td to the delay units 34 and 35 such that the first and second sustain pulses are applied in the same sub-field depending on the number of changed pulses outputted from the number-of-changed pulses determinator 45, and controls the delay units 34 and 35 so as to perform a delay operation only for the delay time Td.

Specifically, the delay time determinator 32*a* outputs the first delay time Td1 such that all the sustain pulses in the sustain time period become the first sustain pulses and outputs the second delay time Td2 such that the number of times of application of the second sustain pulses increases as the number of changed pulses increases when the number of changed pulses is zero in the sustain time period in the same sub-field, for example, outputs the first delay time Td1 such that first 80% of the sustain pulses in the sustain time period are the first sustain pulses and then outputs the second delay time Td2 such that the remaining 20% of the sustain pulses are the second sustain pulses when the number of changed pulses is 0.2, and finally outputs the second delay time Td2 such that all the sustain pulses in the sustain time period become the second sustain pulses when the number of changed pulses is one. Consequently, in the sustain time period in the same sub-field, two types of first and second sustain pulses which differ in the delay time can be applied at a ratio corresponding to the number of changed pulses.

In the present embodiment, a lighting rate/sustain period LUT 39 stores values, for example, 6 μs as a first sustain period with respect to the lighting rate of 0 to 35%, 6 μs as a first sustain period and 7 μs as a sustain period with respect to the lighting rate of 35 to 45%, 7 μs as a first sustain period with respect to the lighting rate of 45 to 55%, 7 μs as a first sustain period and 8 μs as a second sustain period with respect to the lighting rate of 55 to 65%, 8 μs as a first sustain period with respect to the lighting rate of 65 to 80%, 8 μs as a first sustain period and 7 μs as a second sustain period with respect to the lighting rate of 80 to 90%, and 7 μs as a first sustain period with respect to the lighting rate of 90 to 100%.

The first sustain period is the sustain period of the first sustain pulses in a case where in the same sub-field, the discharge cells are first discharged in a first discharged state by applying the first sustain pulses, and are then discharged in a second discharged state different from the first discharged state by applying the second sustain pulses different from the first sustain pulses. The second sustain period is the sustain period of the second sustain pulses in this case.

The reason why the second sustain period is not stored with respect to the lighting rates of 0 to 35%, 45 to 55%, 65 to 80%, and 90 to 100% is that in the cases of the lighting rates, only the first sustain pulses are applied and the second sustain pulses are not applied in the same sub-field, so that the second sustain periods are not required in the present embodiment.

The sustain period determinator 40*a* is connected to the basic control signal generator 33*d*, and reads out the corresponding first and second sustain periods from the lighting rate/sustain period LUT 39 in response to the sub-field lighting rate signal SL outputted from the sub-field lighting rate measuring unit 8 and outputs one of the first and second sustain periods to the basic control signal generator 33*d* such that the first and second sustain pulses are applied in the same sub-field depending on the number of changed pulses outputted from the number-of-changed pulses determinator 45.

Specifically, the sustain period determinator 40*a* outputs the first sustain period such that all the sustain pulses in the sustain time period become the first sustain pulses and outputs the second sustain period such that the number of times of application of the second sustain pulses increases as the number of changed pulses increases when the number of changed pulses is zero in the sustain time period in the same sub-field, for example, outputs the first sustain period such that first 80% of the sustain pulses in the sustain time period are the first sustain pulses and then outputs the second sustain period such that the remaining 20% of the sustain pulses are the second sustain pulses when the number of changed pulses is 0.2, and finally outputs the second sustain period such that all the sustain pulses in the sustain time period become the second sustain pulses when the number of changed pulses is one. Consequently, in the sustain time period in the same sub-field, two types of first and second sustain pulses which differ in the sustain period can be applied at a ratio corresponding to the number of changed pulses.

The basic control signal generator 33*d* outputs control signals S1 to S4 as the sustain driver driving control signal US such that the sustain driver 6 outputs the sustain pulses in the sustain period determined by the sustain period determinator 40*a*.

By the above-mentioned configuration, the sub-field processor 3*e* controls the delay time and the sustain period of the sustain pulses depending on the lighting rate measured by the sub-field lighting rate measuring unit 8, and controls the ratio of the number of times of application of the second sustain pulses to the number of times of application of the first sustain pulses in the same sub-field depending on the number of changed pulses. Since the number of sustain pulses in the sustain time period in each sub-field is determined to be a predetermined number, the numbers of times of application of the first and second sustain pulses cannot, in some cases, be necessarily set at a ratio corresponding to the number of changed pulses. In this case, however, the settable number of times of application closest to the ratio corresponding to the number of changed pulses is set.

The scan driver 5 is also controlled by the sub-field processor 3*e* in the same manner as described above. Similarly, the delay time and the sustain period of the sustain pulses applied to the scan electrode 12 are controlled depending on the lighting rate for each sub-field, and ratio of the number of times of application of the second sustain pulses to the number of times of application of the first sustain pulses in the same sub-field is controlled depending on the number of changed pulses.

The present embodiment is the same as the second embodiment except that the sub-field processor 3*e* corresponds to a control circuit.

In a case where the PDP having the characteristics shown in FIG. 17 is used, the luminance becomes discontinuous by switching the delay time and the sustain period, as described in the fourth and sixth embodiments. Accordingly, a viewer may, in some cases, feel the change in the luminance as a flicker. The reason for this is that the delay time and the sustain period of all the sustain pulses in the sub-field are simultaneously changed.

In the present embodiment, two types of first and second sustain pulses which differ in the delay time and the sustain period are changed in the same sub-field depending on the lighting rate for each sub-field in the following manner by the above-mentioned configuration, thereby restraining a large change in the luminance so that the viewer does not feel the flicker.

First, when the lighting rate is 0 to 35%, first sustain pulses having a delay time of 0 ns and having a sustain period of 6 μs are applied in each sub-field. That is, only one type of sustain pulses for inducing discharges once are applied in the sustain time period in the same sub-field.

On the other hand, when the lighting rate is 45 to 55%, first sustain pulses having a delay time of 200 ns and having a sustain period of 7 μs are applied in each sub-field. That is, only one type of sustain pulses for inducing first and second discharges are applied in the sustain time period in the same sub-field.

When the lighting rate is 35 to 45%, first sustain pulses having a delay time of 0 ns and having a sustain, period of 6 μs (sustain pulses in a case where the lighting rate is 0 to 35%) and second sustain pulses having a delay time of 200 ns and having a sustain period of 7 μs (sustain pulses in a case where the lighting rate is 45 to 55%) are applied at a ratio corresponding to the lighting rates in each sub-field. That is, the first sustain pulses for inducing discharges induced once and the second sustain pulses for inducing the first and second discharges in the sustain time period in the same sub-field are applied at a ratio corresponding to the lighting rates.

Specifically, when the lighting rate is 35%, the sustain pulses are applied such that the ratio of the first sustain pulses to the second sustain pulses is 100:0. When the lighting rate is increased, the number of times of application of the first sustain pulses is decreased and the number of times of application of the second sustain pulses is increased in the sustain time period in the same sub-field with the increase in the lighting rate. When the lighting rate is 37%, for example, the respective numbers of times of application of the first and second sustain pulses are controlled such that first 80% of the sustain time period are the first sustain pulses and the remaining 20% thereof are the second sustain pulses. Finally, when the lighting rate is 45%, the sustain pulses are applied such that the ratio of the first sustain pulses to the second sustain pulses is 0:100.

In switching the delay time and the sustain period, the ratio of the sustain pulses before the switching to the sustain pulses after the switching is thus gradually changed depending on the lighting rate. Accordingly, all the sustain pulses in the same sub-field are not simultaneously switched. In switching from the discharge induced once to the first and second discharges, the luminance is continuously changed, thereby making it possible to prevent a flicker from being produced.

Then, when the lighting rate is 65 to 80%, first sustain pulses having a delay time of 350 ns and having a sustain period of 8 μs are applied in each sub-field. That is, only one type of sustain pulses for inducing first and second discharges are applied in the sustain time period in the same sub-field.

When the lighting rate is 55 to 65%, first sustain pulses having a delay time of 200 ns and having a sustain period of 7 μs (sustain pulses in a case where the lighting rate is 45 to 55%) and second sustain pulses having a delay time of 350 ns and having a sustain period of 8 μs (sustain pulses in a case where the lighting rate is 65 to 80%) are applied at a ratio corresponding to the lighting rates. That is, the first sustain pulses for inducing the first and second discharges and the second sustain pulses, having a longer delay time and a longer sustain period, for inducing the first and second discharges in the sustain time period in the same sub-field are applied at a ratio corresponding to the lighting rates.

Specifically, when the lighting rate is 55%, the sustain pulses are applied such that the ratio of the first sustain pulses to the second sustain pulses is 100:0. When the lighting rate is increased, the number of times of application of the first sustain pulses is decreased and the number of times of application of the second sustain pulses is increased in the sustain time period in the same sub-field with the increase in the lighting rate. When the lighting rate is 57%, for example, the respective numbers of times of application of the first and second sustain pulses are controlled such that first 80% of the sustain time period are the first sustain pulses and the remaining 20% thereof are the second sustain pulses. Finally, when the lighting rate is 65%, the sustain pulses are applied such that the ratio of the first sustain pulses to the second sustain pulses is 0:100.

In switching the delay time and the sustain period, the ratio of the sustain pulses before the switching to the sustain pulses after the switching is thus gradually changed depending on the lighting rate in the same sub-field. Accordingly, all the sustain pulses in the same sub-field are not simultaneously switched. In switching from the first and second discharges at a short time interval to the first and second discharges at a long time interval, the luminance is continuously changed, thereby making it possible to prevent a flicker from being produced.

Finally, when the lighting rate is 90 to 100%, first sustain pulses having a delay time of 200 ns and having a sustain period of 7 μs are applied in each sub-field. That is, only one type of sustain pulses for inducing the first and second discharges are applied in the sustain time period in the same sub-field.

When the lighting rate is 80 to 90%, first sustain pulses having a delay time of 350 ns and having a sustain period of 8 μs (sustain pulses in a case where the lighting rate is 65 to 80%) and second sustain pulses having a delay time of 200 ns and having a sustain period of 7 μs (sustain pulses in a case where the lighting rate is 90 to 100%) are applied at a ratio corresponding to the lighting rates in each sub-field. That is, the first sustain pulses for inducing first and second discharges and the second sustain pulses, having a shorter delay time and a shorter sustain period than the first sustain pulses, for inducing first and second discharges are applied at a ratio corresponding to the lighting rates in the sustain time period in the same sub-field.

Specifically, when the lighting rate is 80%, the sustain pulses are applied such that the ratio of the first sustain pulses to the second sustain pulses is 100:0. When the lighting rate is increased, the number of times of application of the first sustain pulses is decreased and the number of times of application of the second sustain pulses is increased in the sustain time period in the same sub-field with the increase in the lighting rate. When the lighting rate is 82%, for example, the respective numbers of times of application of the first and second sustain pulses are controlled such that first 80% of the sustain time period are the first sustain pulses and the remaining 20% thereof are the second sustain pulses. Finally, when the lighting rate is 90%, the sustain pulses are applied such that the ratio of the first sustain pulses to the second sustain pulses is 0:100.

In switching the delay time and the sustain period, the ratio of the sustain pulses before the switching to the sustain pulses after the switching is thus gradually changed depending on the lighting rate in the same sub-field. Accordingly, all the sustain pulses in the same sub-field are not simultaneously switched. In switching from the first and second discharges at a long time interval to the first and second discharges at a short time interval, the luminance is continuously changed, thereby making it possible to prevent a flicker from being produced.

Figure 38:
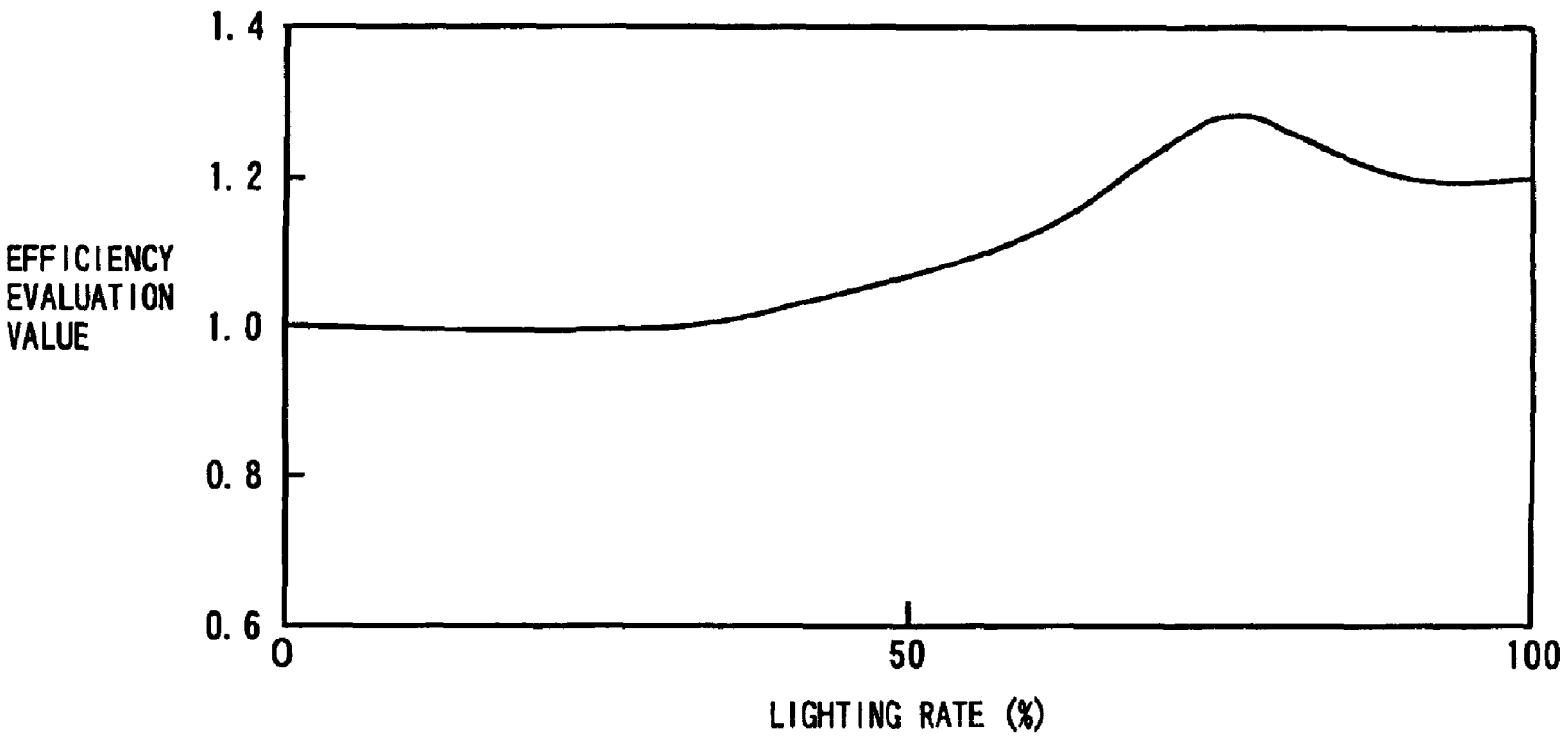
FIG. 38 is a diagram showing the relationship between an efficiency evaluation value and a lighting rate in the plasma display device shown in FIG. 36.

FIG. 38 is a diagram showing the relationship between an efficiency evaluation value and a lighting rate in the plasma display device shown in FIG. 36. In the present embodiment, the delay time and the sustain period are switched depending on the lighting rate for each sub-field in the above-mentioned manner, as shown in FIG. 38, thereby making it possible to improve luminous efficiency corresponding to applied power and to reduce power consumption.

Furthermore, in the present embodiment, before and after switching the delay time and the sustain period, the ratio of the sustain pulses before the switching to the sustain pulses after the switching is changed depending on the lighting rate in the same sub-field, thereby making it possible to gradually change the ratio of the different two types of sustain pulses to continuously change the luminance and to switch the delay time and the sustain period without giving a visually uncomfortable feeling.

Although description was made of a case where the switching of the delay time and the sustain period is performed three times, the same effect can be obtained, even when the delay time and the sustain period are switched the other number of times, by carrying out the same control as described above at the time of each switching.

The control of the number of times of application of the first and second sustain pulses may be carried out in not all sub-fields but the sub-field greatly weighted which greatly visually affects the viewer.

Although in the present embodiment, both the delay time and the sustain period are switched, the numbers of times of application of the first and second sustain pulses may be controlled when one of the delay time and the sustain period is switched.

Figure 39:
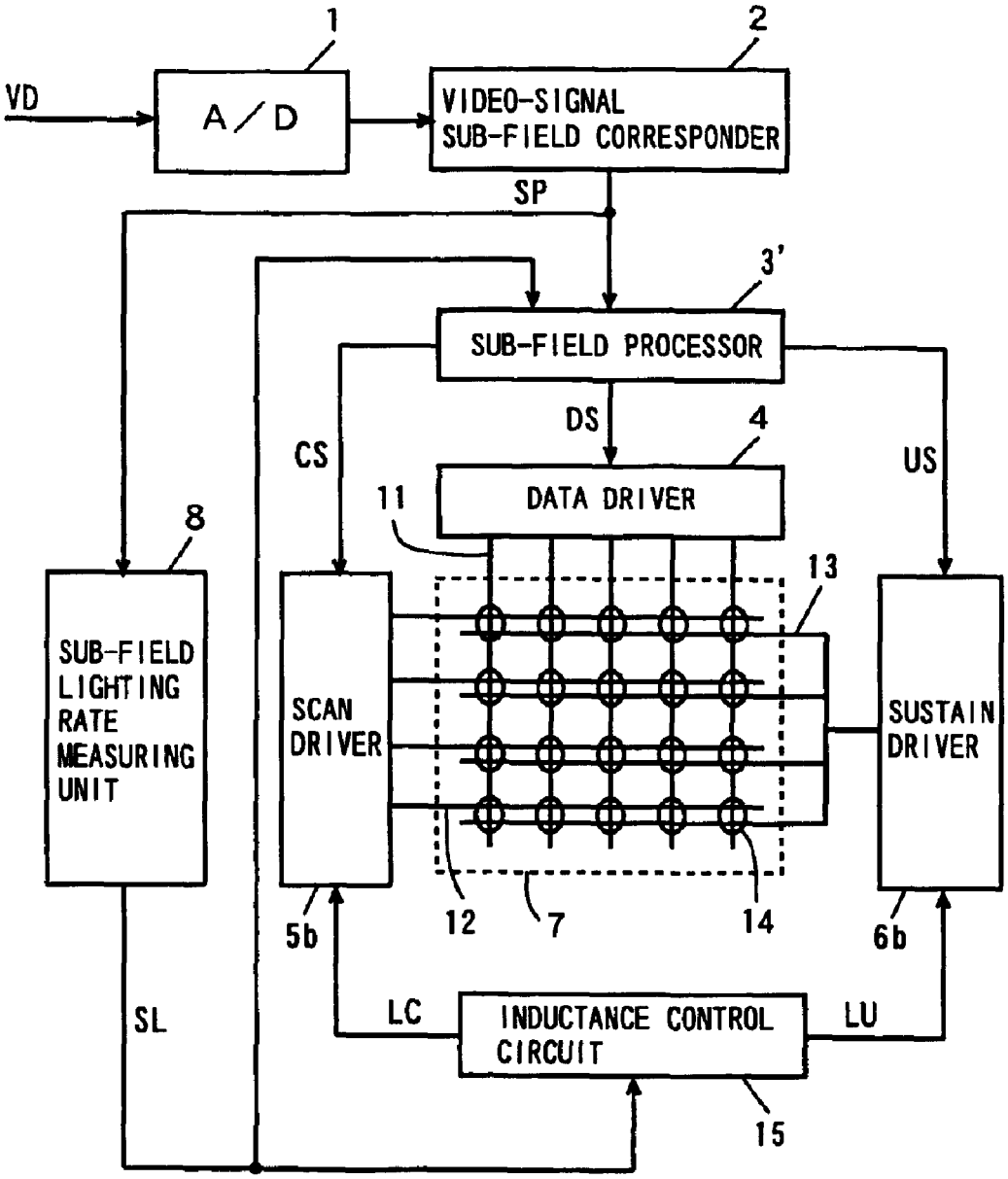
FIG. 39 is a block diagram showing the configuration of a plasma display device according to a ninth embodiment of the present invention.

Description is now made of a plasma display device according to a ninth embodiment of the present invention. FIG. 39 is a block diagram showing the configuration of the plasma display device according to the ninth embodiment of the present invention.

The plasma display device shown in FIG. 39 is the same as the plasma display device shown in FIG. 11 except that an inductance control circuit 15 for changing the inductance values of a scan driver 5*b* and a sustain driver 6*b* depending on a lighting rate for each sub-field is added. Accordingly, the same portions are assigned the same reference numerals and hence, only different portions will be described in detail below.

The inductance control circuit 15 shown in FIG. 39 receives a sub-field lighting rate signal SL outputted from a sub-field lighting rate measuring unit 8 and respectively outputs inductance control signals LC and LU for controlling inductance values which contribute to LC resonance depending on the lighting rate for each sub-field to the scan driver 5*b* and the sustain driver 6*b*.

Figure 40:
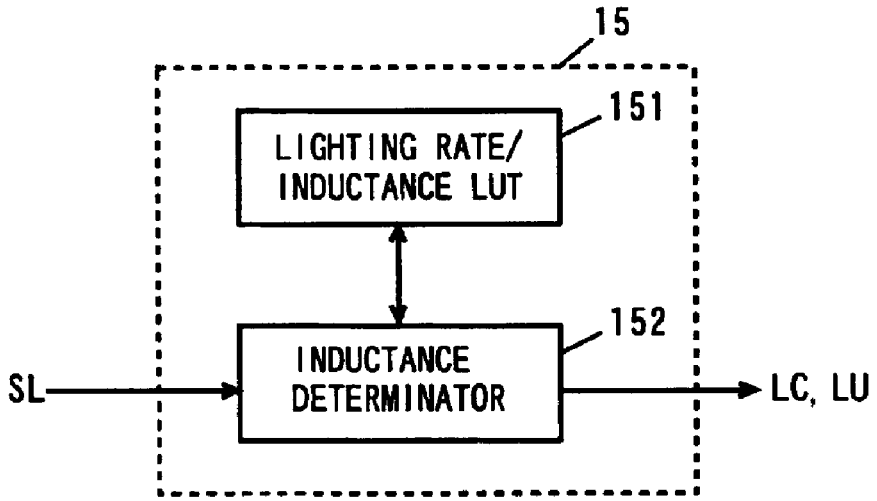
FIG. 40 is a block diagram showing the configuration of an inductance control circuit shown in FIG. 39.

FIG. 40 is a block diagram showing the configuration of the inductance control circuit 15 shown in FIG. 39. The inductance control circuit 15 shown in FIG. 40 comprises a lighting rate/inductance LUT 151 and an inductance determinator 152.

The lighting rate/inductance LUT 151 is connected to the inductance determinator 152, and stores in a table format the relationship between a lighting rate and an inductance value contributing to LC resonance based on experimental data. For example, 0.36 μH is stored as an inductance value with respect to the lighting rate of 65 to 100%, and 0.6 μH is stored as an inductance value with respect to the lighting rate of 0 to 65%.

The inductance determinator 152 reads out the corresponding inductance values from the lighting rate/inductance LUT 151 in response to the sub-field lighting rate signal SL outputted from the sub-field lighting rate measuring unit 8 and respectively outputs the read inductance values to the scan driver 5*b* and the sustain driver 6*b* as the inductance control signals LC and LU. The determination of the inductance values is not particularly limited to the example in which the relationship between a lighting rate and an inductance value based on experimental data is stored in a table format, as described above. For example, the inductance value corresponding to the lighting rate may be found from an approximate expression representing the relationship between a lighting rate and an inductance value.

By the above-mentioned configuration, the inductance control circuit 15 controls the inductance values, contributing to LC resonance, of the scan driver 5*b* and the sustain driver 6*b* depending on the lighting rate measured by the sub-field lighting rate measuring unit 8.

Figure 41:
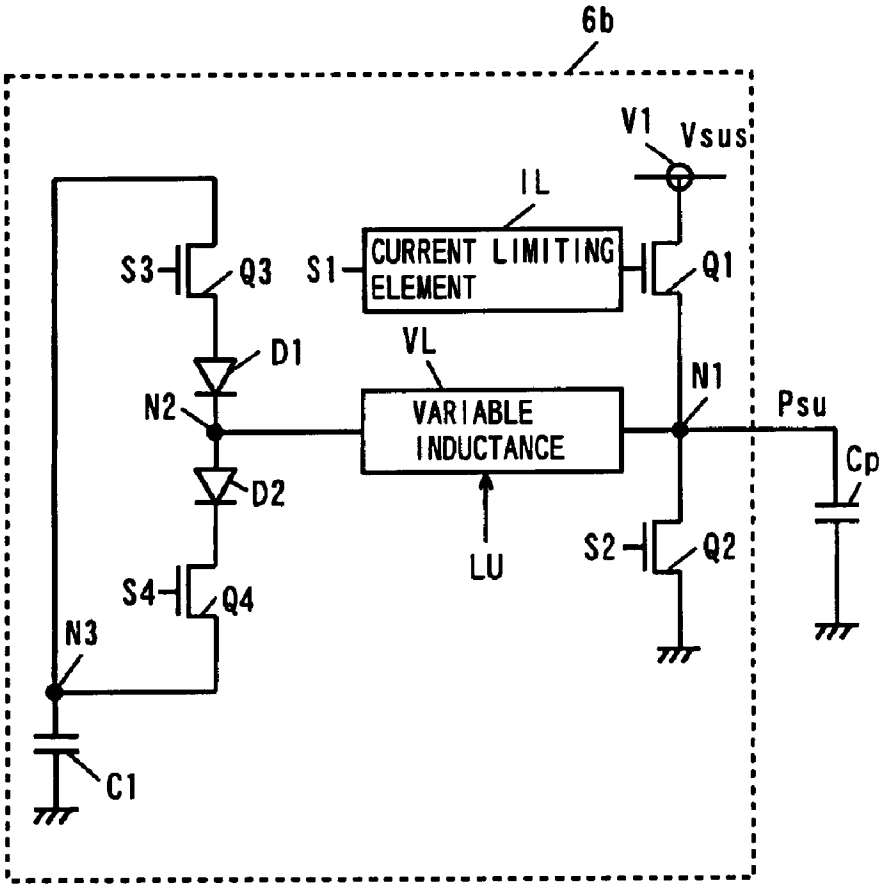
FIG. 41 is a circuit diagram showing the configuration of a sustain driver shown in FIG. 39.

The sustain driver 6*b* shown in FIG. 39 will be described in detail. FIG. 41 is a circuit diagram showing the configuration of the sustain driver 6 shown in FIG. 39. The scan driver 5*b* in the present embodiment is configured and operated similarly to the sustain driver 6*b*. Accordingly, the detailed description of the scan driver 5*b* is omitted, and only the sustain driver 6*b* will be described in detail below.

The sustain driver 6*b* shown in FIG. 41 is the same as the sustain driver 6 shown in FIG. 3 except that the recovery coil L is changed into a variable inductance VL for changing an inductance value depending on the inductance control signal LU. The same portions are assigned the same reference numerals and hence, only different points will be described in detail below.

The variable inductance VL shown in FIG. 41 is connected between a node N2 and a node N1, and changes an inductance value depending on the inductance control signal LU outputted from the inductance control circuit 15.

The present embodiment is the same as the second embodiment except that the scan driver 5*b* and the sustain driver 6*b* correspond to a driving circuit, first and second driving circuits, and a final driving circuit, the variable inductance VL, a recovery capacitor C1, a transistor Q3, and a diode D1 correspond to a first driving circuit, the inductance control circuit 15 corresponds to an inductance control circuit, and the variable inductance VL corresponds to an inductance circuit and a variable inductance circuit.

Figure 42:
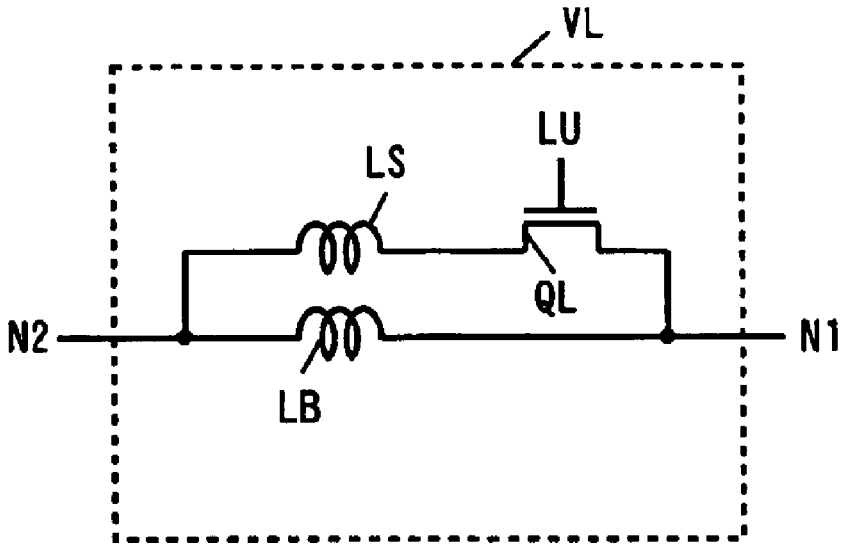
FIG. 42 is a circuit diagram showing a variable inductance shown in FIG. 41.

FIG. 42 is a circuit diagram showing the configuration of the variable inductance VL shown in FIG. 41. The variable inductance VL shown in FIG. 42 comprises recovery coils LB and LS and a transistor QL.

The recovery coil LB is connected between the node N2 and the node N1, the recovery coil LS and the transistor QL are connected in series between the node N2 and the node N1, and the recovery coil LB and the recovery coil LS are connected in parallel. An inductance control signal LU is inputted to the gate of the transistor QL.

Figure 43:
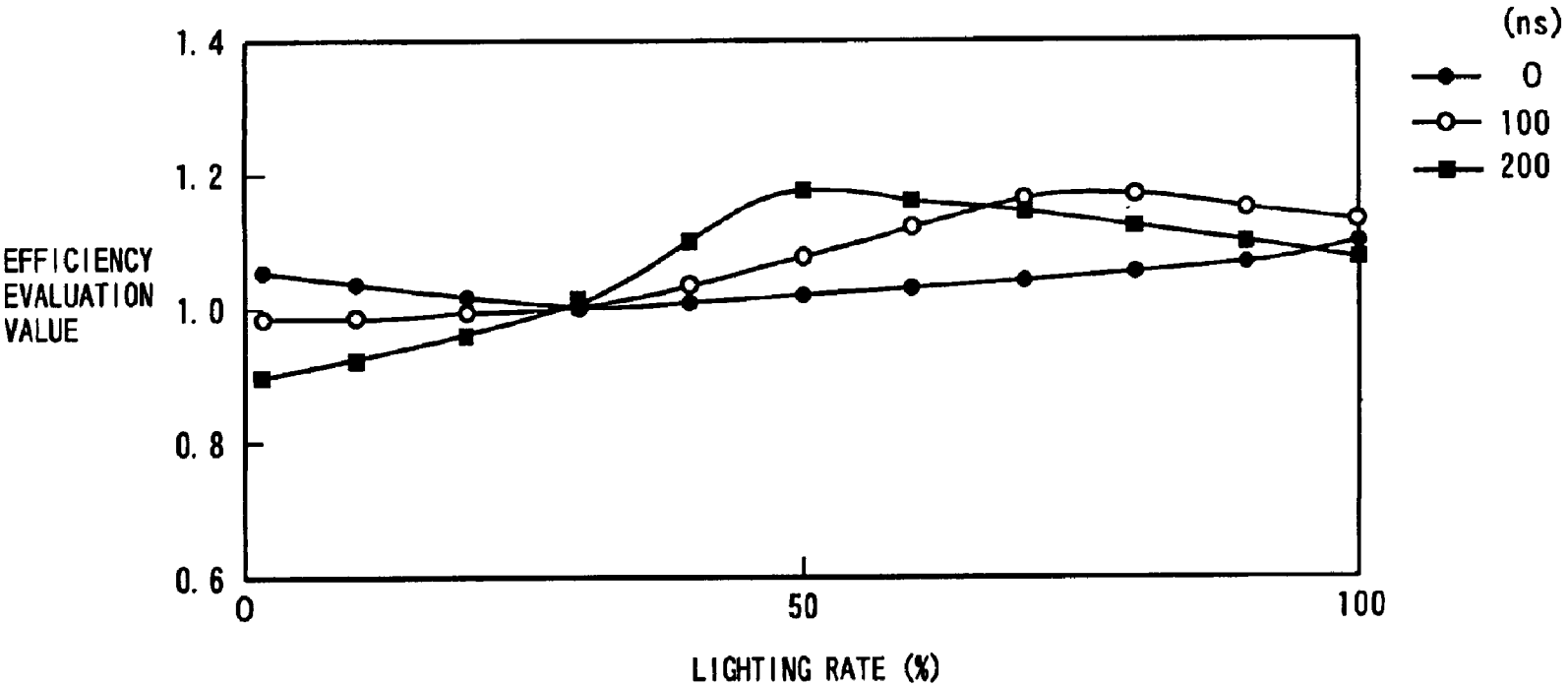
FIG. 43 is a diagram showing the relationship between a lighting rate and an efficiency evaluation value in each delay time in a case where an inductance value is 0.6 μH.

When the inductance value of the recovery coil LB is 0.6 $\mu$H, and the inductance value of the recovery coil LS is 0.9 $\mu$H, a composite inductance value of the recovery coils LB and LS is 0.36 $\mu$H. The relationship between a lighting rate and an efficient evaluation value at each delay time in a case where the inductance value is 0.6 $\mu$H is as shown in FIG. 43. The relationship between a lighting rate and an efficient evaluation value at each delay time Td in a case where the inductance value is 0.3 $\mu$H is as shown in FIGS. 17 and 32 (FIG. 32 shows the relationship in a case where the period is changed in a part of the range of the lighting rate with respect to the delay time of 350 ns in FIG. 17).

In FIG. 43, a delay time Td indicated by each sign is the same as that in FIG. 17. An efficiency evaluation value at each delay time Td in each lighting rate uses, in a case where the delay time in the corresponding lighting rate is 0 ns as shown in FIG. 17, that is, in a case where the inductance value is 0.36 $\mu$H, an efficiency evaluation value of the delay time of 0 ns in the corresponding lighting rate as a reference value, and is normalized by dividing the efficiency evaluation value at each delay time by the reference value. It is indicated that the higher the efficiency evaluation value is, the smaller power consumption becomes.

Comparison between FIG. 43 and FIG. 17 shows that power consumption is further reduced in FIG. 43 where the inductance value is large. Consequently, power consumption can be reduced by not only controlling the delay time Td but also changing the inductance value contributing to LC resonance as in each of the embodiments.

Figure 44:
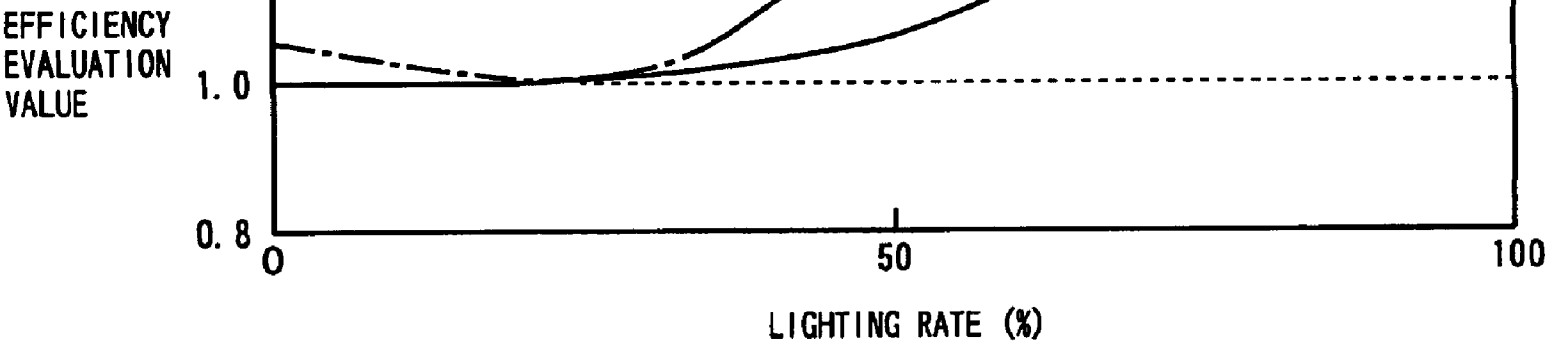
FIG. 44 is a diagram showing the relationship between an efficiency evaluation value and a lighting rate in a case where an inductance value is switched from 0.6 μH to 0.36 μH when a lighting rate reaches not less than 65%.

FIG. 44 is a diagram showing the relationship between an efficiency evaluation value and a lighting rate in a case where the inductance value is switched from 0.6 $\mu$H to 0.36 $\mu$H when the lighting rate reaches not less than 65% by the inductance control circuit 15 on the basis of the relationship between an efficiency evaluation value and a lighting rate shown in FIG. 43.

A solid line shown in FIG. 44 indicates the relationship between an efficiency evaluation value and a lighting rate in a case where power consumption is reduced to its minimum, that is, the relationship between an efficiency evaluation value and a lighting rate in cases where the delay time Td is set to 0 ns when the lighting rate is 0 to 25%, is set to 100 ns when the lighting rate is 25 to 45%, is set to 200 ns when the lighting rate is 45 to 60%, and is set to 350 ns when the lighting rate is 60 to 100%, and the sustain period is set to 6 $\mu$s when the lighting rate is 0 to 80%, and is set to 8 $\mu$s when the lighting rate is 80 to 100% in control of the sustain period depending on the lighting rate described using FIG. 33.

Then, a portion indicated by a one-dot and dash line shown in FIG. 44 indicates the relationship between a lighting rate and an efficiency evaluation value in a case where the delay time is set to 0 ns with respect to the lighting rate of 0 to 30%, and is set to 200 ns with respect to the lighting rate of 30 to 65% after the inductance value is set to 0.6 $\mu$H. As the control of the inductance value, the inductance value is set to 0.6 $\mu$H when the lighting rate is 0 to 65%, and is set to 0.36 $\mu$H when the lighting rate is 65 to 100%. That is, illustrated is a case where the inductance value is decreased when the lighting rate is not less than a predetermined value, for example, 65%. In this case, the efficiency evaluation value is further increased when the lighting rate is in the range of 0 to 65%, thereby making it possible to further reduce power consumption.

When the lighting rate is 0 to 65%, therefore, the inductance control circuit 15 outputs a low-level signal as the inductance control signal LU, so that the transistor QL is turned off, and only the inductance LB having an inductance value of 0.6 $\mu$H contributes to LC resonance. When the lighting rate is 65 to 100%, the inductance control circuit outputs a high-level signal as the inductance control signal LU, so that the transistor QL is turned off, and only the composite inductance of the recovery coils LS and LB having an inductance value of 0.36 $\mu$H contributes to LC resonance.

In the present embodiment, control is thus carried out such that not only the timing at which the sustain pulses are increased again but also the inductance value of LC resonance which raises the sustain pulses with the increase in the lighting rate is decreased. Accordingly, discharges can be induced in a state where power consumption is reduced. Although in the above-mentioned description, both the timing at which the sustain pulse rises again and the inductance value are controlled, only the inductance value may be controlled to reduce power consumption.

Figure 45:
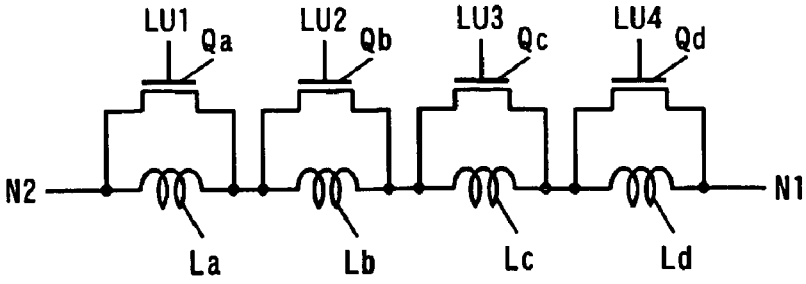
FIG. 45 is a circuit diagram showing the configuration of another example of the variable inductance shown in FIG. 41.
Figure 46:
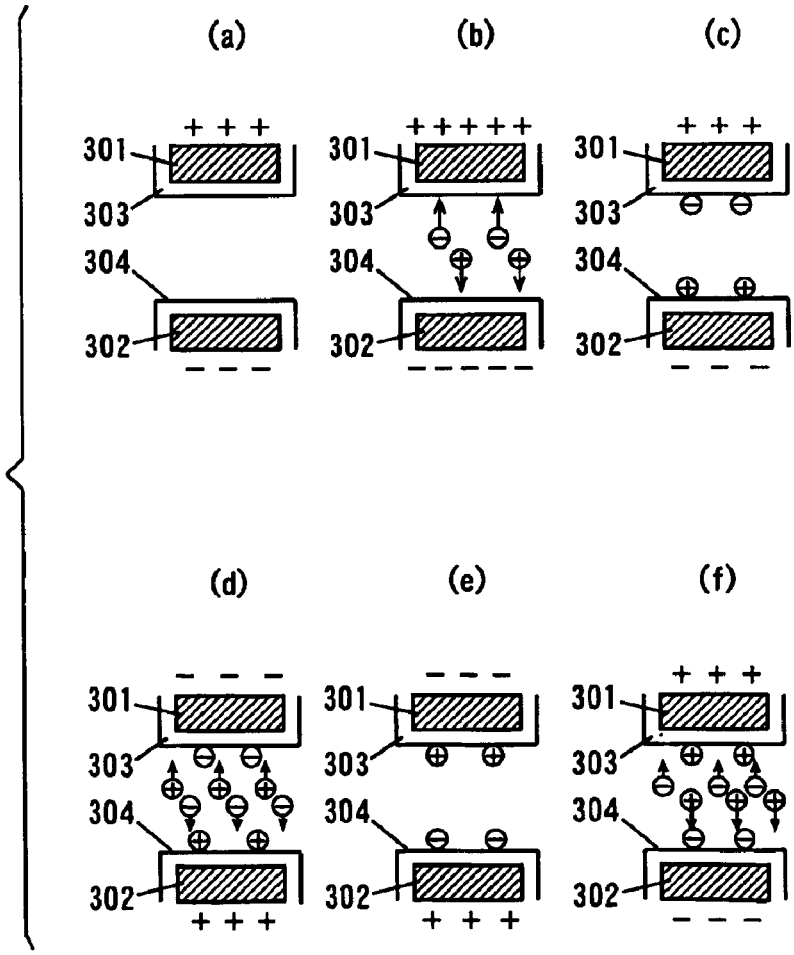
FIGS. 46(*a*)–46(*f*) are diagrams for explaining a method of driving discharge cells in a conventional plasma display device.
Figure 47:
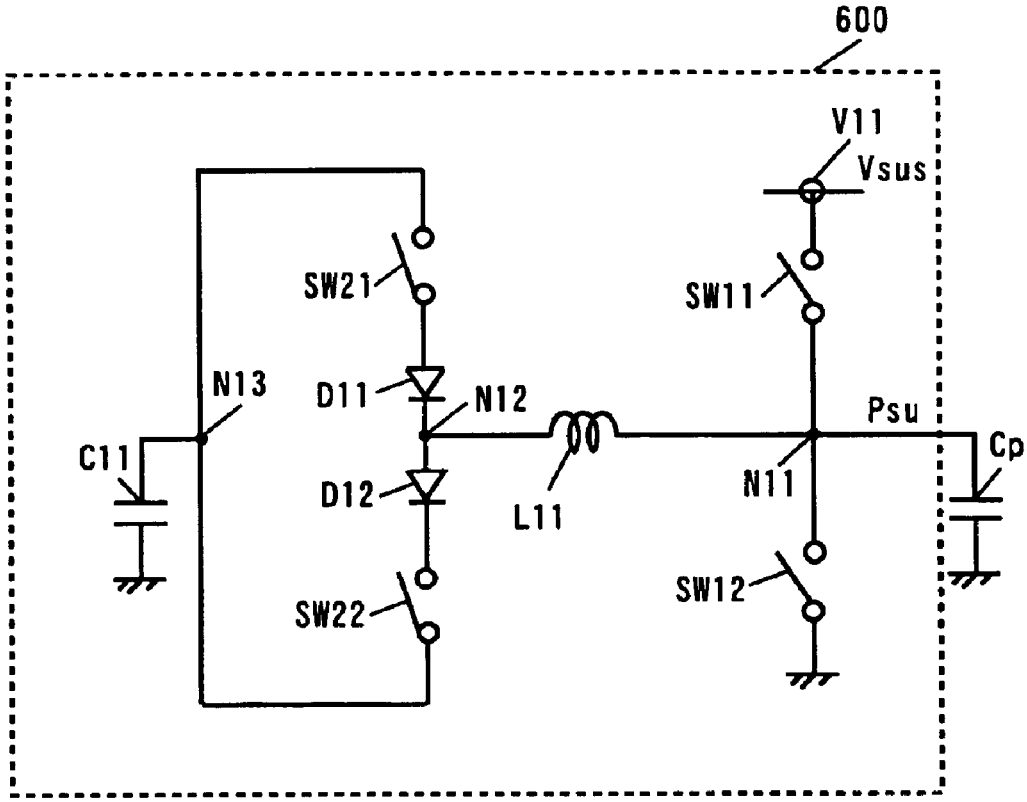
FIG. 47 is a circuit diagram showing the configuration of a sustain driver in the conventional plasma display device.
Figure 48:
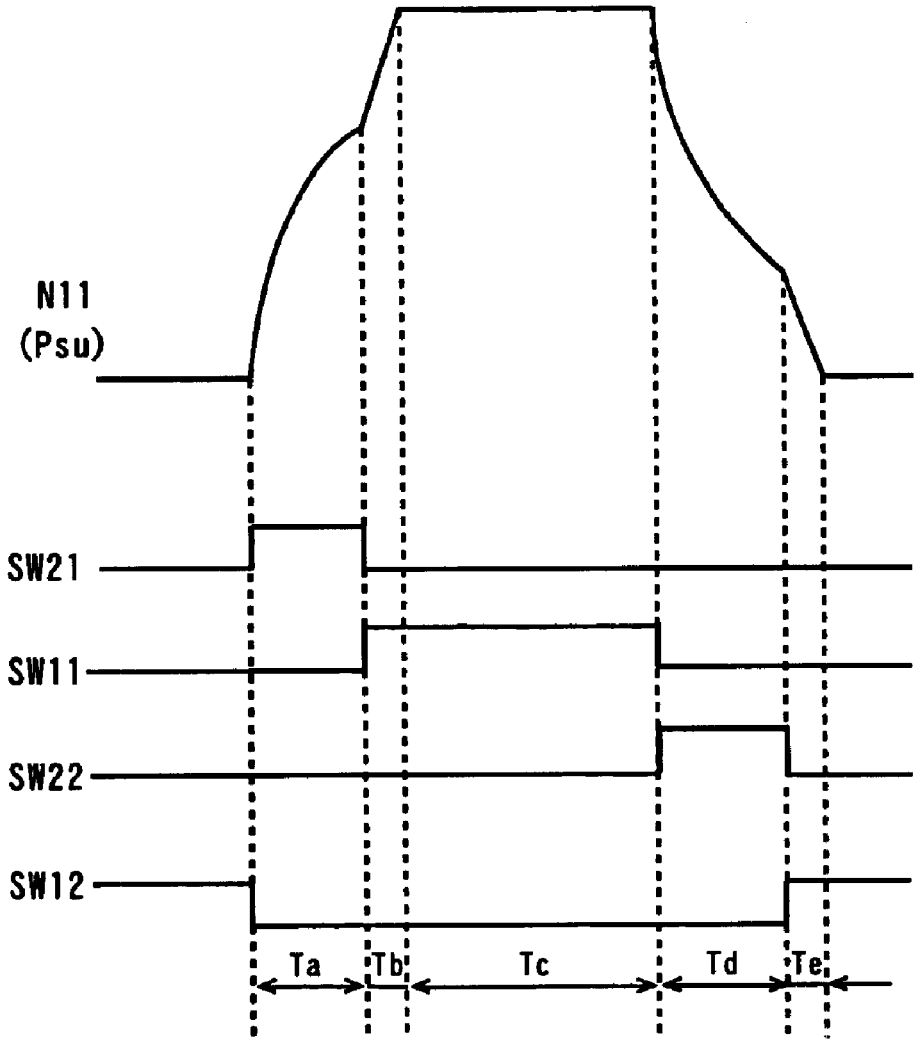
FIG. 48 is a timing chart showing the operation in a sustain period of the sustain driver shown in FIG. 47.

FIG. 45 is a circuit diagram showing the configuration of another example of the variable inductance shown in FIG. 41. The variable inductance shown in FIG. 45 comprises recovery coils La to Ld and transistors Qa to Qd.

The recovery coil La and the transistor Qa are connected in parallel. Similarly, the recovery coils Lb to Ld and the transistors Qb to Qd are respectively connected in parallel, and the recovery coil and the transistor which are connected in parallel are connected in series between a node N2 and a node N1.

Letting $L_0$ be the inductance value of the recovery coil La, the inductance value of the recovery coil Lb is set to $L_0/4$, and the inductance value of the recovery coil Ld is set to $L_0/8$. In this case, $2^4$ inductance values can be set by outputting four inductance control signals LU1 to LU4 from the inductance control circuit 15 as an inductance control signal LU and carrying out on-off control of the transistors Qa to Qd. In the case of the example, the inductance value is changed more finely depending on the lighting rate, thereby making it possible to set the most suitable state of LC resonance to further reduce power consumption.

The number of connections of the recovery coils and the transistors is not particularly limited to four, described above. It can be changed into various numbers of connections. The variable inductance is not particularly limited to that in each of the examples. It may have another configuration, provided that the inductance value can be varied depending on the inductance control signal.

Although in each of the above-mentioned embodiments, description was made of the division into sub-fields by the ADS system as an example, the division into sub-fields by an address-while-display scheme, for example, may be used, in which case the same effect can be obtained by detecting the lighting rate of discharge cells which are simultaneously turned on. Although in each of the above-mentioned embodiments, description was made of a case where power consumption is reduced by improving luminous efficiency corresponding to applied power, the luminance may be raised by improving luminous efficiency, to achieve high luminance when light is emitted with the same power consumption without lowering applied power.

What is claimed is:

1. A display device for selectively discharging a plurality of discharge cells to display an image, comprising:

a display panel that includes said plurality of discharge cells;

a first driving circuit that applies a driving pulse to a selected discharge cell in said display panel to induce a first discharge; and a second driving circuit that increases a voltage of the driving pulse, to induce a second discharge subsequently to said first discharge, after the voltage of said driving pulse is reduced by said first discharge, wherein an interval between a peak of said first discharge and a peak of said second discharge is not less than 100 ns nor more than 550 ns.

2. The display device according to claim 1, characterized in that said second driving circuit induces said second discharge while a priming effect produced by said first discharge is obtained.

3. The display device according to claim 1, characterized in that the interval between the peak of said first discharge and the peak of said second discharge is not less than 300 ns nor more than 550 ns.

4. The display device according to claim 1, characterized in that the peak intensity of said second discharge is not less than the peak intensity of said first discharge.

5. The display device according to claim 1, characterized in that said plurality of discharge cells respectively include capacitive loads, and said first driving circuit comprises an inductance circuit having at least one inductance element having its one end connected to said capacitive load, and a resonance driving circuit for outputting said driving pulse due to LC resonance by said capacitive load and said inductance element.

6. The display device according to claim 1, characterized in that said first driving circuit comprises a first capacitive element provided outside said display panel as a current supply source for said driving pulse, said first capacitive element recovering charges stored in said discharge cells.

7. The display device according to claim 1, characterized by further comprising a third driving circuit for increasing, after the voltage of the driving pulse is reduced by the second discharge, the voltage of the driving pulse, to induce third discharge subsequently to said second discharge.

8. The display device according to claim 7, characterized in that said third driving circuit repeats an operation for increasing, after the voltage of the driving pulse is reduced by the discharge, the voltage of the driving pulse, to continuously induce discharges a plurality of times subsequently to the second discharge.

9. The display device according to claim 7, characterized in that said second driving circuit comprises a second capacitive element provided outside said display panel as a current supply source for said driving pulse, and a voltage source for charging said second capacitive element to a predetermined voltage.

10. The display device according to claim 7, characterized in that said third driving circuit repeats an operation for increasing the voltage of the driving pulse after the voltage of the driving pulse is reduced by the discharge, to continuously induce discharges a plurality of times subsequently to the second discharge, and said control circuit controls said third driving circuit such that said driving pulse is changed depending on the lighting rate detected by said detection circuit.

11. The display device according to claim 1, characterized in that said driving pulse includes a driving pulse which makes a transmission from a first potential to a second potential and takes a maximal value and a minimal value at least once during a transition from the first potential to the second potential, and further comprising a final driving circuit that drives said driving pulse such that a transition speed from a predetermined extreme value to the second potential is lower than a transition from the first potential to an extreme value immediately aft that and a transition speed from a subsequent extreme value to another extreme value immediately after that.

12. The display device according to claim 11, wherein said final driving circuit comprises:

a field effect transistor having one end receiving said field potential, and a current-limiting circuit for limiting a current of a control signal inputted to the gate of said field effect transistor.

13. A display device for selectively discharging a plurality of discharge cells to display in image, comprising:

a display panel that includes said plurality of discharge cells;

a driving circuit that applies a driving pulse to a selected discharge cell in said display panel to induce a first discharge, the driving circuit increasing a voltage of the driving pulse to induce a second discharge subsequent to said first discharge;

a detection circuit that detect a lighting rate of discharge cells simultaneously turned on out of said plurality of discharge cells; and a control circuit that controls said driving circuit such that said driving pulse is changed depending on the lighting rate detected by said detection circuit.

14. The display device according to claim 13, further comprising:

a conversion circuit that converts in order to divide one field into a plurality of sub-fields and discharge a selected discharge cell for each sub-field to make a gray scale expression, image data in the one field into image data in each sub-field, said detection circuit comprising a sub-field lighting rate detection circuit that detects the lighting rate for each sub field, said control circuit controlling said driving circuit such that said driving pulse is changed depending on the lighting rate for each sub-field detected by said sub-field lighting rate detection circuit.

15. The display device according to claim 14, wherein said driving circuit applies, in the same sub-field, at least one of a first driving pulse for inducing a discharge once by applying one pulse and a second driving pulse for inducing said second discharge after inducing said first discharge, and said control circuit controls said driving circuit so as to change a ratio of a number of times of application of said first driving pulse to a number of times of application of said second driving pulse depending on the lighting rate for each sub-field detected by said sub-field lighting rate detection circuit.

16. The display device according to claim 14, wherein said driving circuit applies, in the same sub-field, at least one of a first driving pulse for inducing said first and second discharges at a first time interval and a second driving pulse for inducing said first and second discharges at a second time interval longer than the first time interval, and said control circuit controls said driving circuit so as to change a ratio of a number of times of application of said first driving pulse to the number of times of application of said second driving pulse depending on the lighting rate for each sub-field detected by said sub-field lighting rate detection circuit.

17. The display device according to claim 16, wherein a period of said second driving pulse is longer than a period of said fist driving pulse.

18. The display device according to claim 16, wherein said control circuit controls said driving circuit such that a higher the lighting rate for each sub-field detected by said sub-field lighting rate detection circuit is, a higher the ratio of the number of times of application of said second driving pulse to the number of times of application of said first driving pulse becomes.

19. The display device according to claim 16, characterized in that said control circuit controls said driving circuit so as to increase the ratio of the number of times of application of said second driving pulse to the number of times of application of the second driving pulse to the number of times of application of the first driving pulse with the increase in the lighting rate when the lighting rate is increased to not less than a predetermined value.

20. The display device according to claim 13, wherein said driving circuit comprises;

a first driving circuit that increases the voltage of said driving pulse to induce said first discharge, and a second driving circuit that increases the voltage of said driving pulse to induce said second discharge after inducing said first discharge, and said control circuit controlling said second driving circuit such that said driving pulse is changed depending on the lighting rate detected by said detection circuit.

21. The display device according to claim 20, characterized in that said second driving circuit increases, after the voltage of said driving pulse is reduced by the first discharge, the voltage of the driving pulse, to induce said second discharge subsequently to the first discharge.

22. The display device according to claim 20, wherein said control circuit changes a timing at which said second driving circuit increases the voltage of said driving pulse depending on the lighting rate detected by said detection circuit.

23. The display device according to claim 20, wherein a higher the lighting rate detected by said detecting circuit is, a later a timing at which said second driving circuit increases the voltage of said driving pulse is.

24. The display device according to claim 20, characterized in that said control circuit controls, when the lighting rate detected by said detection circuit reaches not less than a predetermined value, said second driving circuit such that said second discharge is induced subsequently to said first discharge.

25. The display device according to claim 20, wherein said control circuit controls said second driving circuit so as to delay a timing at which the voltage of the driving pulse is increased with an increase in the lighting rate detected by said detection circuit, and advance the timing at which the voltage of said driving pulse is increased to not less than the predetermined value.

26. The display device according to claim 20, wherein said control circuit controls said second driving circuit so as to switch a timing at which the second driving circuit increases the voltage of the driving pulse when the lighting rate detected by said detection circuit reaches not less than a predetermined value and change a number of pulses composing the driving pulse applied to the selected discharge cell in the display panel such that a luminance is approximately equal before and after the switching of the timing at which the voltage of the driving pulse is increased.

27. The display device according to claim 20, characterized in that said first driving circuit comprises a first capacitive element provided outside said display panel as a current supply source for said driving pulse.

28. The display device according to claim 27, characterized in that said first capacitive element recovers charges stored in said discharge cell.

29. The display device according to claim 20, wherein said driving circuit further comprises a third driving circuit that increases, after the voltage of said driving pulse is reduced by the second discharge, the voltage of said driving pulse, to induce a third discharge subsequently to said second discharge, and said control circuit controls said third driving circuit such that said driving pulse is changed depending on the lighting rate detected by said detention circuit.

30. The display device according to claim 13, wherein said control circuit controls said diving circuit such that a higher the lighting rate detected by said detecting circuit is, a longer a period of said driving pulse is.

31. The display device according to claim 13, wherein said control circuit controls said driving circuit so as to switch a period of said driving pulse when the lighting rate detected by said detection circuit reaches not less than a predetermined value and change a number of pulses composing the driving pulse applied to the selected discharge cell in said display panel such that a luminance is approximately equal before and after the switching of the period of said driving pulse.

32. A display device for selectively discharging a plurality of discharge cells to display in image, comprising:

a display panel that includes said plurality of discharge cells;

a first driving circuit that applies a driving pulse to a selected discharge cell in said display panel to induce a first discharge;

a second driving circuit that increases a voltage of said driving pulse to induce a second discharge subsequent to said first discharge;

a detection circuit that detects a lighting rate of discharge cells simultaneously turned on out of said plurality of discharge cells; and a control circuit that controls said first and second driving circuits such that said driving pulse is changed depending on the lighting rate detected by said detection circuit, wherein said plurality of discharge cells respectively include capacitive loads, and said first driving circuit comprises:

an inductance circuit having at least one inductance element having a first end connected to said capacitive load, and a resonance driving circuit that outputs said driving pulse due to LC resonance by said capacitive load and said inductance element.

33. The display device according to claim 32, wherein said inductance circuit includes a variable inductance circuit capable of changing an inductance value, and further comprising an inductance control circuit that changes the inductance value of said variable inductance circuit depending on the lighting rate detected by said detection circuit.

34. A display device for selectively discharging a plurality of discharge cells to display in image, comprising:

a display panel that includes said plurality of discharge cells;

a driving circuit that applies a driving pulse to a selected discharge cell in said display panel to induce a second discharge after inducing a first discharge;

a detection circuit that detects a lighting rate of discharge cells simultaneously turned on out of said plurality of discharge cells; and a control circuit that controls said driving circuit such that said driving pulse is changed depending on the lighting rate detected by said detection circuit, wherein said driving circuit comprises:

a first driving circuit that induces said first discharge; and a second driving circuit that increases the voltage of said driving pulse to induce said second discharge subsequent to said first discharge, said second driving circuit comprising:

a second capacitive element provided outside said display panel as a current supply source for said driving pulse, and a voltage source that charges said second capacitive element to a predetermined voltage.

35. The display device according to claim 34, wherein said voltage source includes a variable voltage source that changes its output voltage, and further comprising a voltage control circuit that controls the output voltage of said variable voltage source such that a higher the lighting rate detected by said detection circuit is, a lower a charging voltage for said second capacitive element becomes.

36. The display device according to claim 34, wherein said voltage source includes a variable voltage source that changes its output voltage, and further comprising a potential detection circuit that detects a potential of said driving pulse changed by said first discharge, and a voltage control circuit that controls an output voltage of said variable voltage source such that a larger an amount of change in the potential detected by said potential detection circuit is, a lower a charging voltage for said second capacitive element becomes.

37. A method of selectively discharging a plurality of discharge cells to display an image, comprising:

applying a driving pulse to a selected discharge cell to induce a first discharge; and increasing, after a voltage of the driving pulse is reduced by the first discharge, the voltage of the driving pulse, to induce a second discharge subsequently to the first discharge, wherein an interval between a peak of the first discharge and a peak of the second discharge is not less than 100 ns nor more than 550 ns.

38. The method of driving a display deice according to claim 37, further comprising:

increasing, after the voltage of said driving pulse is reduced by the second discharge, the voltage of the driving pulse, to induce a third discharge subsequently to the second discharge.

39. The method of driving a display deice according to claim 38, wherein inducing the third discharge further comprises repeating an operation for increasing, after the voltage of the driving pulse is reduced by the discharge, the voltage of the driving pulse, to continuously induce discharges a plurality of times subsequently to the second discharge.

40. The method of driving a display device according to claim 37, characterized in that said driving pulse includes a driving pulse which makes a transition from a first potential to a second potential and takes a maximal value and a minimal value at least once during a transition from the first potential to the second potential, and further comprising driving the driving pulse such that a transition speed from a predetermined extreme value to the second potential is lower than a transition speed from the first potential to an extreme value immediately after that and a transition speed from a subsequent extreme value to another extreme value immediately after that.

41. A method of selectivity discharging a plurality of discharge cells to display an image, comprising:

detecting a lighting rate of discharge cells which are simultaneously turned on out of said plurality of discharge cells; and applying a driving pulse to a selected discharge cell to induce first discharge; and increasing a voltage of the driving pulse to induce a second discharge subsequent to the first discharge.

42. The method of driving a display device according to claim 41, wherein inducing the first and second discharges comprises:

increasing the voltage of the driving pulse applied to the selected discharge cell, to induce the first discharge, and increasing the voltage of the driving pulse to induce the second discharge after inducing the first discharge, and changing the driving pulse in accordance with the detected lighting rate.

43. The method of driving a display deice according to claim 42, wherein inducing the second discharge comprises increasing, after the voltage of the driving pulse is reduced by the first discharge, the voltage of the driving pulse, to induce the second discharge subsequently to the first discharge, and changing the timing at which the voltage of the driving pulse is increased in accordance with the detected lighting rate.

44. A display device for selectively discharging a plurality of discharge cells to display an image, comprising:

a display panel that includes said plurality of discharge cells;

a first driving circuit that applies a driving pulse to a selected discharge cell in said display panel to induce a first discharge; and a second driving circuit that increases a voltage of the driving pulse, to induce a second discharge subsequently to said first discharge, wherein said plurality of discharge cells respectively include capacitive loads, and said first driving circuit comprises an inductance circuit that has at least one inductance element having a first end connected to a capacitive load, and a resonance driving circuit that drives said driving pulse due to LC resonance by said capacitive load and said inductance element.

45. A display device for selectively discharging a plurality of discharge cells to display an image, comprising:

a display panel that includes said plurality of discharge cells;

a first driving circuit that applies a driving pulse to a selected discharge cell in said display panel to induce a first discharge; and a second driving circuit that increases a voltage of the driving pulse, to induce a second discharge subsequently to said first discharge, wherein said first driving circuit comprises a first capacitive element provided outside said display panel as a current supply source for said driving pulse, said first capacitive element recovering charges stored in said discharge cells.

46. A display device for selectively discharging a plurality of discharge cells to display an image, comprising:

a display panel that includes said plurality of discharge cells;

a first driving circuit that applies a driving pulse to a selected discharge cell in said display panel to induce a first discharge; and a second driving circuit that increases a voltage of the driving pulse, to induce a second discharge subsequently to said first discharge, wherein said first driving circuit comprises a first capacitive element provided outside said display panel as a current supply source for said driving pulse, and a voltage source charges said second capacitive element to a predetermined voltage.

* * * * *

UNITED STATES PATENT AND TRADEMARK OFFICE

CERTIFICATE OF CORRECTION

PATENT NO. : 6,900,781 B1
DATED : May 31, 2005
INVENTOR(S) : M. Mori et al.

It is certified that error appears in the above-identified patent and that said Letters Patent is hereby corrected as shown below:

Title page,
Item [30], Foreign Application Priority Data, add
-- April 18, 2000 (JP) 2000/117033 --.

Column 56,
Line 33, “aft” should be -- after --.

Column 57,
Line 32, “fist” should be -- first --.

Column 58,
Line 46, “diving” should be -- driving --.

Column 60,
Lines 11, 17 and 56, ”deice” should be -- device --.
Line 40, after “cells;” delete “and”.

Column 62,
Lines 15 and 16, “first” should be -- second --.

Signed and Sealed this

Third Day of January, 2006

JON W. DUDAS
*Director of the United States Patent and Trademark Office*